United States Patent [19]

Egawa et al.

[11] Patent Number: 4,876,560

[45] Date of Patent: Oct. 24, 1989

[54] RECORDING APPARATUS

[75] Inventors: Jiro Egawa; Naruhito Yoshida; Toshihiro Kasai; Moriya Nagasawa, all of Kanagawa; Naoaki Ide; Hironobu Machida, both of Yokohama, all of Japan

[73] Assignee: Kabushiki Kaisha Toshiba, Kawasaki, Japan

[21] Appl. No.: 232,222

[22] Filed: Aug. 15, 1988

Related U.S. Application Data

[62] Division of Ser. No. 9,349, Jan. 30, 1987.

[30] Foreign Application Priority Data

Jan. 31, 1986 [JP] Japan ..... 61-18235

[51] Int. Cl.[4] ..... G03G 15/00

[52] U.S. Cl. ..... 346/153.1; 355/14 R; 355/3 SH

[58] Field of Search ..... 355/14 C, 14 R, 14 SH, 355/3 SH, 3 R, 14 CU; 346/153.1, 155, 76 L, 78

[56] References Cited

U.S. PATENT DOCUMENTS 4,586,808 5/1986 Tanimoto et al. ..... 355/14 C X 4,588,284 5/1986 Federico et al. ..... 355/14 R 4,711,556 10/1987 Abuyama ..... 355/14 R

*Primary Examiner*—A. C. Prescott

*Attorney, Agent, or Firm*—Cushman, Darby & Cushman

[57] ABSTRACT

A recording apparatus according to the present invention in which a data is recorded by charging a driven recording medium, scanning laser beams on the driven recording medium to form electrostatic latent images thereon, and developing and transferring the electrostatic latent image, comprises a charger for charging the driven recording medium; and at least two image forming device disposed around the recording medium for recording multi-colored and/or uni-colored data in a plurality of print modes. In the recording apparatus, the print modes is controlled so as to drive the second image forming device corresponding to the second print mode after the operation of the first print mode is closed, when the second print mode is designated in the operation of the first image forming means corresponding to the first print mode. And, the driver for driving the recording medium is controlled so as to continuously drive the recording medium when the first print mode is switched to the second print mode by the switching device. The image forming device comprises device for forming an electrostatic latent image on the recording medium by scanning laser beams in accordance with the recording data and device for developing the electrostatic latent image.

3 Claims, 88 Drawing Sheets

Non magnetic Single component Development using a Superposed Bias of AC and DC

FIG.40

| | First Laser | Second Laser |
|---|---|---|
| 1 Collimater Coupling Ffficiency | 85.6% | 85.6% |
| 2 Collimator Transmission Facter | 97% | 97% |
| 3 Prism Surface | 99.5% Third surface=98.5% | |
| 4 Polygonal Mirror Reflectivity | 78% | 78% |
| 5 fθ Lens Transmission Factor | 97% | 97% |
| 6 Reflecting Mirror Reflectivity | 98% 2=96% | 98% 3=94.1% |
| 7 Trasparent Glass Transmission Factor | 98% | 98% |
| 8 Dirt | 90% | 90% |
| Overall | 52.4% | 52.1% |

Potential Correction with Consideration on Temperature

FIG.46(A)

| Address | Content | |
|---|---|---|
| 4000<br>4001 | First color top margin table | |
| 4002<br>4003 | Second color top margin table | |
| 4004<br>4005 | Left margin table | |
| 4006<br>4007 | A3 | Bottom margin table |
| 4008<br>4009 | | Right margin table |
| | ⋮ | |
| 4080<br>4081 | A6 | Bottom margin table |
| 4082<br>4083 | | Right margin table |
| 4090<br>~ | Top margin coarse adjustment tabl | Switch 1, 2, ~, n |
| 40B0<br>~ | Top margin fine adjustment table | Switch 1, 2, ~, n |
| 40D0<br>~ | Left margin coarse adjustment table | Switch 1, 2, ~, n |
| 4100<br>~ | Left margin fine adjustment table | Switch 1, 2, ~, n |
| 4120<br>~ | Z beam scan table | Switch 1, 2, ~, n |

FIG.46(B)

| Address | Content | |
|---|---|---|
| 6000<br>6001 | Red toner | First development bias table |
| 6002<br>6003 | | Second development bias table |
| 6004<br>6005 | Blue toner | First development bias table |
| 6006<br>6007 | | Second development bias table |
| 6008<br>6009 | Green toner | First development bias table |
| 600A<br>600B | | Second development bias table |
| 600C<br>600D | Black toner | First development bias table |
| 600E<br>600F | | Second development bias table |
| | | |
| 6100<br>6101 | First charging potential control | Surface potential table |
| 6102<br>6103 | | Error in converging |
| 6104<br>6105 | | First time control output |
| 6106<br>6107 | | Minimum correction |
| 6108<br>6109 | | Surface potential limit |
| 610A<br>610B | | Control output upper limit |
| 610C<br>610D | | Control output lower limit |
| 610E<br>610F | Second charging potential control | Surface potential table |
| 6110<br>6111 | | Error in converging |
| 6112<br>6113 | | First time control output |
| 6114<br>6115 | | Minimum correction |
| 6116<br>6117 | | Surface potential limit |
| 6118<br>6119 | | Control output upper limit |
| 611A<br>611B | | Control output lower limit |
| | | |
| 6120<br>~ | Temperature correction charging potential | 40C Correction table<br>~<br>10C Correction table |

( Normal Development → Normal Development ) Type ( Inverted Development → Normal Development ) Type

FIG.49(A)

| Command | Abreviation of command | Function |
|---|---|---|
| 01H | SR1 | Status 1 request |
| 02H | SR2 | Status 2 request |
| 04H | SR3 | Status 3 request |
| 07H | SR4 | Status 4 request |
| 08H | SR5 | Status 5 request |
| 03H | SR6 | Status 6 request |
| 20H | SR7 | Status 7 request |
| 23H | CSTU | Indicate casset top |
| 25H | CSTL | Indicate casset bottom |
| 26H | VSYNC | Start image data transfer |
| 29H | SP1 | Indicate first color printing mode |
| 2AH | SP2 | Indicate second color printing mode |
| 2CH | DP1 | Two color |
| 31H | MF1 | Indicate manual feeding(A4 longitudinal) |
| 32H | MF2 | Indicate manual feeding(A4 longitudinal) |
| 34H | MF3 | Indicate manual feeding(A4 transverse) |
| 37H | MF4 | Indicate manual feeding(A5 longitudinal) |
| 38H | MF5 | Indicate manual feeding(A6 longitudinal) |
| 33H | MF6 | Indicate manual feeding(A4 longitudinal) |
| 3DH | MF7 | Indicate manual feeding(A5 longitudinal) |
| 3EH | MF8 | Indicate manual feeding(A5 transverse) |
| 40H | MF9 | Indicate manual feeding(A6 longitudinal) |

FIG.49(B)

| | D 7 | D 6 | D 5 | D 4 | D 3 | D 2 | D 1 | D 0 |
|---|---|---|---|---|---|---|---|---|
| Status 1 | | Paper in transport | | VSYNC | Manual feeding | Cassete top/bottom | Printing mode | First color mode / Second color mode / Two color mode |
| Status 2 | | | Cassette size(top) | | | Cassette size(bottom) | | |
| Status 3 | | | Toner color(first color) | | | Toner color(second color) | | |
| Status 4 | | | Test/maint | Data re-sending | In waiting | Operater call | Serviceman call | |
| Status 5 | | | Toner bag exchang | No paper | Paper jam | No first color toner | No second color toner | |
| Status 6 | | | | First laser failure | Second laser failure | Scan moter failure | First potential sensor failure | Second potential senser failure |
| Status 7 | | | | | | Re-sending page number | | |

FIG.63(B)
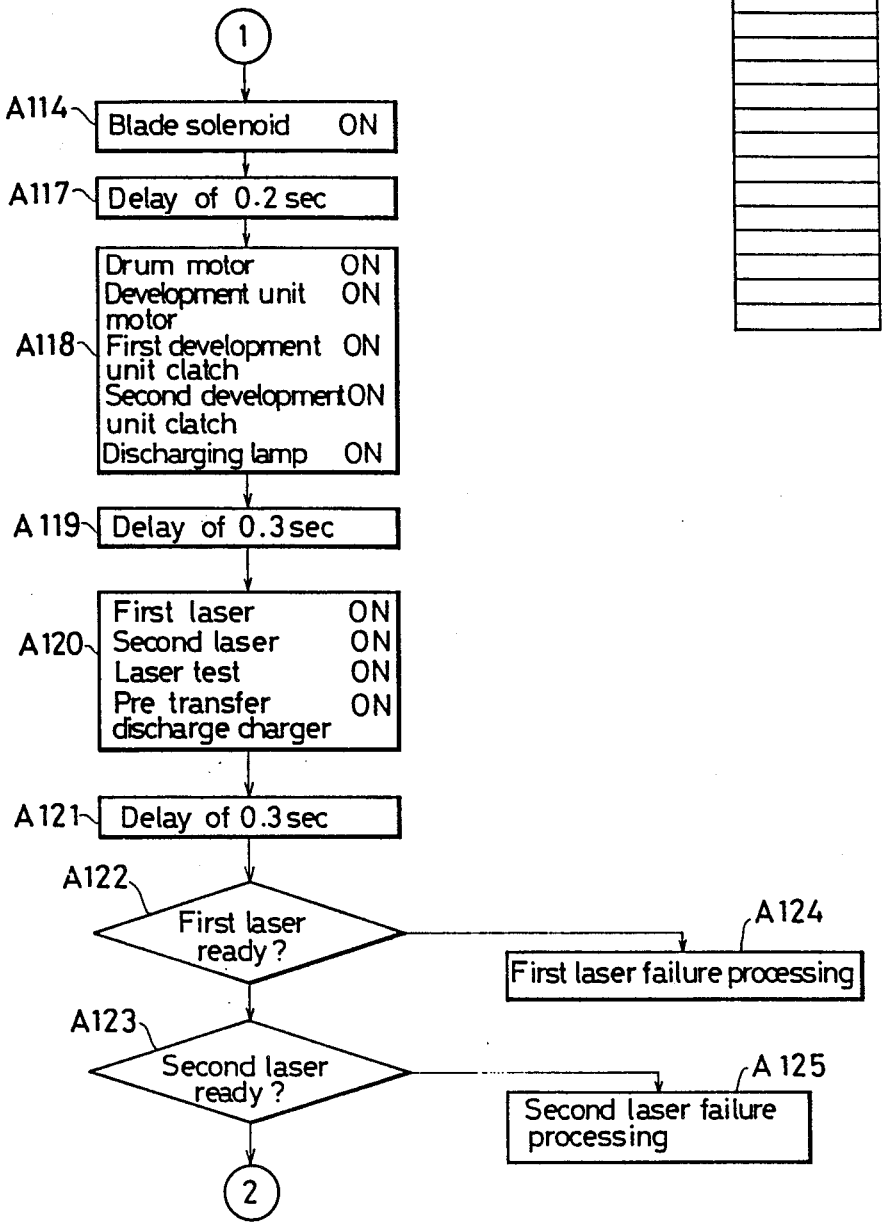
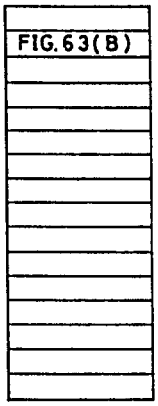

FIG.63(D)
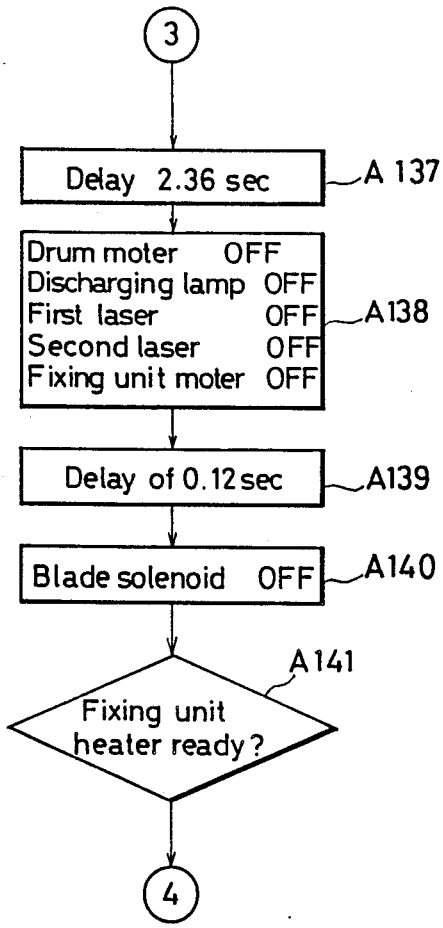
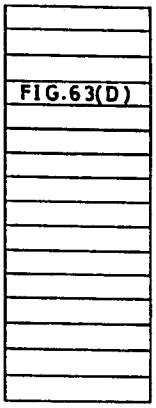

FIG.65(A)
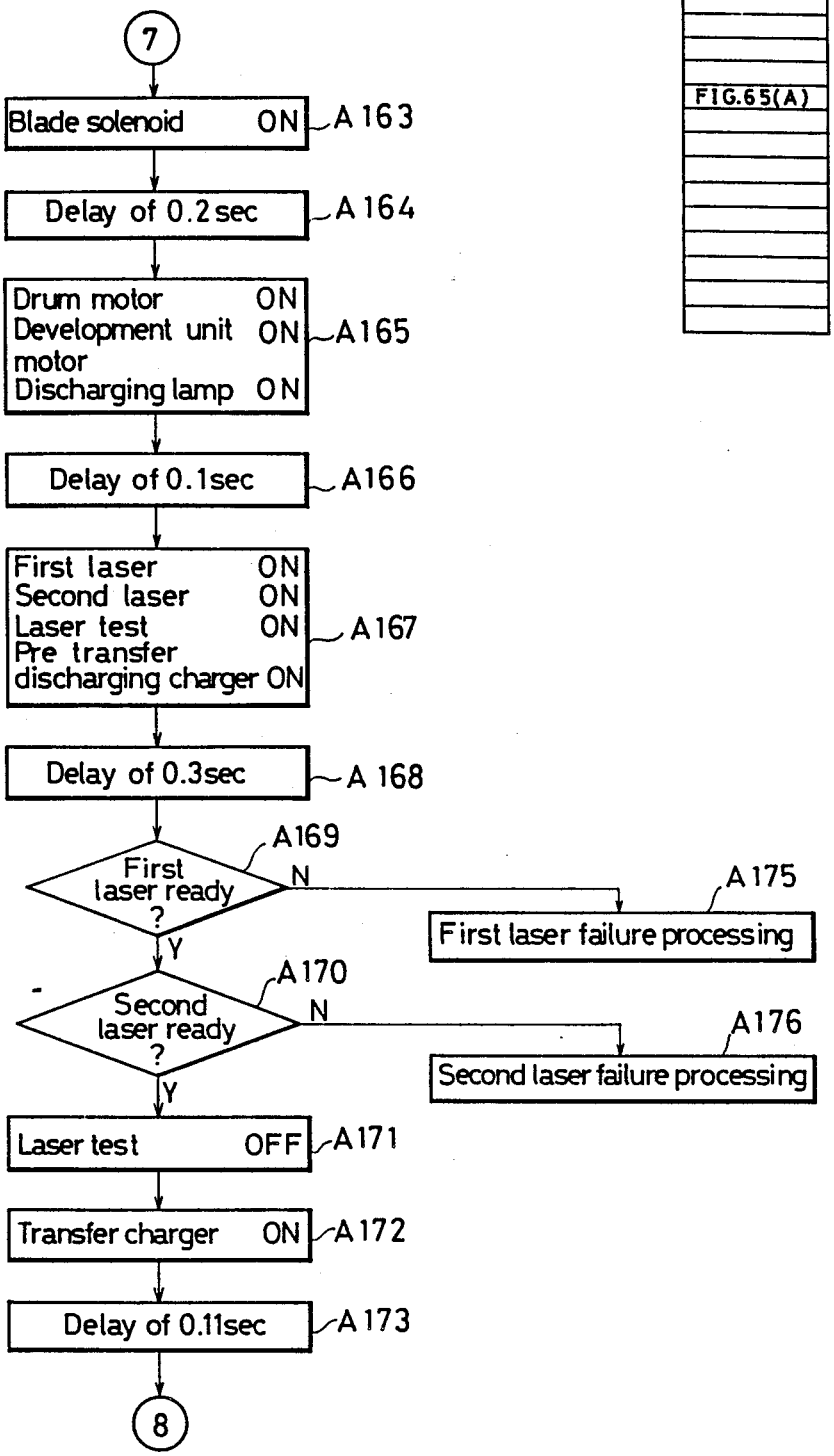
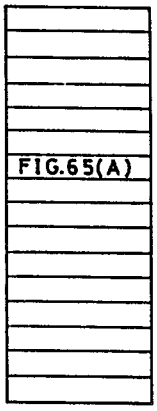

FIG.65(B)
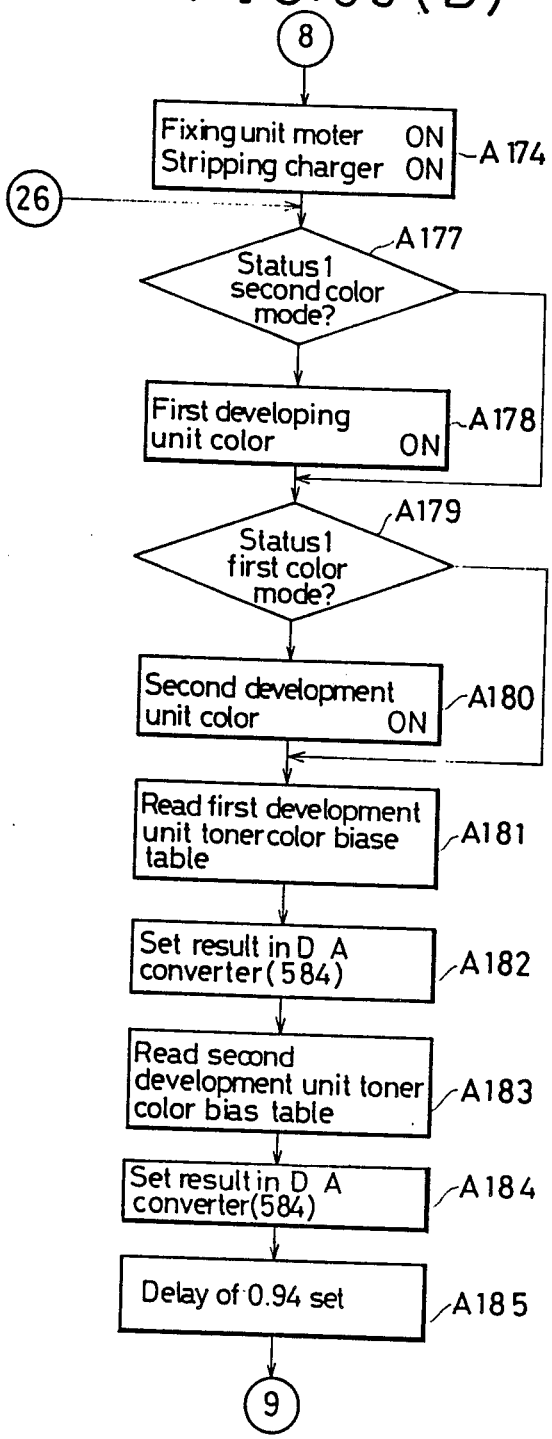
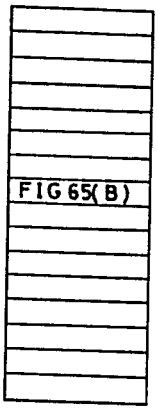

FIG.66(C)
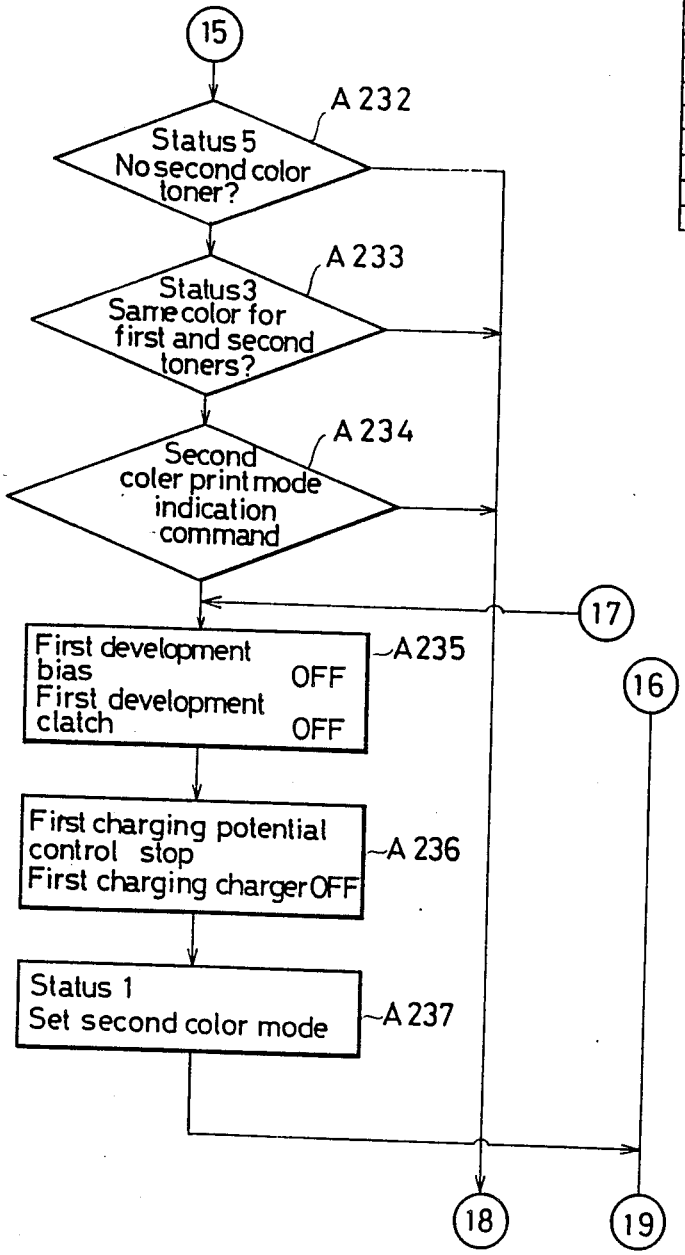
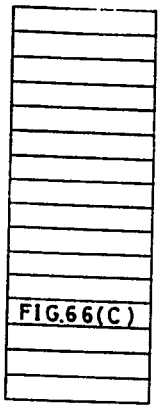

A 248
IPREQ ON
24
A 249
IPRNT ON
Y
N
A 250
5 sec passed since IPREO ON?
Y
N
A 251
IPREQ OFF
A 252
IPRDY OFF
25
A 253
Status1 First color mode?
Y
N
A 254
First charging potential control
A 255
Status1 Second coler mode?
Y
N
A 256
Second charging potential control STOP
28
A 266
Is this after change of print mode ?
Y
N
26
27

FIG.67(B)
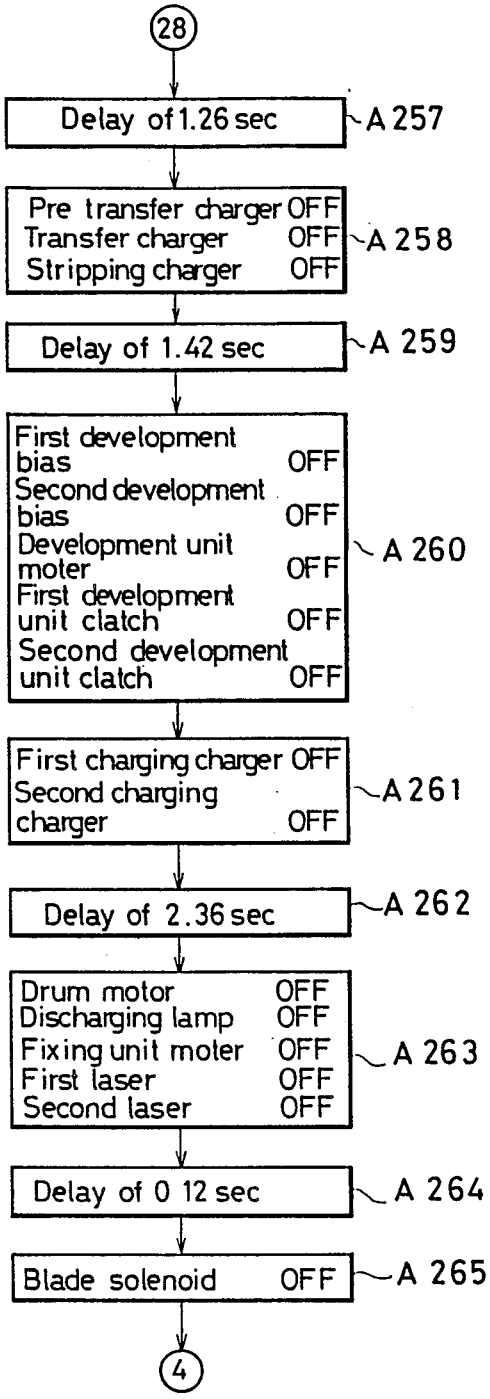
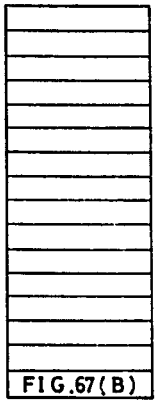

RECORDING APPARATUS

This is a division of application Ser. No. 009,349, filed Jan. 30, 1989.

BACKGROUND OF THE INVENTION

1. Field of the Invention

The present invention relates to a recording apparatus which includes a process of forming electrostatic latent images on a changed recording medium by means of irradiation of laser beams, and more particularly, to a recording apparatus which is capable of recording multi-colored information on the recording medium with a plurality of laser beams.

2. Description of the Prior Art

A recording apparatus of the above kind includes, as shown, for instance, in FIG. 73, a drum-shaped photosensitive body 100 as the recording medium. In the periphery of the photosensitive body 100 there are arranged successively along the direction of rotation shown by the arrow, a first charger 101, a first exposure unit 102, a first developing unit 103, a second charger 104, a second exposure unit 105, a second developing unit 106, a transfer-stripping charger 107, a cleaner 110, and a discharger 109. One cycle of process is completed by electrically charging the photosensitive body 100 uniformly with the first charger 101, forming a second electrostatic latent image by the second exposure section 105, visualizing a second color by the second developing unit 106, carrying out a control processing if needed to equalize the amount of charges by the two color toners, though not shown, transferring dichromatic information onto a transfer material 108 with the transfer-stripping charger 107, cleaning with the cleaner 110 the toner that remains on the photos ensitive body 100 after transfer, and erasing the latent images with the discharger 109.

However, the existing apparatus has the second developing unit 106 which is of contact development type so that even when there is formed a first toner image 103*a* which is brought out to be visible, for example, by the first developing unit 103 as shown in FIG. 74(A), there may occur a case in which a portion of the first toner image 103*a* is scraped off by the second developing unit 106 as shown in FIG. 74(B). Then, in response to the exposure condition of the second exposure section 105, second toner 106*a* may be piled up by the second developing unit 106 over the first toner image 103*a* as shown in FIG. 74(C).

On the other hand, when the first toner 103*a* that was scraped off by the second developing unit 106 is sent into the inside of the second developing unit 106 to be mixed with the second toner 106*a* as shown in FIG. 75, the life of the developer (consisting of a carrier and a toner) will undergo a sharp reduction.

Further, in the case of the dichromatic printing process in which both of the first developing unit 103 and the second developing unit 106 are operated in the normal development mode, the changes in the surface potential of the photosensitive body 100, the conditions of the toner on the photosensitive body 100, and so forth will change as illustrated in FIG. 76(A).

Namely, due to charging by the first charger 001, the surface potential of the photosensitive body 100 is raised, and when the normal exposure is given using the first exposure section 102, only the information zone which is irradiated by the laser beam is maintained at a high potential to form an electrostatic latent image, leaving the outside of the information zone at a low potential. The electrostatic latent image is brought out to be visible using a negatively charged toner by the first developing unit 103. When the photosensitive body 100 is charged again in this state by the second charger 104, the surface potential of the photosensitive body 100 returns to nearly the level of the first charged state and the surface toner on the electrostatic latent image is transformed to a state in which it is charged positively by the appended charges.

Next, when the photosensitive body 100 is exposed normally by the second exposure section 105, there is formed an electrostatic latent image with high potential in the information zone, and at the same time there remains the image that was visualized in the past by the first developing unit 103. Further, an electrostatic latent image is brought out visible by the second developing unit 106 in a second exposure using negatively charged toner. A small amount of the toner is attached also to the electrostatic latent image due to the first exposure The electrostatic latent image that is brought out to be visible in this manner by the two normal development modes is transferred onto the transfer material 108.

In addition, in the case of the dischromatic printing process in which the first developing unit 103 is operated in the inverted development mode and the second developing unit 106 is operated in the normal development mode, the surface potential of the photosensitive body 100 due to charging by the first charger 101 is raised, and an inverted exposure is carried out by the first exposure section 102 as shown in FIG. 76(B), bringing the information zone alone in low potential to form an electrostatic latent image, with the area outside of the information zone maintained at high potential. The electrostatic latent image is brought out to be visible by the first developing unit 103 due to positively charged toner. When the photosensitive body 100 is charged in this state again by the second developing unit 104, the surface potential of the photosensitive body 100 returns to approximately the level of the first charging.

Next, when the photosensitive body 100 is exposed normally by means of the second exposing section 105, the information zone becomes an electrostatic latent image with high potential, and the image that was brought out visible by first developing unit 103 remains as is. Then, the electrostatic latent image due to the second exposure is brought out visible by the second developing unit 106 with negatively charged toner, and a small amount of the toner is attached also to the electrostatic latent image due to the first exposure After carrying out a pre-transfer charging with a charger which is not shown in order to give the same polarity to the electrostatic latent images that are brought out visible in this manner by the inverted development mode and the normal development mode, each of the electrostatic latent images that are brought out to be visible is transferred onto the transfer material 108.

In the case of the conventional dichromatic printing process by the combination of the normal-normal development modes or the dichromatic printing process by the combination of the inverted-normal development modes, there is necessarily involved a process of charging a toner with the charge that has the polarity that is opposite to the polarity of the toner.

In particular, in the dichromatic printing process by the combination of the inverted-normal development modes, the polarity of the toner used varies for each development mode so that there is an inconvenience in that in order to transfer simultaneously both electrostatic latent images that are brought out to be visible onto the transfer material 108, there has to be given a pre-transfer charging to invert the polarity of one of the toners. Moreover, when the dichromatic printing process is employed in which development is carried out in the inverted mode after development in the normal mode, there also arises the necessity of carrying out a pre-transfer charging.

Furthermore, in the dichromatic printing process of the combination of the normal-normal development modes, the toner is the same in each of the developing units. However, it is inevitable to have the opposite charge on the toner, at the time of recharging with the second charger 104, as shown in FIG. 76(A).

When the opposite charge appears on the toner, although each image is transferred later with corona of respective polarity, it is clear that the efficiency for each is lower than that for the ordinary monochromatic transfer.

However, when a high resistance is given to the toner in order to enhance the transfer efficiency and to secure a stable development in a humid atmosphere, there arises a problem that the toner which sits on the photosensitive body inverts the polarity so that it is difficult to invert the polarity even with the reversed charging.

In addition, when the thickness of the toner layer on the photosensitive body is large, the toner layer is laminated in multiple layers rather than in a single layer. In such a case, when the top layer in particular is inverted, it prevents the transfer of the opposite charge to the inner toner layers, so that there is a problem that the toner polarity in the lower layers is difficult.

Moreover, the existing color copier in practice is of the type in which an image is transferred onto a transfer paper or an intermediate transfer drum for each color, and this process is repeated, to complete the full color print, so that this method can also be applied to the recording apparatus of the type under consideration.

However, in that case, the copying speed will have to be reduced sharply since a sheet of copy is obtained by repeating the process similar to the above.

Furthermore, in the existing recording apparatus of the above kind, when printing is done in only one color, if, for instance, while the apparatus is in printing operation in a first color, a second color is designated, then the printing operation in the second color will be initiated by temporarily interrupting the rotational driving of the photosensitive body simultaneous with the completion of printing operation in the first color. Therefore, the copying speed will have to be reduced in some cases.

SUMMARY OF THE INVENTION

The object of the present invention which was conceived in view of the above circumstances, is to provide a recording apparatus which is capable of maintaining a high copying speed always.

In order to achieve the above object, the recording apparatus of the present invention is characterized in that, while the apparatus is in printing operation in one monochromatic printing mode which was accepted by the apparatus in the past, when there is given an indication that demands another monochromatic printing mode from within or without the apparatus, the apparatus accepts the indication upon completion of the printing operation in the monochromatic printing mode that was accepted in the past. In addition, the apparatus includes switching means which switches the electrostatic latent image formation means and the development means so as to respond to the other monochromatic printing made mentioned above, and control means which controls, when making a transition to the control which carries out a predetermined printing operation in response to the switching operation of the switching means, the rotational drive of the photosensitive body in continuation to the monochromatic printing mode that was accepted in the past.

BRIEF DESCRIPTION OF THE DRAWINGS

FIG. 40 is a diagram for showing the efficiency of optical system for the first and the second beams, FIGS. 46A & 46B are a diagram which shows the content of the ROM data table, FIGS. 49A & 49B are a detailed explanatory diagram for the command and the status that are used for the dichromatic LBP.

DESCRIPTION OF THE PREFERRED EMBODIMENT

Figure 1:
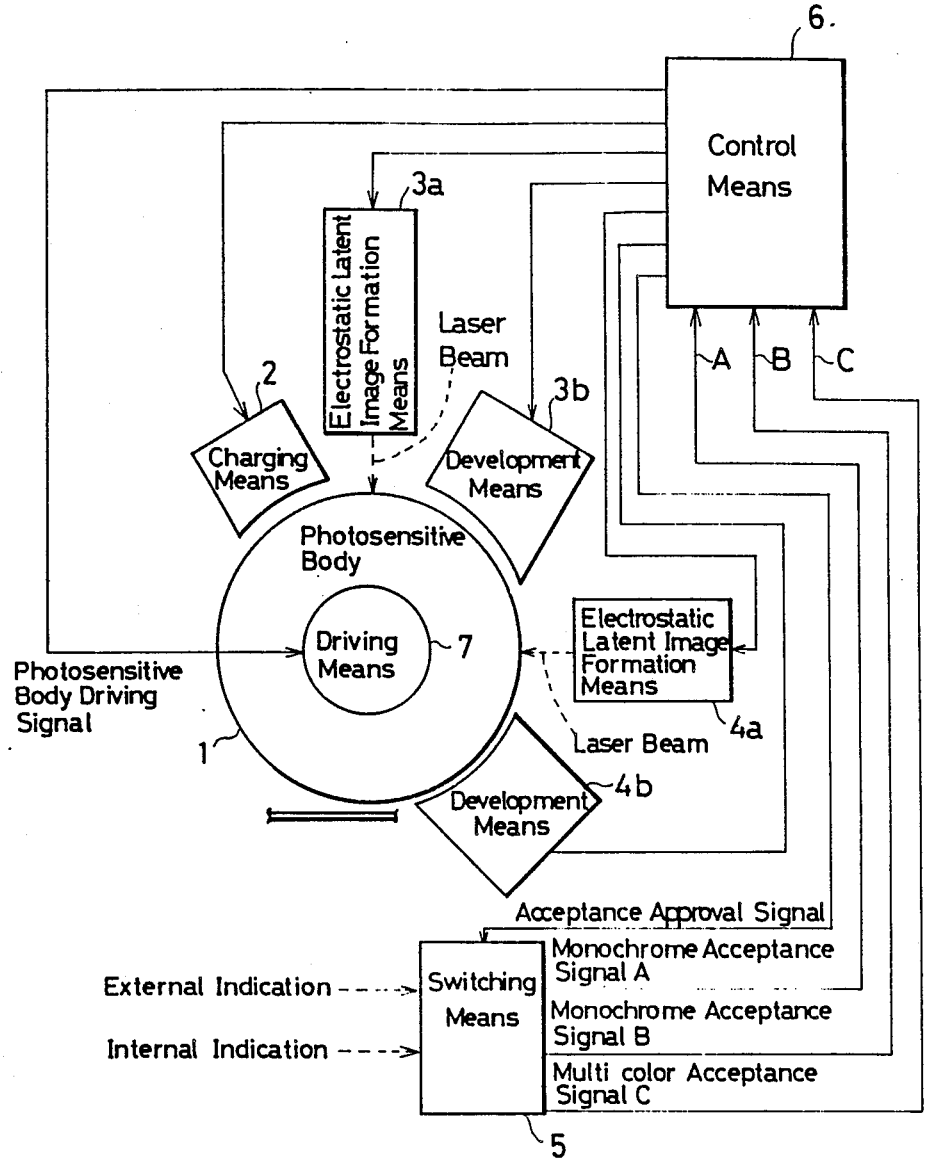
FIG. 1 is a block diagram which shows an outline of the recording apparatus of the present invention.

Referring to the drawings, an embodiment of the present invention will be described in detail.

FIG. 1 is a block diagram which shows an outline of a recording apparatus of the present invention.

The recording apparatus has in the periphery of a photosensitive body 1, charging means 2, the combination of electrostatic latent image formation means 3*a* and development means 3*b* for a first color, and the combination of electrostatic latent image formation means 4*a* and development means 4*a* for a second color.

When an acceptance approval signal is issued from control means 6 to switching means 5, if there comes in an indication for demanding a monochromatic printing mode of a first color alone from, for example, outside or inside, a monochromatic acceptance signal A for the first color is applied from the switching means 5 to the control means 6. By this arrangement, the control means 6 activates the electrostatic latent image 3*a*, the development means 3*b*, and others to carry out the printing operation with the first color.

When there is given an indication, during printing operation with the first color, that requests a monochromatic printing mode with the second color alone that comes from the outside or from the inside of the apparatus, by the issuance of an acceptance approval signal from the control means 6 to the switching means 5 upon completion of the printing operation according to the monochromatic printing mode with the first color alone, there is supplied a monochromatic printing acceptance signal B with the second color from the switching means 5 to the control means 6. Then, the control means 6 controls driving means 7, when printing operation is to be carried out with the second color by activating the electrostatic latent image formation means 4*a*, the development means 4*b*, and others, so as to drive to rotate the photosensitive body 1 in continuation of the monochromatic printing mode with the first color.

Further, when there is given to the switching means 5 an indication to request a multi-color printing mode from the outside or from the inside, and when the indication is accepted by the switching means 5, a multicolor printing acceptance signal C is supplied to the control means 6. Based on this, the control means 6 carries out the control of activation states simultaneously for the electrostatic latent image formation means 3*a*, 4*a* and the development means 3*b* 4*b* for the first color and the second color.

Figure 2:
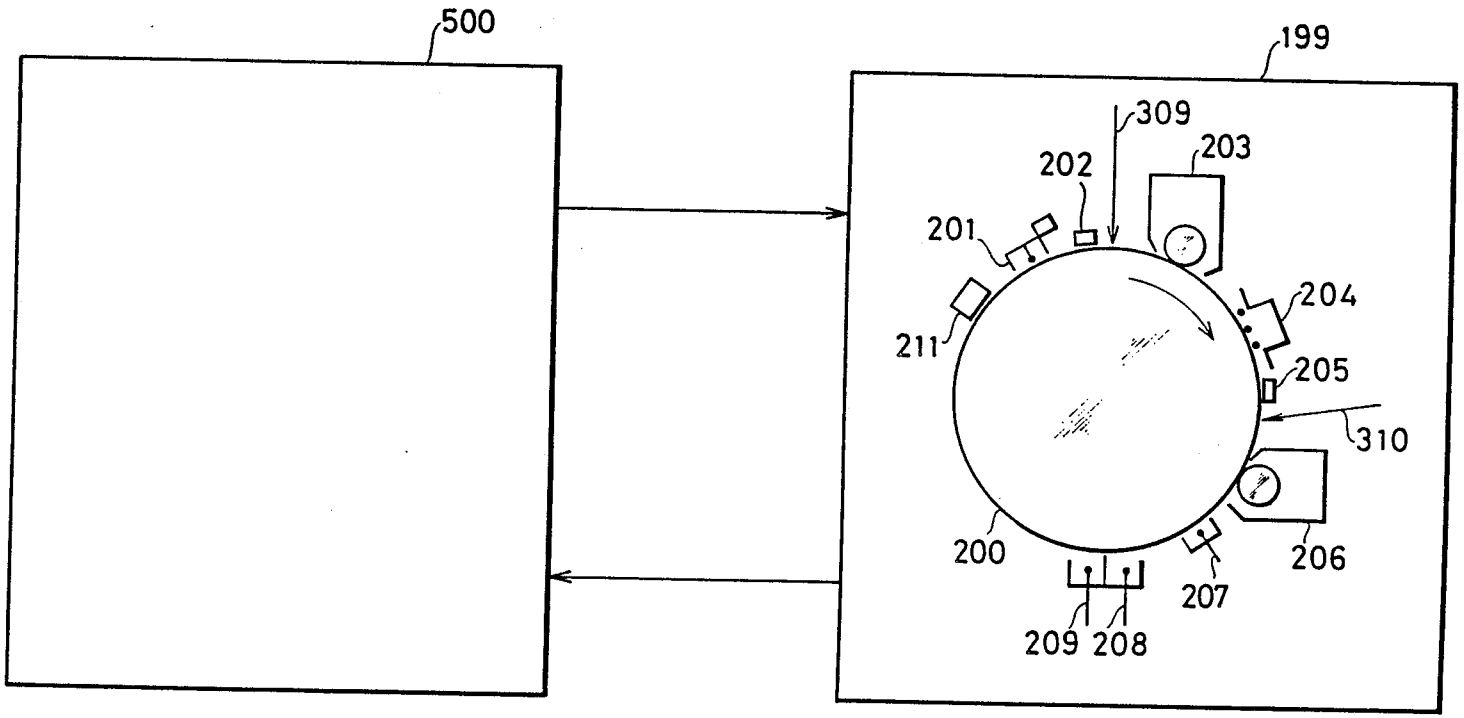
FIG. 2 is a diagram which shows an overall schematic configuration of the system for an example of the dichromatic LBP to which is applied the recording apparatus of the present invention.

FIG. 2 is a diagram which shows a schematic configuration for the entire system of an example of a dichromatic LBP to which is applied the recording apparatus of the present invention.

The dichromatic LBP 199 is joined to a host system 500 (an external apparatus such as an electronic computer and a word processor) via a transmission controller (interface circuit or the like) which is not shown. In this arrangement, the system receives two kinds of dot image data from the host system 500, modulates two laser beams to carry out writing on the photosensitive body. The two kinds of dot image data that are written are developed independently and they are transferred onto a recording paper.

Namely, in the interior of the dichromatic LBP 199 there are provided various components shown in FIG. 1 as the fundamental components for image formation. In the figure, 200 is a drum-shaped photosensitive body. In the periphery of the photosensitive body 200, along the direction of rotation indicated by the arrow there are arranged successively a first charger 201, a first surface potential sensor 202, a first developing unit 203, a second charger 204, a second surface potential sensor 205, a second developing unit 206, a pretransfer charger 207, a transfer charger 208, a stripping charger 209, a cleaner 210, and a discharger 211. A first exposure is carried out by irradiating the photosensitive body 200 with a first laser beam 309 between the first surface potential sensor 202 and the first developing unit 203. In addition, the system has a configuration in which a second exposure is carried out with a second laser beam 310 between the second surface potential sensor 205 and the second developing unit 206.

Figure 3:
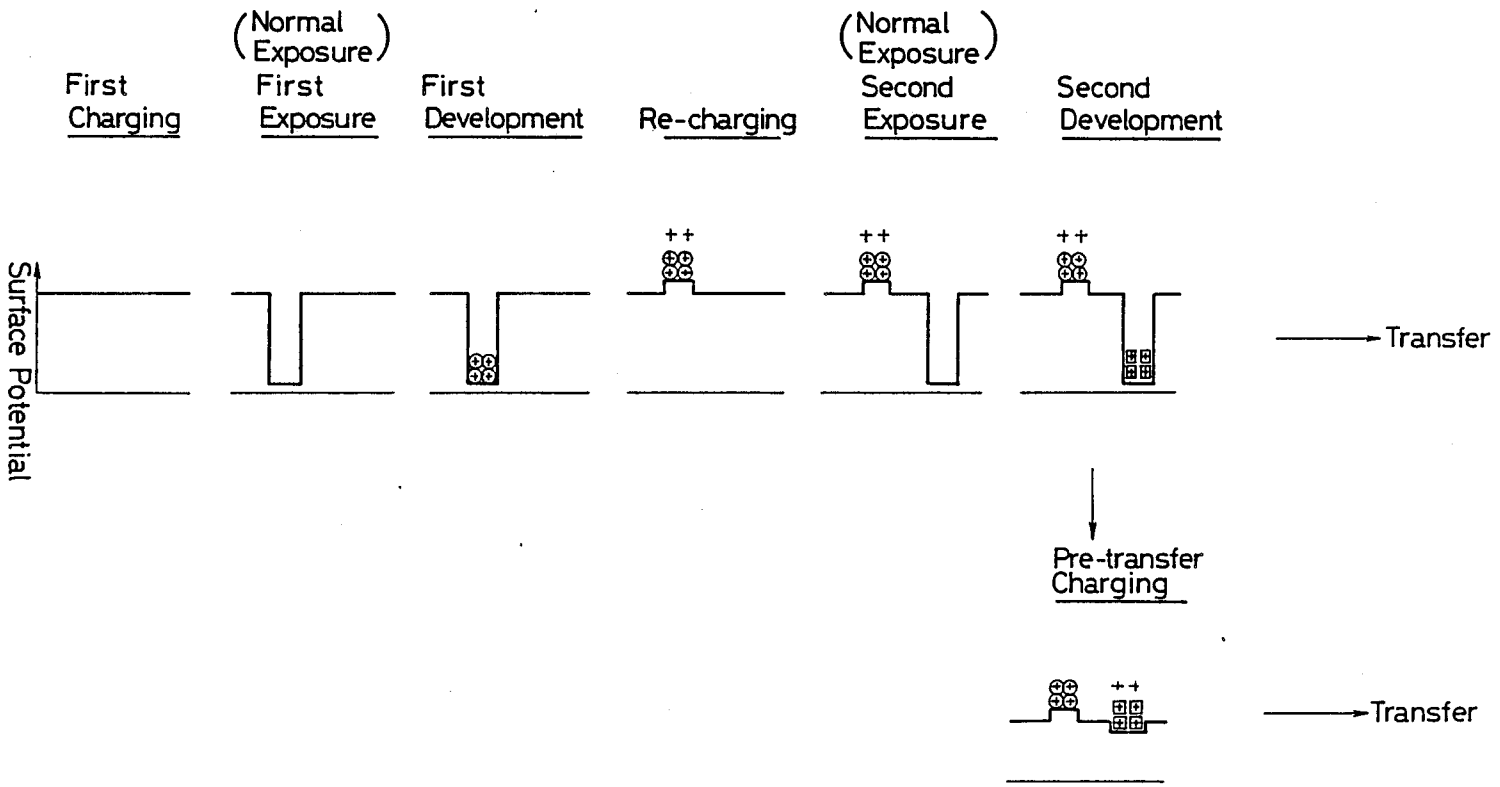
FIG. 3 is a schematic transitional diagram in accordance with the processes, for the changes in the surface potential of the photosensitive body, the toner condition on the photosensitive body, and the like, in the LBP to which is applied the present invention, FIG. 4 an overall configurational diagram for the image formation unit in the LBP to which is applied the present invention, FIG. 5

In addition, from the viewpoint of eliminating the problems that exist in the conventional development mode which is a combination of the development modes, a dichromatic printing process which is activated by two inverted development modes is employed in the present invention. In this case, changes in the surface potential of the photosensitive body 200, conditions of the toner on the photosensitive body 200, and others vary as shown in FIG. 3.

Namely, the surface potential of the photosensitive body 200 is raised by the charging with the first charger 201, and by the irradiation with the first laser beam 309, an inverted development is carried out to create an electrostatic latent image in the information zone which is brought to low potential while the outside of the information zone is maintained at high potential. The electrostatic latent image is brought out to be visible by the first developing unit 203 with a positively charged toner. When the photosensitive body 200 is charged again in this state with the second developing unit 204, the surface potential of the photosensitive body 200 returns approximately to the level of the first charging. Next, when the photosensitive body 200 is invertedly exposed by the irradiation of the second laser beam 310, this information zone becomes an electrostatic latent image with low potential, and the image that was brought out to be visible previously by the first developing unit 203 remains as is. Then, the electrostatic latent image due to the second exposure is brought out to be visible with a positively charged toner by the second developing unit 206. In that case, the image that was brought out to be visible by the first development will not be affected by the second development since it is formed by a positively charged toner.

Both of the electrostatic latent images that are brought out to be visible by the two inverted development modes are toner images of positive polarity so that it is possible to transfer them onto a transfer material as they are. In that process of transfer, there will be generated a difference in the transfer efficiency because of the differences in the charges of the two kinds of toner and in the potentials of the photosensitive body on the rear of the toner images. However, there is no difference in the polarity, in contrast to the case of the prior art where there is one in the mutual relation of the toner images, so that the practical problem is only slight.

Of course, it is possible match the transfer conditions of two kinds of toner image by the execution of a pretransfer charging after the completion of the second development with the pretransfer charger 207.

Figure 4:
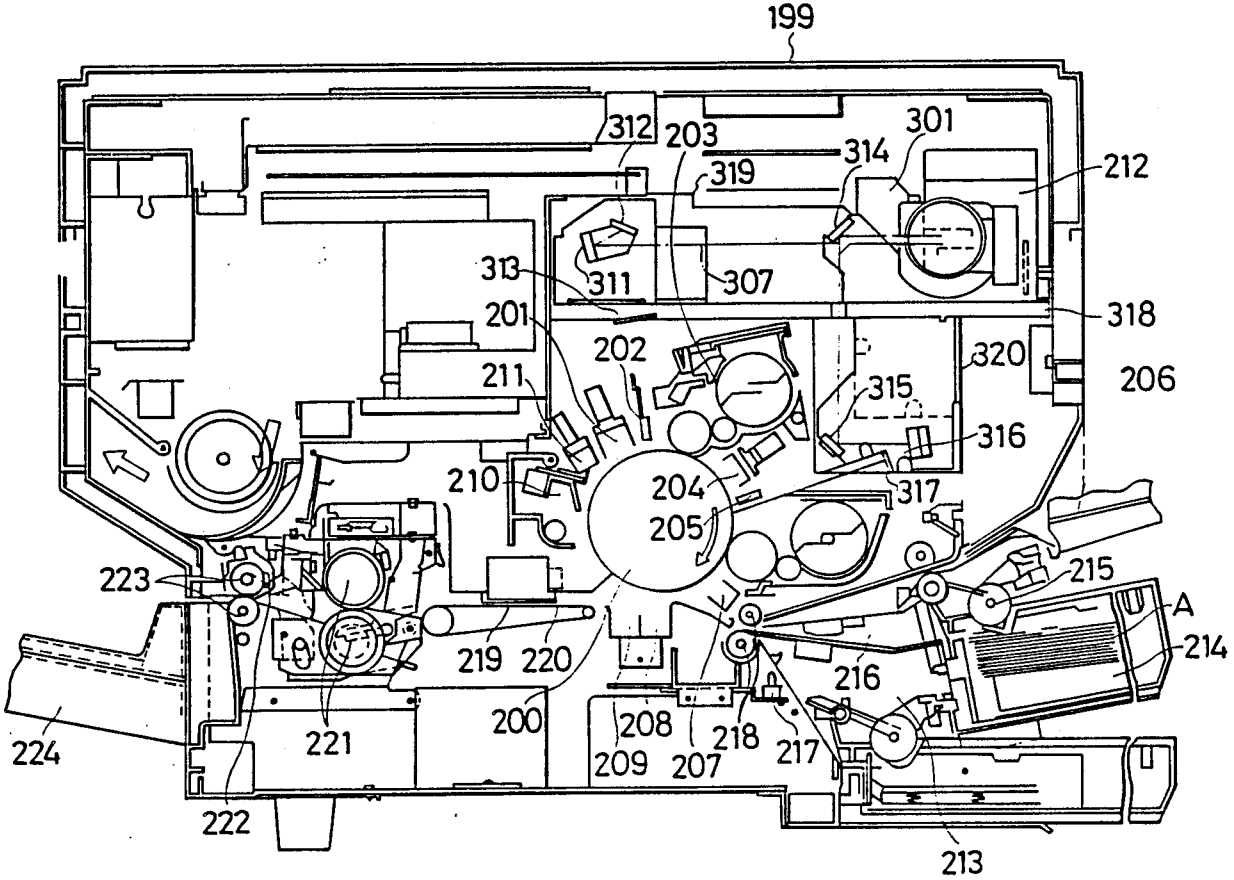

FIG. 4 is a configurational diagram which shows the entirety of the image formation unit in a dichromatic LBP which is an embodiment of the present invention In the embodiment, similar to FIG. 2, there are arranged successively in the circumference of the photosensitive body 200, along the direction of rotation shown by the arrow, a first charger 201, a first surface potential sensor 202, a first developing unit 203, a second charger 204, a second surface potential sensor 205, a second developing unit 206, a pretransfer charger 207, a transfer charger 208, a stripping charger 209, a cleaner 210, and a discharger 211.

In addition, 212 is a polygonal scanner unit, 213 is a paper feeding device, 214 is an upper paper feeding cassette, 215 is an upper paper feeding roller, 216 is a first transportation route, 217 is a preresist pulse sensor, 218 is a pair of resist rollers, 219 is a second transportation route, 220 is an adsorption belt, 221 is a fixing unit, 222 is a paper ejection switch, 223 is a pair of paper ejection rollers, and 224 is a tray for ejected paper.

Of the various parts enumerated in the above, the photosensitive body 200 has an outer peripheral surface of Se—Tc layer. Because of this, the first charger 201 is made as a corona charger with positive polarity. The first charger gives a charged potential of 600 V or 1,000 V to the photosensitive body 200.

The first surface potential sensor 202 detects the charged condition of the photosensitive body 200 by the first charger 201.

In the stage following the first surface potential sensor 202, the photosensitive body 200 undergoes a first exposure under the irradiation of the first laser beam 309 that is reflected from the polygonal scanner unit 212 to form an electrostatic latent image on the photosensitive body 200 due to the first exposure.

Figure 5:
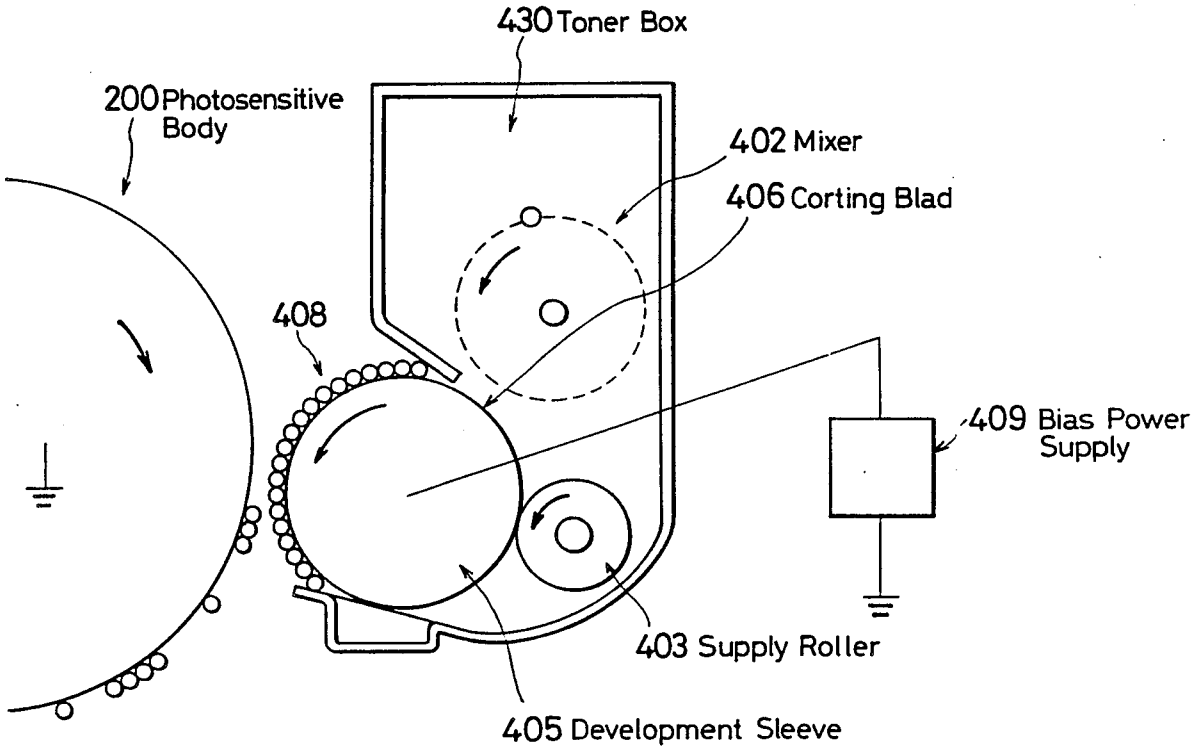
Figure 6:
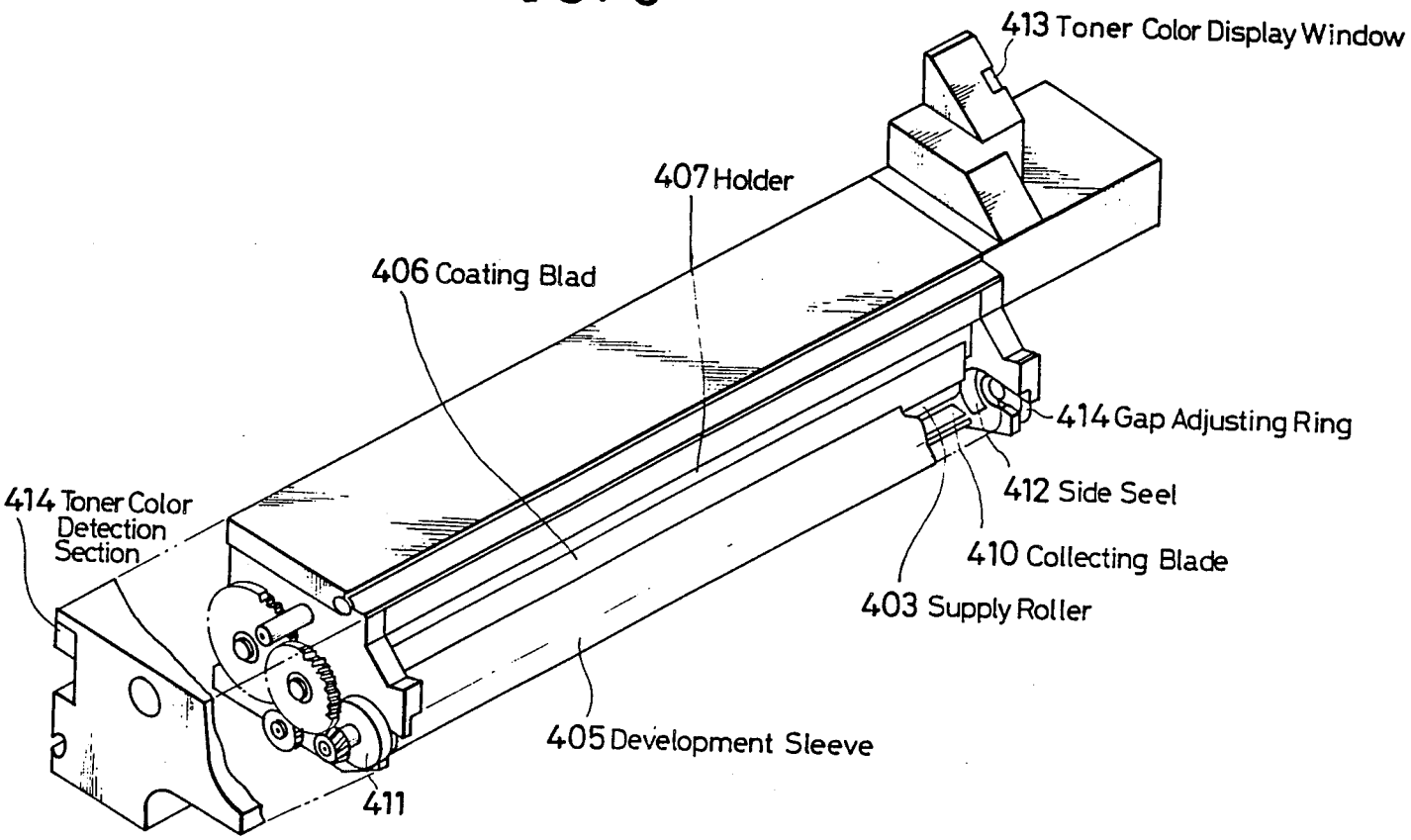
FIG. 6 is a configurational diagram for the first developing unit, FIG. 7 a curve for development characteristic of the first developing unit.

The first developing unit 203 which develops the electrostatic latent image due to the first exposure, is a nonmagnetic single component developing unit with sectional view as shown in FIG. 5 and external appearance as shown in FIG. 6.

In the first developing unit 203, a development sleeve 405 is moved at an approximate relative speed of zero with respect to the photosensitive body 200. On the development sleeve 405, a toner layer is coated by a coating blade 406, and the electrostatic latent image on the photosensitive body 200 due to the first exposure is brought out to be visible by the toner layer.

Between the photosensitive body 200 and the development sleeve 405, there is given a predetermined gap. The gap has an appropriate size in response to the case of using a DC power supply alone for the bias power supply and to the case of using a superposed power supply of AC and DC power supplies. Namely, for the case of using a DC power supply alone, it is appropriate to choose the gap in the range of 50 to 300 μm while it is appropriate to choose it in the range of 80 to 500 μm in the case of a superposed power supply. In the present embodiment, a gap size of 150 μm was chosen for the case of a DC power supply alone, and a size of 200 μm for the case of a superposed power supply.

In FIG. 5, 402 is a mixer, 406 is a coating blade, and 408 is a toner.

Further, in FIG. 6, 403 is a supply roller, 407 is a holder, 410 is a blade, 411 is a gap adjusting ring, 412 is a side seal, 413 is a toner color display window, and 414 is a toner color detection section.

Figure 7A:
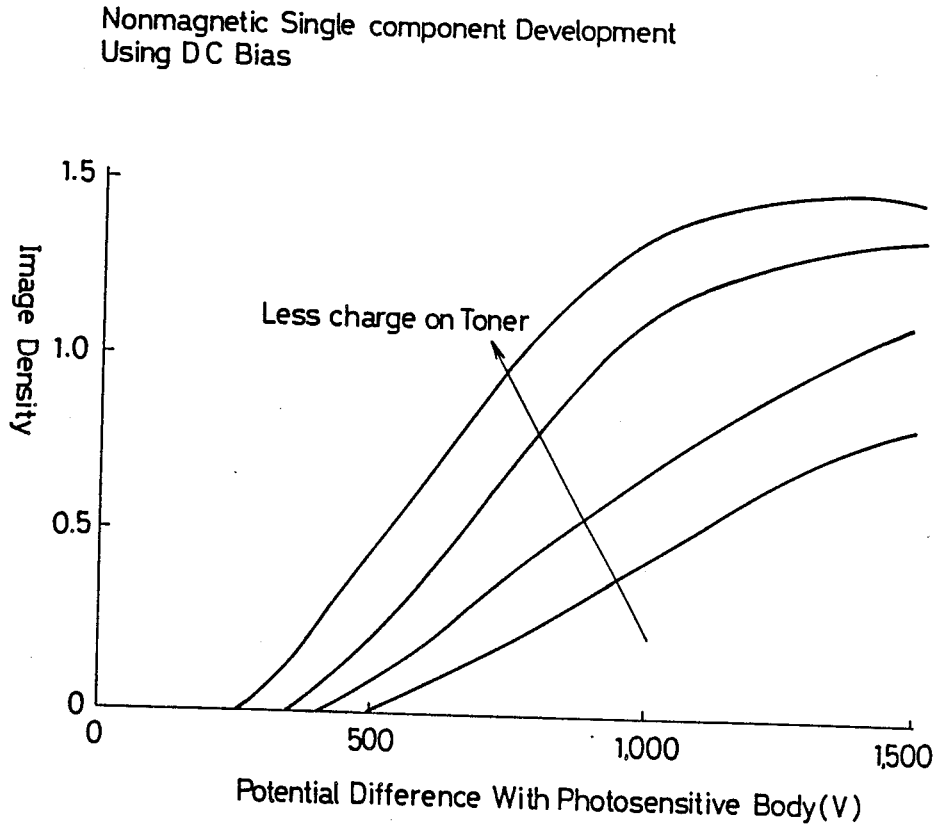
Figure 7B:
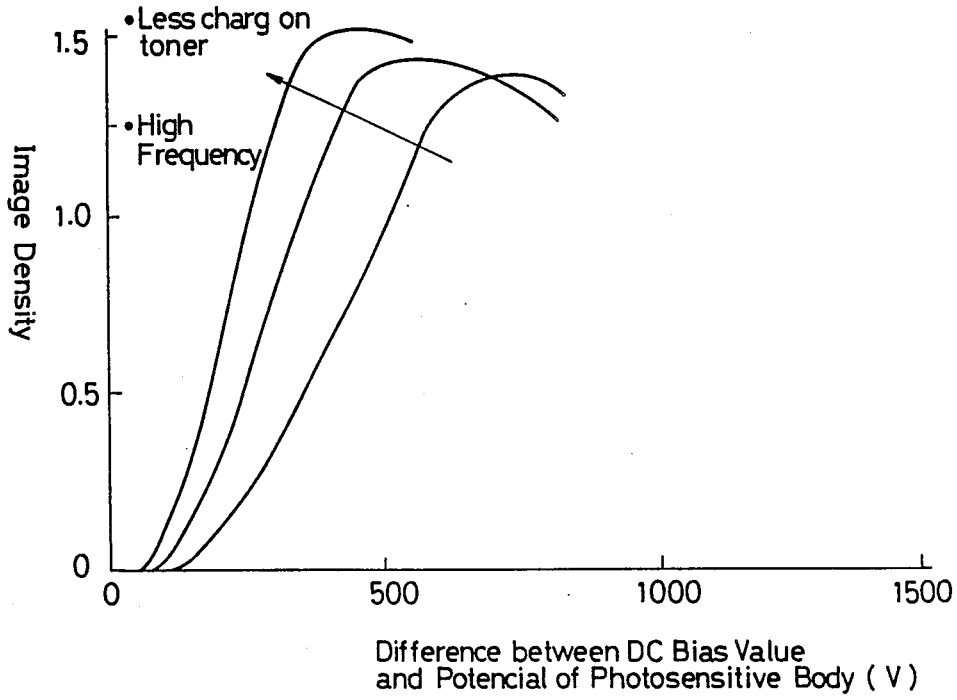
Figures 8, 9, 10:
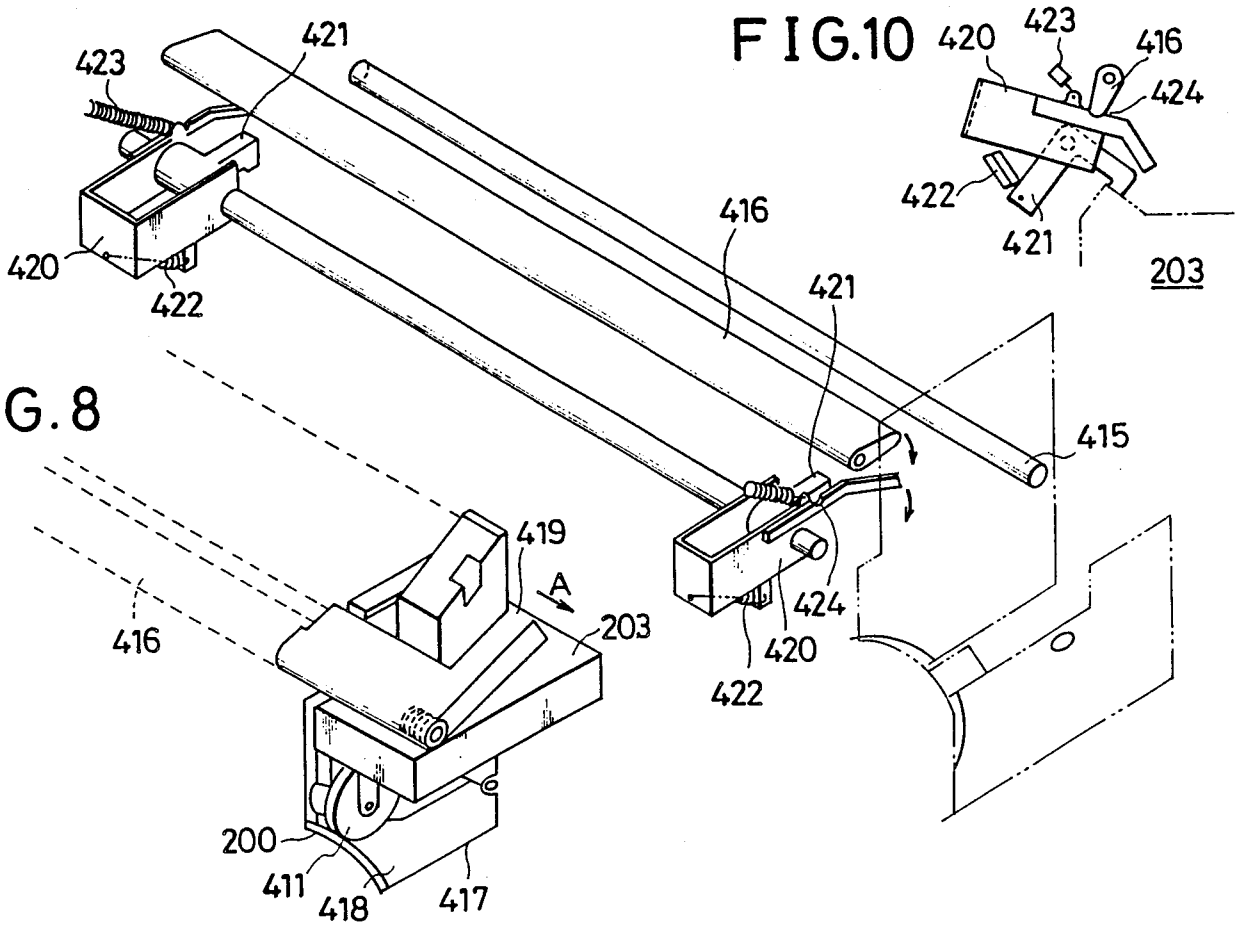
FIG. 8, FIG. 9, FIG. 10 are diagrams for illustrating the configuration in installing a first developing unit to the dichromatic LBP.

Moreover, nonmagnetic single-component development characteristic in the case of a DC bias power supply is as shown in FIG. 7(A), and nonmagnetic single-component development characteristic in the case of a superposed bias power supply of AC and DC is as shown in FIG. 7(B).

Next, the structure for installing the first developing unit 203 on a dichromatic LBP 199 will be described in detail by making reference to FIG. 8, FIG. 9, FIG. 10, and FIG. 11.

To begin, the first developing unit 203 is inserted into an aperture 418 in a frame 417 of the dichromatic LBP 199. A shaft 415 spans the frame 417 and a frame on the opposite side (not shown), and supports the rotation of the first developing unit 203. The first developing unit 203 is inserted by hooking it to a guiding plate 416 with the shaft 415 as the guiding shaft. The guiding plate 416 is rotated together with a handle 419. After insertion of the first developing unit 203, when the handle 419 is turned in the direction of the arrow A, the guiding plate 416 is also moved in the same direction, and the first developing unit 203 is moved with the shaft 415 as the center of turning. As a result, the gap adjusting ring 411 makes a contact with the photosensitive body 200. As the guiding plate 416 is rotated, a lever 420 is moved to be fitted in a notch 424, and is fixed in a predetermined position. A developing unit pressing lever 421 is moved by a spring 422 interlocked with the lever 420. As a result of this action, the lever 421 gives the first developing unit 203 a force to press the photosensitive body 200. When the handle 419 is turned in the direction opposite to that of the arrow A, the guiding plate 416 is turned also in the same direction, and further, the levers 420 and 421 are turned in the counterclockwise direction by the force of a spring 423 which is attached to the lever 420. As a result, the energizing force to the developing unit is removed, and the first developing unit 203 is removed from the photosensitive body 200 by the guiding plate 4.

Figure 11A:
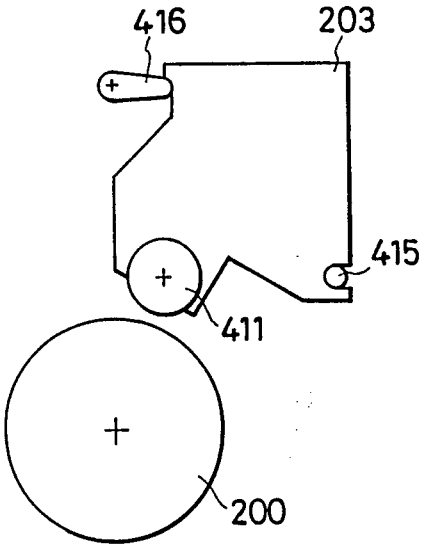
FIGS. 11A and 11B are an explanatory diagram for the modes of accessing and removing the first developing unit from the photosensitive unit.
Figure 11B:
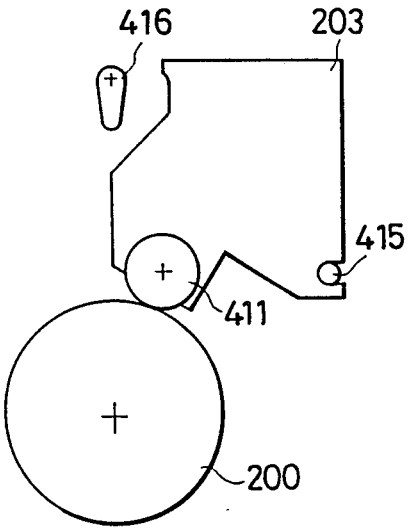

FIG. 11(A) illustrates the situation in which the first developing unit 203 is to be attached or to be removed, while FIG. 11(B) illustrates the contact of the first developing unit 203 with the photosensitive body 200.

Figure 12:
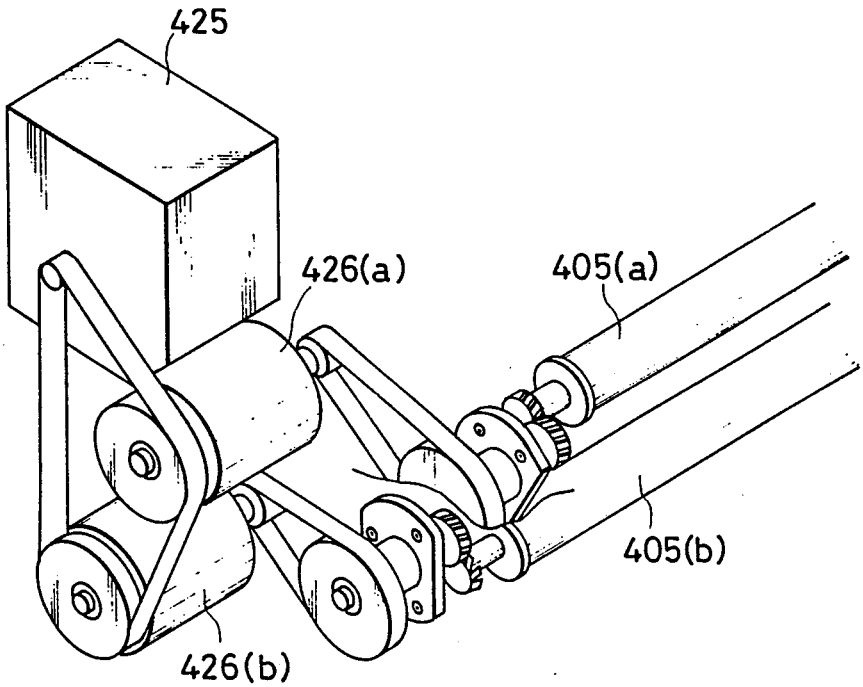
FIG. 12 is a perspective diagram for the developing unit driving mechanism.
Figure 13:
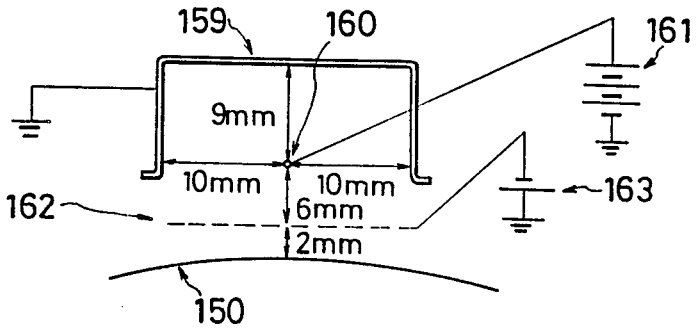
FIG. 13 is a configurational diagram for the schorotron charger that is applied to the second charger.

FIG. 12 shows the driving section for the developing unit. The driving force from a developing unit driving motor 425 is transmitted to clatches 426(*a*) and 426(*b*). Choice between the first developing unit 203 and the second developing unit 206 is decided by the color of the printing. When the first developing unit 203 is selected, a clatch 426(*a*) is activated to turn the development sleeve 405(*a*) of the first developing unit 203. When the second developing unit 206 is activated, a clatch 426(*b*) is activated to turn the development sleeve 405(*b*) of the second developing unit 206.

Next, the photosensitive body 200 is charged again by the second charger 204. In this process, unevenness in the potential created on the surface of the photosensitive body 200 generated in the various processes up to the first developing is returned to a uniform potential. In the present embodiment, use is made of a schorotron. In the schorotron, a charging wire 160 is applied a voltage of 6 kV, a shielding wire is kept at the ground potential, and a grid 1,200 V is impressed with a voltage of 1,200 V. Reference numerals 161 and 163 are a high tension power supply and a grid power supply, respectively.

Figure 14:
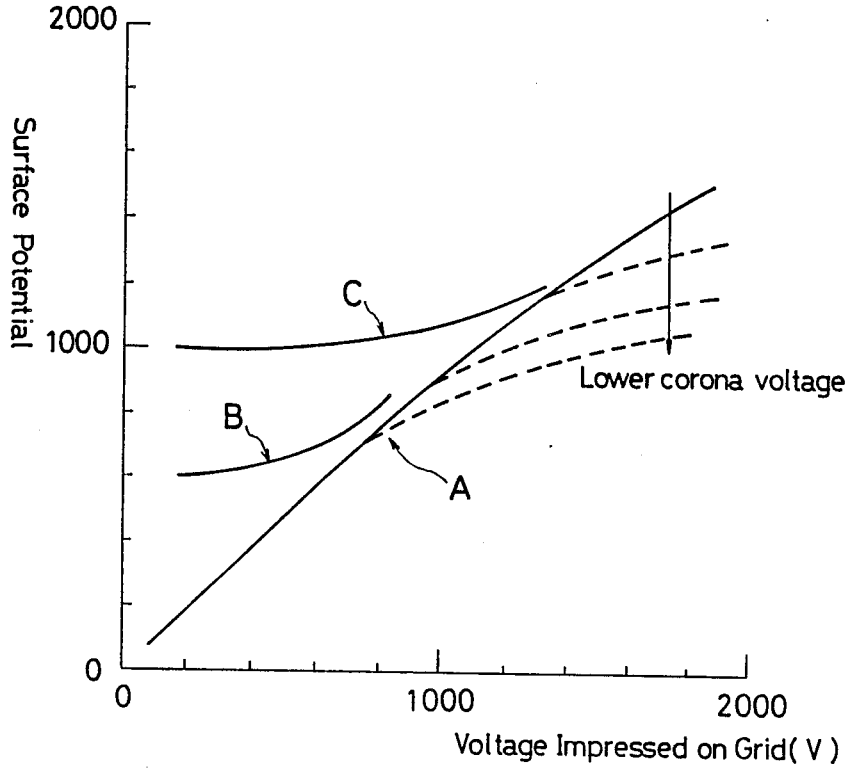
FIG. 14 is a characteristic curve for the schorotron charger.

Further, in FIG. 14 is shown the result of an experiment that illustrates the situation in which the effect of uniformizing the unevenness of potential is obtained by the schorotron. The figure illustrates the variations after passage of the second charger, with the grid voltage as a constant, for the surface potentials 0 V, 600 V, and 1,000 V for curves A, B, and C, respectively.

Here, by comparing curve A with curve B, the way in which the unevenness in the potential of the photosensitive body 200 generated by the first exposure is uniformized after passage of the second charger, will be seen clearly. Namely, when a superposed development of AC and DC is employed for the first development, the unevenness in the potential of the photosensitive body 200 can be made less than several tens of volts if the grid voltage of the second charger is kept greater than 800 V.

Further, comparing curve A with curve C (the case of using a DC development as the first development), the potential difference can be made less than several tens of volts if the grid voltage is greater than 1,300 V. In the present embodiment, a grid voltage of 1,300 V was adopted because of the use of a DC noncontact single component development for the second development, as will be described later. In that case, the voltage after the second development was about 1,120 to 1,180 V for both of the first image information portion and other portions.

The second surface potential sensor 205 detects the charged state of the photosensitive body 200 due to the second charger 204.

In the stage following the second surface potential sensor 205, analogous to the first exposure, second laser beam 310 that is reflected by the polygonal scanner unit 212 is illuminated on the photosensitive body 200 to carry out a second exposure and to form an electrostatic latent image due to second exposure on the photosensitive body 200.

Figure 15:
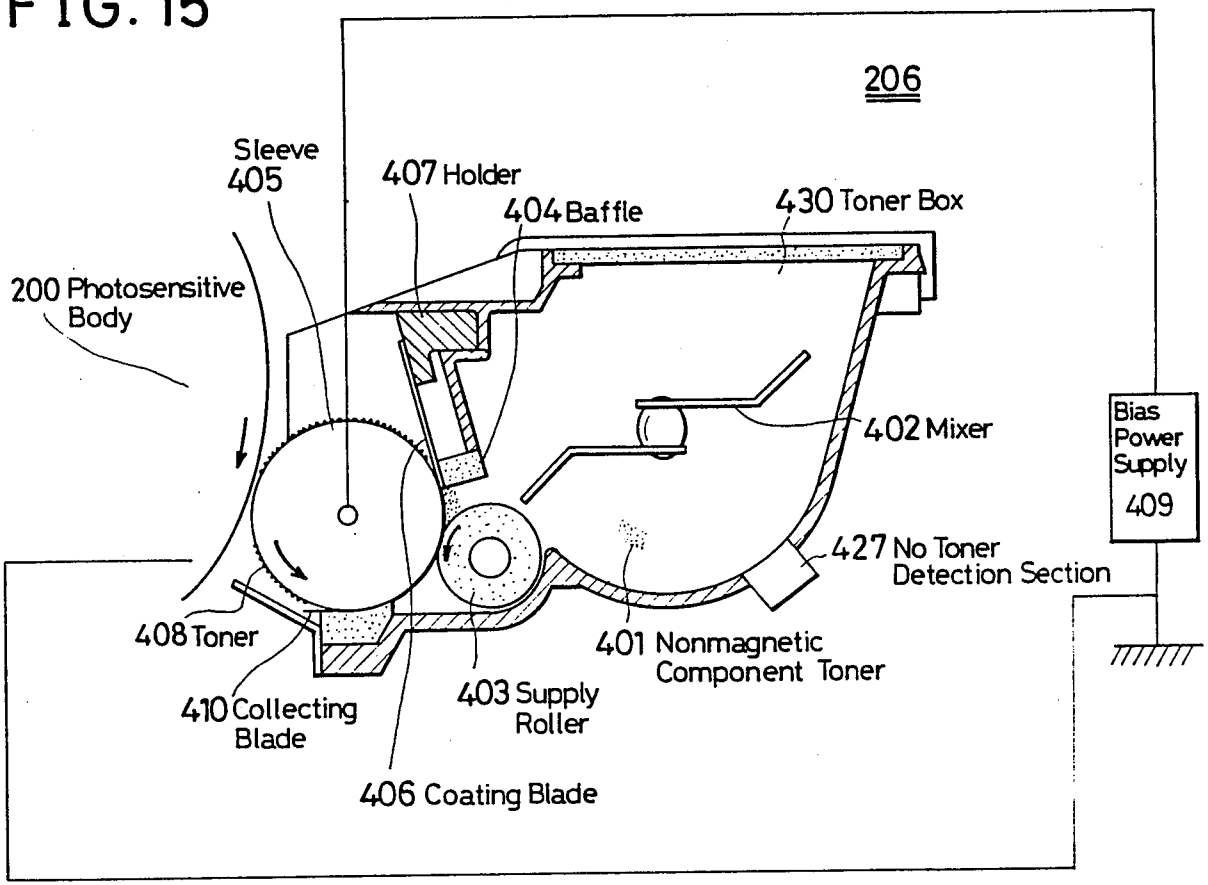
FIG. 15 is a diagram for illustrating the configuration of the second developing unit.

The second developing unit 206 which develops the electrostatic latent image due to the second exposure has a sectional form as shown in FIG. 15. If a nonmagnetic single-component toner 401 is present in its interior, the nonmagnetic single-component toner 401 is sent in to the gap between a baffle 40 and a supply roller 403 by means of a mixer 402 and the supply roller 403. The outer peripheral surface of the supply roller 403 is of soft material made of polyester-based polyurethane foam, and is made porous by separate bubbles. Since the supply roller 403 is rotated in the direction opposite to that of the development sleeve 405 by making contact with it, the supply roller 403 scrapes off toner 108 that remains on the development sleeve 405 without contributing to the development, and attaches fresh toner 401 on the development sleeve 405. The development sleeve 405 is formed by sand blasting, for example, the surface of an aluminum sleeve, and then by giving an effective fabrication. Reference numeral 406 is a development blade which is made of a thin stainless steel plate of thickness 0.15 mm. In the state fixed to a holder 407, the development blade 406 gives a force of 1,000 g/mm to the development sleeve 405 that makes contact with it. Toner 401 which is attached to the development sleeve 405 is made into a thin layer and is charged uniformly by passing the gap between the development sleeve 405 and the development blade 406. Here, between the development sleeve 405 and the photosensitive body 200, there is applied a voltage of the bias power supply 409.

The bias power supply 409 is a DC bias. In applying the DC bias, the following three conditions have to be satisfied, Namely, (a) It should be sufficient to develop the image information portion (the portion of potential erasure in the second exposure).

(b) It should not spoil the portion outside of the image (the unexposed portion in the second exposure).

(c) It should not attract the toner of the first image after the second charging.

Figure 16:
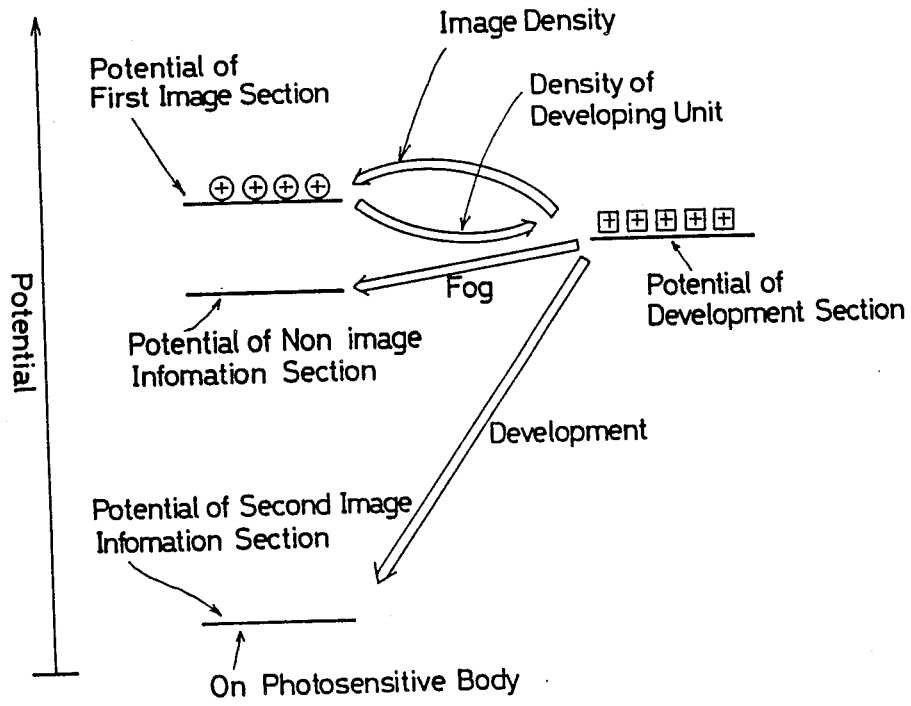
FIG. 16 is a diagram which shows schematically the development conditions of the second developing unit.

FIG. 16 illustrates schematically the state of the toner motion in order to show potentials that are suitable and potentials that are unsuitable for satisfying these conditions.

First, condition (a) corresponds to the toner motion as indicated by "development" in FIG. 16. This is due to the difference on the photosensitive body of the potential at the development portion (potential of the development sleeve) and the potential at the laser beam irradiation portion. Its development characteristic for the case of development with a DC bias is shown in FIG. 16 to have a characteristic similar to that shown in FIG. 7(A). It was found that a potential difference greater than 900 V is required in order to obtain a sufficiently high image density.

Next, it will be clear from FIG. 7(A) that the result of subtraction of (the potential for the area outside of the image information portion) from (the potential of the developing unit) should be less than 250 V in order to avoid the generation of a fog.

Figure 17:
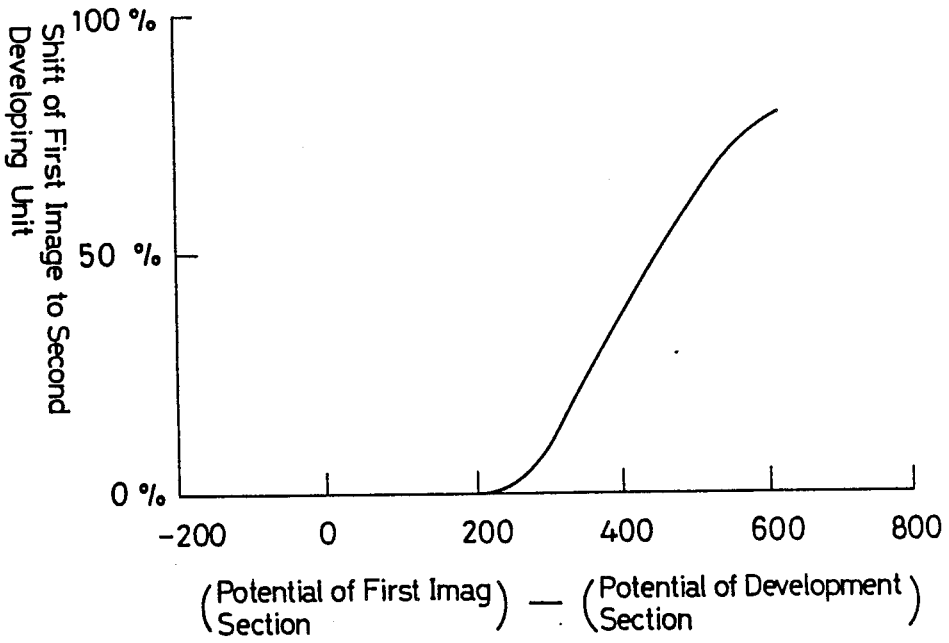
FIG. 17 is a characteristic curve for reversed attachment of a first image to the second developing unit.

Further, the relation between the potential of the second developing unit and the potential of the first image portion is the same as the relation for a fog, in the aspect of color mixing of the image. The color mixing in the developing unit corresponds to the toner motion which is opposite to that in the above, and the result of the experiment is as shown in FIG. 17. From the figure, it will be seen that the result of subtraction of (the potential of the second developing unit) from (the potential of the first developing unit) has to be less than 200 V.

Consequently, it was found that the following relationships among various potentials have to be satisfied in order to obtain satisfactory superposed images that have no color mixing.

(Potential of the second developing unit)
(Potential of the second image information portion) 900 V.
(Potential of the second developing unit)
(Potential of the nonimage information portion of the second image) >250 V.
(Potential of the second developing unit)
(Potential of the first image portion) >250 V.
(Potential of the first image portion)
(Potential of the second developing unit) <200 V.

The potential of the first image portion after a recharging by the second charger may be higher or may be lower than the potential of the second developing unit depending upon the conditions such as the toner concentration.

Next, in the present embodiment, pretransfer charging is carried out for the photosensitive body 200 using a pretransfer charger 207 as was mentioned in conjunction with FIG. 3.

An effect required by the pretransfer charging process is to equalize the potentials of the first and second images. Then,.it is possible to make the transfer conditions of the two images nearly equal and obtain a satisfactory dichromatic image as a result of carrying out transfers with almost no difference under identical transfers.

Another effect required is to improve the detachability in removing a transfer paper from the photosensitive body 200. This is required because, in the case of inverted development, the charge polarity on the photosensitive body and the polarity of the transfer corona are opposite each other. Accordingly, the attractive force between the photosensitive body and the transfer paper becomes greater than in the case of the normal development, with a result that the detachability of the transfer paper becoming deteriorated. Namely, the attractive force between the photosensitive body and the transfer paper is arranged to be reduced by lowering the surface potential of the photosensitive body before the transfer.

Now, for reducing the surface potential of the photosensitive body, one may think of discharge using light. However, although the detachability of the transfer paper can surely be improved by this method, it will also generate an inconvenience that the toner image will be spread.

The above phenomenon arises as a result that in the inverted development, the polarity of the potential on the photosensitive body and the polarity of the toner are the same fundamentally, so that the sticking force of the toner to the photosensitive body is weak. When the charges on the photosensitive body is brought to zero by means of the light, the effect of enclosing the toner by the charges of the same polarity in the surrounding will be multified, with a result that the toner image is dispersed by the repulsive force of the toner itself, making it impossible to obtain a satisfactory image quality. For that reason, the pretransfer process has to be able to achieve the following effects.

(a) It reduces the potential of the photosensitive body to a predetermined level.

(b) It lowers the potential of the first image portion close to the predetermined level.

(c) It raises the potential of the second image portion close to the predetermined level.

Figure 18:
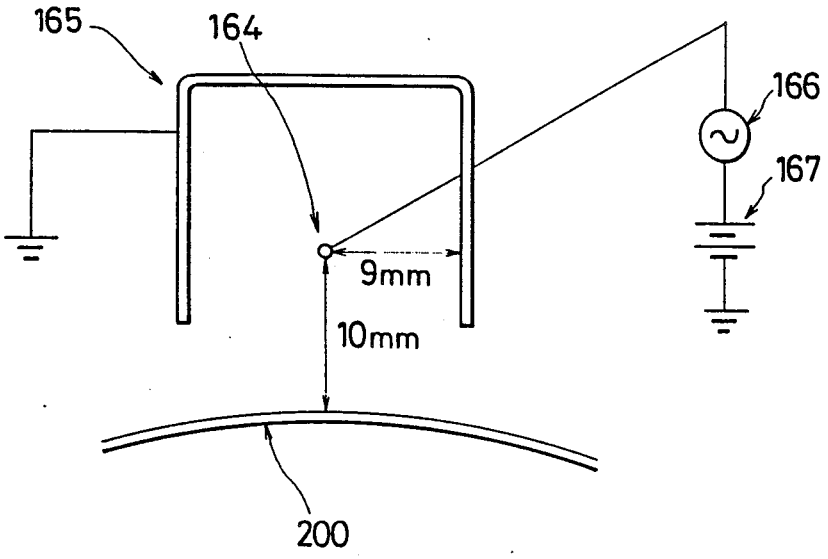
FIG. 18 is an explanatory diagram for the configuration of the pretransfer charger.

As a charger which is capable of realizing these effects, use was made of a superposed charger of an AC high voltage and a DC high voltage as shown in FIG. 18. To the charging wire 164 there is impressed a high voltage which is the superposition of AC and DC as represented by an AC high voltage power supply 166 and a DC high voltage power supply 167. The shield 165 is grounded.

Next, the function of the charger will be described. The most important point of the charger is that the potential of the portion which has higher potential than a predetermined value is lowered while at the same time the potential of the portion which has lower potential than the predetermined value is raised.

What has been described in the above is based on the effects of charge removal in the high tension AC discharge. For instance, when use is made of ACP-P5KV, if the surface potential is called Vx, the flow of the positive corona component, of corona ions that are generated by the charging wire to which is applied an AC high voltage, moves in proportion to the potential difference (25 $kV-V_X$). On the contrary, the flow of the negative corona component moves in proportion to the potential difference ($V_X$+2.5 kV). Consequently, when $V_X>0$, motion of the negative component is larger, whereas when $V_X<0$, motion of the positive component is larger, converging in both cases close to 0 V. (To be more specific, negative corona is easy to be generated than positive corona, so that the converging potential is not 0 V but is somewhat negative.)

Next, when a DC with the voltage value of $V_{DC}$ is superposed, potential differences that cause the positive and negative ions are (2.5 kV+$V_{DC}-V_X$) and ($V_X-V_{DC}-+2.5$ kV), and hence, it converges close to $V_{DC}$ according to the idea similar to above. (In fact, it is $V_{DC}\alpha$.) From what has been described above the effects (a) to (c) mentioned earlier can be realized. It is to be noted that the schorotron charger also possesses the effect of smoothing the unevenness in the surface potential to a constant value. A distinct difference of this charger from a charger which is a superposition of AC and DC is that in this charger it is not possible to lower a higher potential to match a lower potential, so that it is only possible to equalize the potential to a value which is greater than the maximum potential in the unevenness of the potential. For this reason, the charger tends to have a problem in the detachability of the transfer material mentioned in the foregoing. In order to achieve the same effects by the use of a schorotron, one may lower the surface potential once to a level not quite equal to 0 V, and then lower it to a constant value with the schorotron.

Further, in a superposed charger of AC and DC, the detachability and quality of transferred images were best in the present embodiment when the potential after the passage was in the range of 100 to 800 V. The voltages corresponding to this situation were 4.0 to 6.0 kV for AC and 100 to 750 V for DC.

Next, the optical system for the dichromatic LBP in the present embodiment will be described in detail. In an optical system in which are involved a plurality of laser beams, configuration and shape of lenses to be used will vary depending upon a variety of combinations such as the case where there is a simple optical scanner or the case where there are a plurality of them, in scanning lasers, the case, when the optical scanner consists of polygonal mirrors, where light i made to be incident upon the same surface or the case where light is incident upon different surfaces, the case where the form of the laser beams incident upon the optical scanner is parallel beams incident upon the optical scanner is parallel beams or the case where they are convergent beams, and the case where the incident beams are mutually parallel or the case where they are not parallel.

In the present embodiment description will be given in conjunction with the case of a dichromatic LBP in which there are involved two laser beams and one polygonal mirror where each of the incident beam is a parallel light and the two beams are mutually parallel.

In the existing optical system with a plurality of laser beams there were problems in factors that affect the image quality, namely, unevenness in the image quality due to the differences in the beam diameter on the photosensitive body, scanning speed, and so on, installation, adjustment, and the like of a plurality of beams, and so forth.

Figure 19:
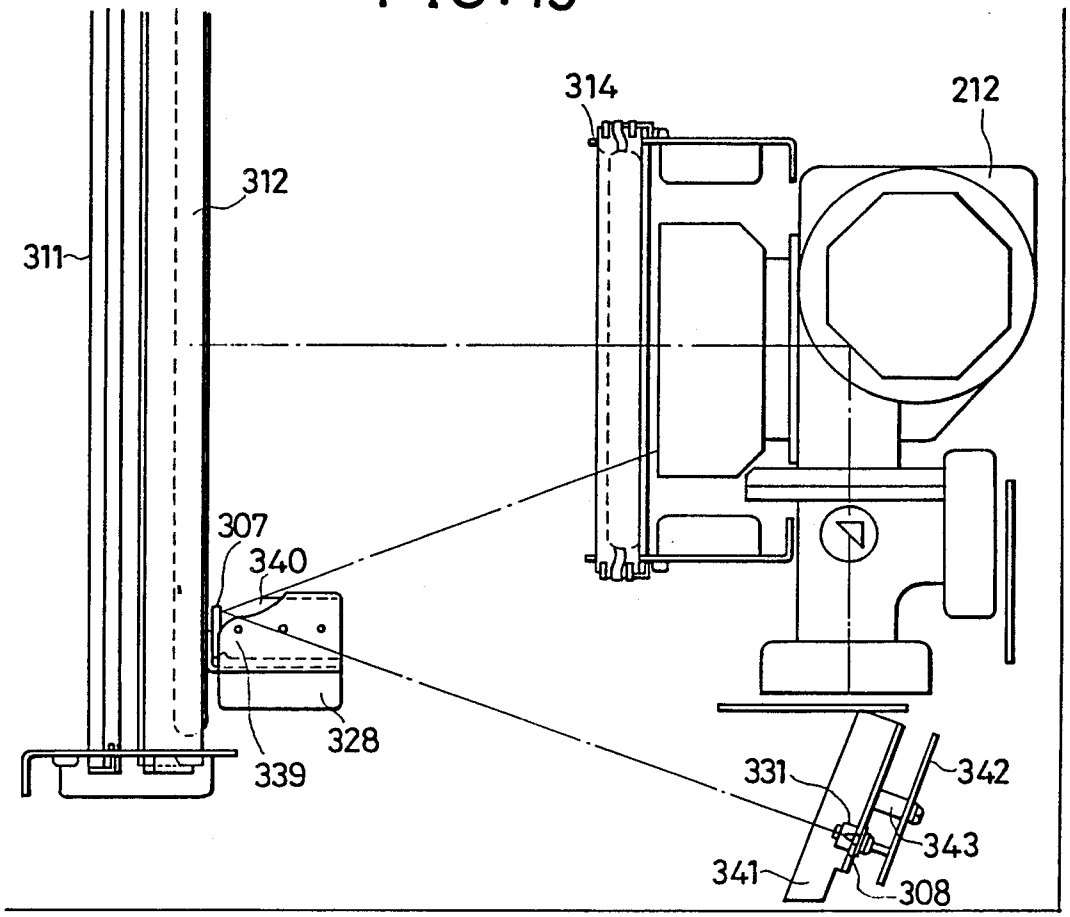
FIG. 19 is a view from the top of the optical system in the dichromatic LBP.

First, as shown by the sectional diagram for the image formation unit shown in FIG. 4 and the view from top o the optical system shown in FIG. 19, by fixing a polygonal scanner unit 212 which includes the lasers, f$\theta$ lens(es), and the like, reflecting mirrors 311, 312, 314, 315, 316, and 307? for directing the scanned laser beam to a predetermined position, transparent glasses 313 and 137 for dust prevention, a beam detector (not shown), and so forth, on a single base 318, it is possible to minimize the difference in the beam diameter on the photosensitive body and the difference in the scanning speed due to errors in the optical path lengths for each laser beam. In addition, mutual adjustment for each laser beam can be achieved readily prior to or after incorporating the optical system in the body of the apparatus. Although the present embodiment treats specifically the case of two laser beams, situation is similar for the case when an optical system with more than two laser beams are involved.

Figure 20:
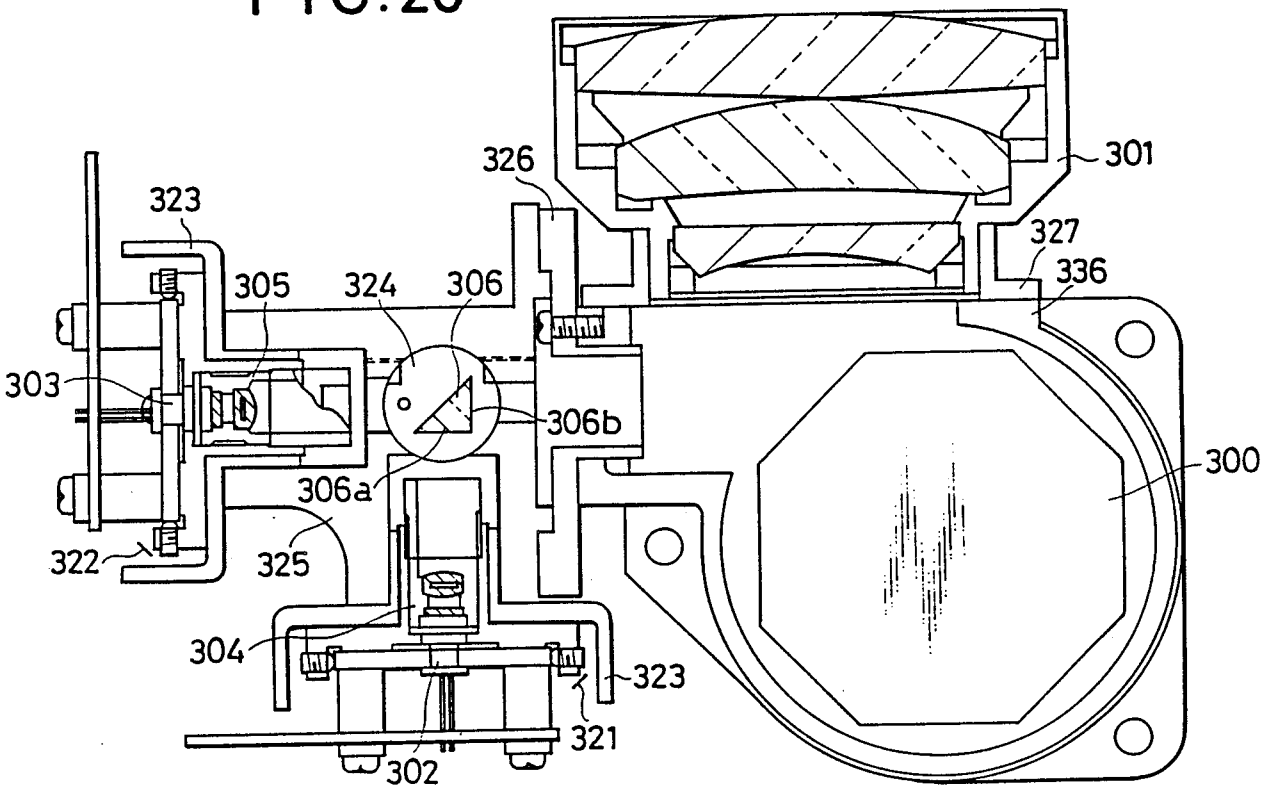
FIG. 20 is a top sectional diagram of the polygonal scanner unit.

FIG. 20 is an upper sectional diagram of the polygonal scanner unit 212. In a prior system a polygonal mirror 300, f8 lens 301, and each laser are either fixed to a base or are fixed via separate casings, so that a difficulty existed in aligning optical axis or the like. In the present embodiment shown in FIG. 20, the polygonal scanner unit 212 consists mainly of an octagonal mirrors 300, f$\theta$ lens 301, first and second semiconductor lasers 302 and 303, collimator lenses 304 and 305, prism 306, and a casing 336, where the f$\theta$ lens 301 is mounted with screws on a flange 327 fixed to the casing with screws.

Figure 21:
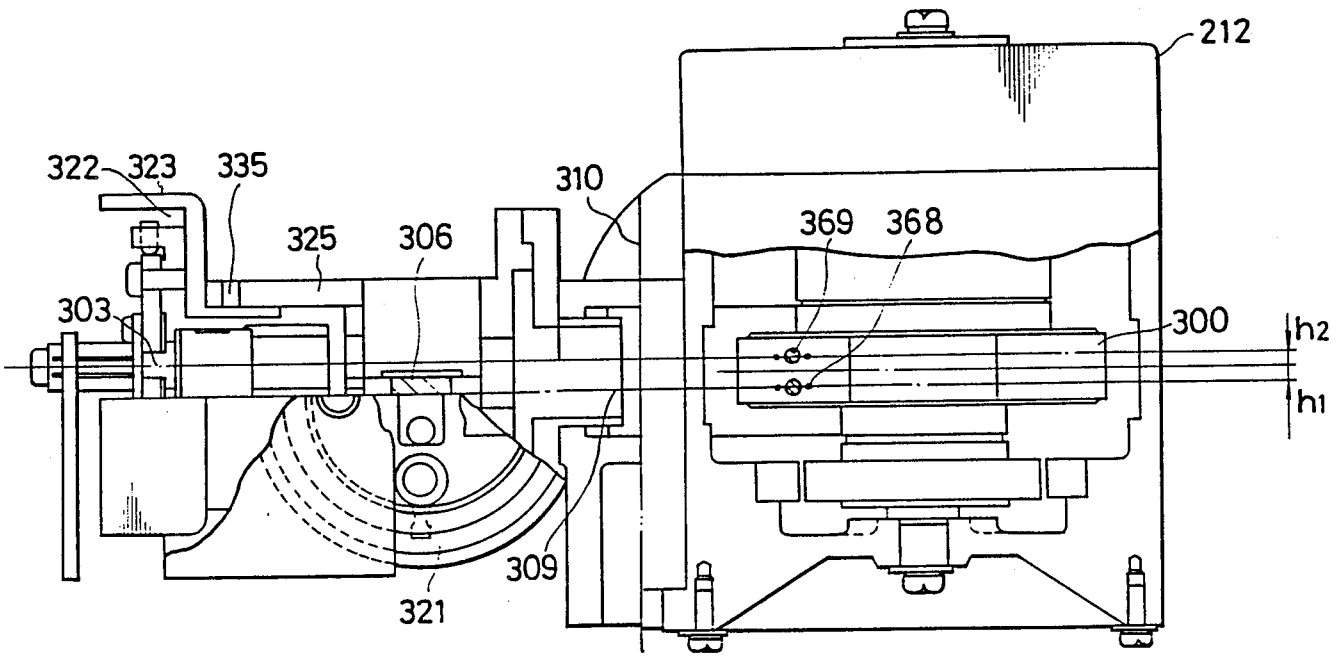
FIG. 21 is a transverse sectional view of the polygonal scanner unit.
Figure 22:
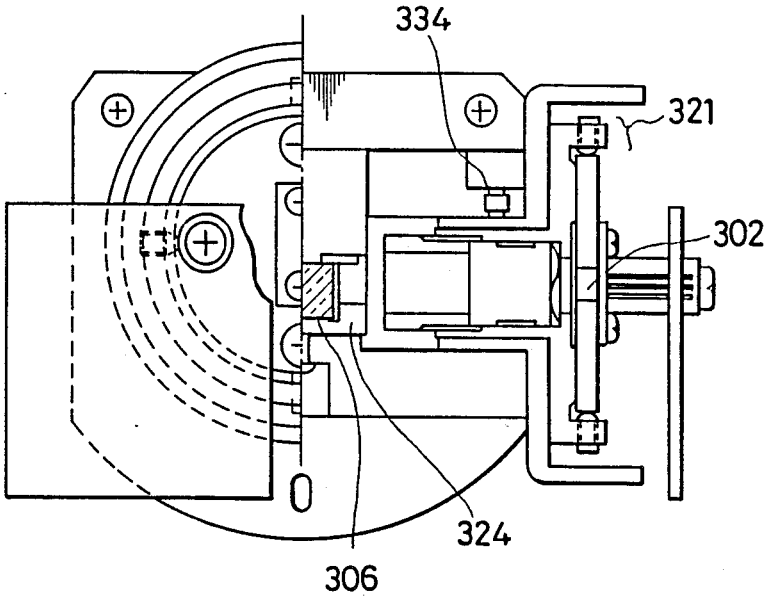
FIG. 22 is a diagram which shows the arrangement of the first and the second laser units.

Further, a first and a second laser units 321 and 322 which include the first and the second semiconductor lasers 302 and 303, collimator lenses 304 and 305, and have adjustment mechanisms, are fixed to a holder 325 that has cylindrical built-in prism holder 324 to which is fixed a prism 322, with fixing set screws 334 and 335 shown in FIG. 21 and FIG. 22, via a plastic spacer 323. The first and the second laser units 321 and 322 are arranged orthogonally each other in a horizontal plane free to rotate and fixable at any point in the plane. The laser beam 309 of the first laser unit 321 is adjusted by the prism 306 so as to be incident upon the polygonal mirror 300.

The holder 325 is fixed to the casing 336 by being screwed to the spacer 326.

As in the above, the polygonal scanner unit 212 includes adjustment of the laser optical axis so that it contributes to the miniaturization and enhancing the accuracy of the optical system, and also to a reduction of the number of assemblage processes.

Although two laser are involved in the present embodiment, a plurality of three or more lasers may be used, lenses in the laser units 321 and 322 may be a lens system other than the collimator lenses, and the laser beams from a plurality of laser units need not be incident upon the same surface of the polygonal mirror 300.

Next, the relationship between the polygonal mirror 300 and the laser units 321 and 322 will be described. First, laser beam 309 which is emitted from the first laser unit 321 is bent orthogonally by the prism 306 which has coatings on the incident plane 306*a* and the exit plane 306*b* as shown in FIG. 20 and FIG. 21, and is adjusted in a horizontal plane to be parallel to the second beam that will be described later. After it is incident at a point with a distance $h_1$ below the central axis of the polygonal mirror 300 and past the f$\theta$ lens 301, it passes through the 1-1 and 1-2 reflecting mirrors 311 and 312, as shown in FIG. 4, and the transparent glass 313, and scans and exposes the photosensitive body 200 in the direction from the front to the rear of the plane of the paper. Further, laser beam 310 which is emitted from a second laser units 322 is incident upon a point a distance $h_2$ above the central axis of the polygonal mirror 300 is scanned on the photosensitive drum in the same direction as in the first laser beam after passing, similar to the first laser beam, the 2-1, 2-2, and 2-3 reflecting mirrors 314, 315, and 316 and the transparent glass 317.

The optical parts are arranges for the laser beams 309 and 310 that are radiated from the first and the second semiconductor lasers 302 and 303, respectively, so as to have approximately equal efficiency of the respective optical system before they are scanned and exposed on the photosensitive drum 200, as shown in FIG. 40.

With this arrangement, the outputs of each semiconductor laser can be adjusted with a single volume, which contributed to simplification of adjustment and bringing down the cost of the apparatus.

Moreover, regarding the dispersion in the laser powers due to dispersion in the sensitivity of the photosensitive drum 200, there will not arise a situation in which powers of some lasers out of a plurality of lasers are insufficient, so that it will contribute also to improve the reliability as a printer.

As shown in FIG. 21, the first and the second laser units 231 and 322 are mounted on the holder 325 keeping a distance of $h_1+h_2$, and the second laser beam 310 passes in the holder 325 over the prism 306 which is used by the first laser beam 309 to be incident upon the polygonal mirror 300. In this case, the distance $h_1+h_2$ is determined by the beam diameters of the parallel beams after passing the collimator lenses 304 and 305. The prism 306 and the prism holder 324 are arranged so as not to obstruct the first laser beam 309. The laser units 321 and 322 that have the first and the second semiconductor lenses 302 and 303 are fixed to the casing 326 via a holder 325 in a plance of the optical axis before its incidence on the polygonal mirror 300 which is parallel to the base 318.

When the optical axes before incidence on the polygonal mirror 300 of the first and second laser units 321 and 322 are arranged to come to lie in a plane perpendicular to the plane of the base 318, the protective effect by the insulating spacer 323, and moreover, vibration-proof, connector fabrication, and others will become difficult.

In the present embodiment, two lasers are used. However, a plurality of three or more beams may be used, and a plurality of beams may be incident on the same plane of the polygonal mirror 300.

In addition, as shown in FIG. 21 and FIG. 22, the first and the second laser units 321 and 322 are arranged so as to have the lines that connect the optical axis points of the first and the second laser units 321 and 322 and each of the incident points on the reflecting planes of the polygonal mirror 300 to be parallel to the plane of the base 318. By so doing, laser beams can be made to be incident upon the polygonal mirror 300 in the simplest manner and with the shortest distance, and also, to improve the reliability.

Figure 24:
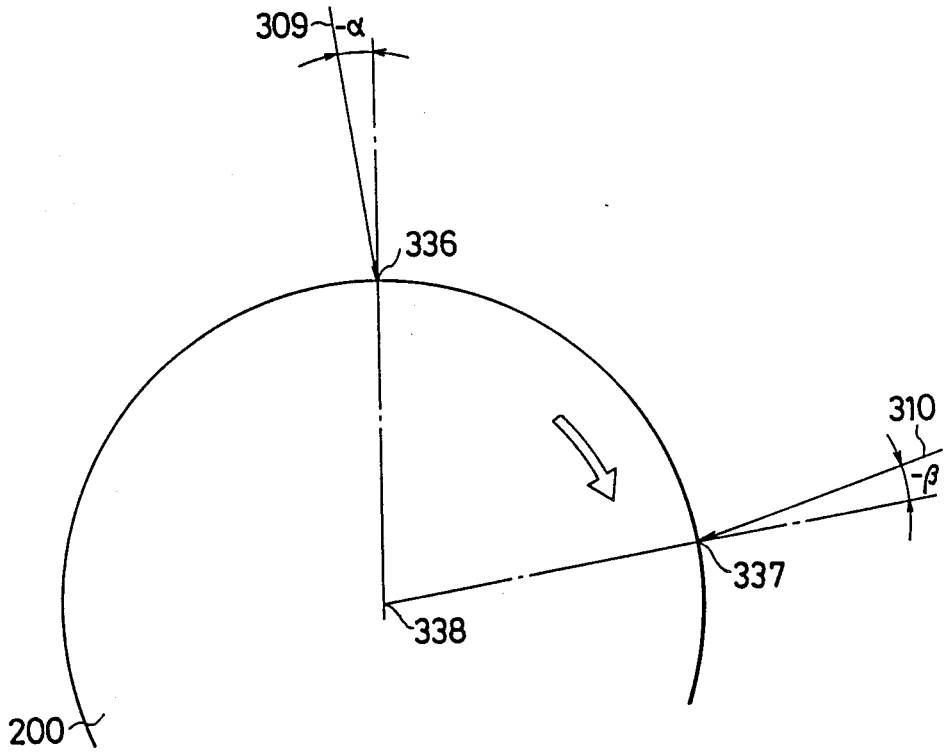
FIG. 24 is diagram which shows the incidence of the first and the second beams to the photosensitive body.

Next, as shown in FIG. 24, the angles $-\alpha$ and $-\beta$ formed by the normal vectors to the photosensitive drum at the incident points 336 and 337 of the first and the second laser beams 309 and 310 and the directions of the laser beams at the incident points as the reference directions, are chosen to satisfy $-\alpha \approx -\beta$. If $|\alpha \approx |\beta|$, the inner beam diameters on the photosensitive drum 200 may bechanged even if the beam diameters of the first and the second laser beams 309 and 310 are equal, and the image quality will be affected. Further, even for the variation in the change in the optical path length due to distortion in the scanning line, the relative error between the first beam and the second beam will be decreased.

In other words, in the present embodiment, the condition $|\alpha|=|\beta|$ on the incidence angles is of no problem, namely, either one or both of the first and second laser beams 309 and 310 may have negative values. Further, although the description of the present embodiment was given in conjunction with the use of two lasers, the present invention can be applied also to the case of three or more lasers. In addition, the photosensitive drum may be of drum-shape, for example, of belt-like, or the photosensitive body may be a unified body of a plurality of photosensitive bodies instead of a single photosensitive body.

Next, periphral mechanisms of the beam detector 308 which generates horizontal synchronized signal that is indispensable for the printing control by the laser printer will be described.

In FIG. 4, the first laser beam 309 which is scanned by the f$\theta$ lens 301 is led to the beam detector 308 by the reflecting mirror 307 in the range of scanning of the first laser beam 309. FIG. 19 is a diagram which shows the surroundings of the beam detector 308 in the optical system as seen from the top, and FIG. 23 is its detailed diagram.

Figure 23:
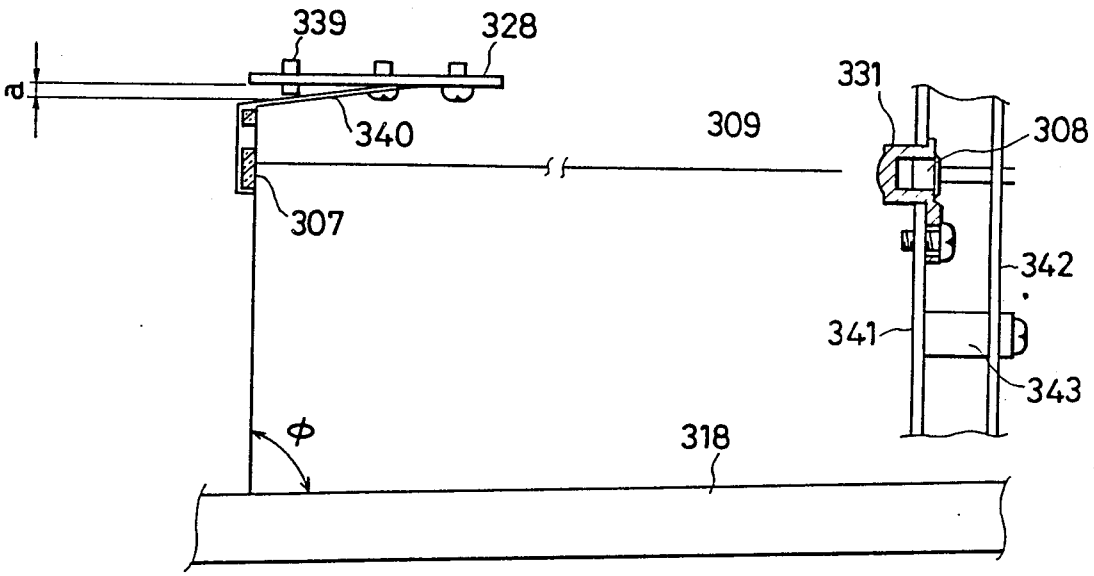
FIG. 23 is a diagram which shows the surroundings of the beam detector.

In FIG. 23, the first laser beam 309 which is scanned by the f0 lens 301 is reflected by the reflecting mirror 307 and impinges upon the beam detector 308 which is placed at a distance that is approximately equal to the photosensitive drum 200.

The reflecting mirror 307 is held by a flat spring 340 is fixed on the base 318 via a bracket 328. The flat spring 340 is adjusted by an adjusting screw 339 to have an optimum beam incidence on the beam detector 308. The angle between the flat spring 340 and the reflecting mirror 307 is designed so as to have the beam incident upon the beam detector 308 when the adjusting screw 339 sticks out from the bracket 328 by a distance of a, and a structure that can withstand vibrations or shocks is obtained by the pressure of the spring. In addition, the angle $\phi$ between the base 318 and the reflecting mirror 307 in its adjusted state, is chosen to be less than 90°, namely, arranging its reflecting surface pointing downward. With the bracket 328 and the angle $\phi$, the reflecting mirror 307 becomes relatively free from stains or dusts, which keeps the laser beam that is led to the beam detector 308 stably for the long time.

Moreover, the beam detector 308 is mounted on a PC plate 342 for beam detection which keeps the beam detector 308 fixed on a bracket 341 with a fixed distance by means of a spacer 343. Further, on the bracket 341 there is fixed a cylindrical spacer 331 that includes a cylindrical lens section 344 made of methyl metacrylate, fitted to, and coaxial with, the beam detector 308. This arrangement stabilizes out-of-focus or insufficiency of light in the beam on the beam detector 308, tilt of the surface of the polygonal mirror 300, and the horizontal synchronized signal against vibrations or shocks.

Figure 25:
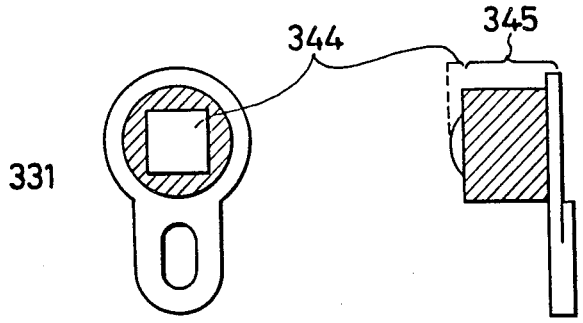
FIG. 25 is an explanatory diagram for the configuration of the cylindrical spacer attached to the beam detector.

FIG. 25 shows the details of the cylindrical spacer 331. The cylindrical spacer 331 consists of a cylindrical lens section 344 and a holder section 345 that are united into a body, and the portion (hatched portion in the figure) masking the cylindrical lens section is coated in black color. This is done so because the laser beam that is led to the beam detector 308 by the reflecting mirror 307 has a certain width so that light that impinges upon the surroundings of the cylindrical lens section 344 also enters the beam detector by refraction or the like, which generates noises in the horizontal synchronized signal and causes a large defect in the image quality. With a processing mentioned above, it becomes possible to provide images of high quality easily and at low cost. Of course, treatments for prevention of light transmission other than black coating will be equally effective, and the material for the cylindrical spacer 331 may be one with high light transmissivity other than methyl metacrylate such as polycarbon.

Figure 26:
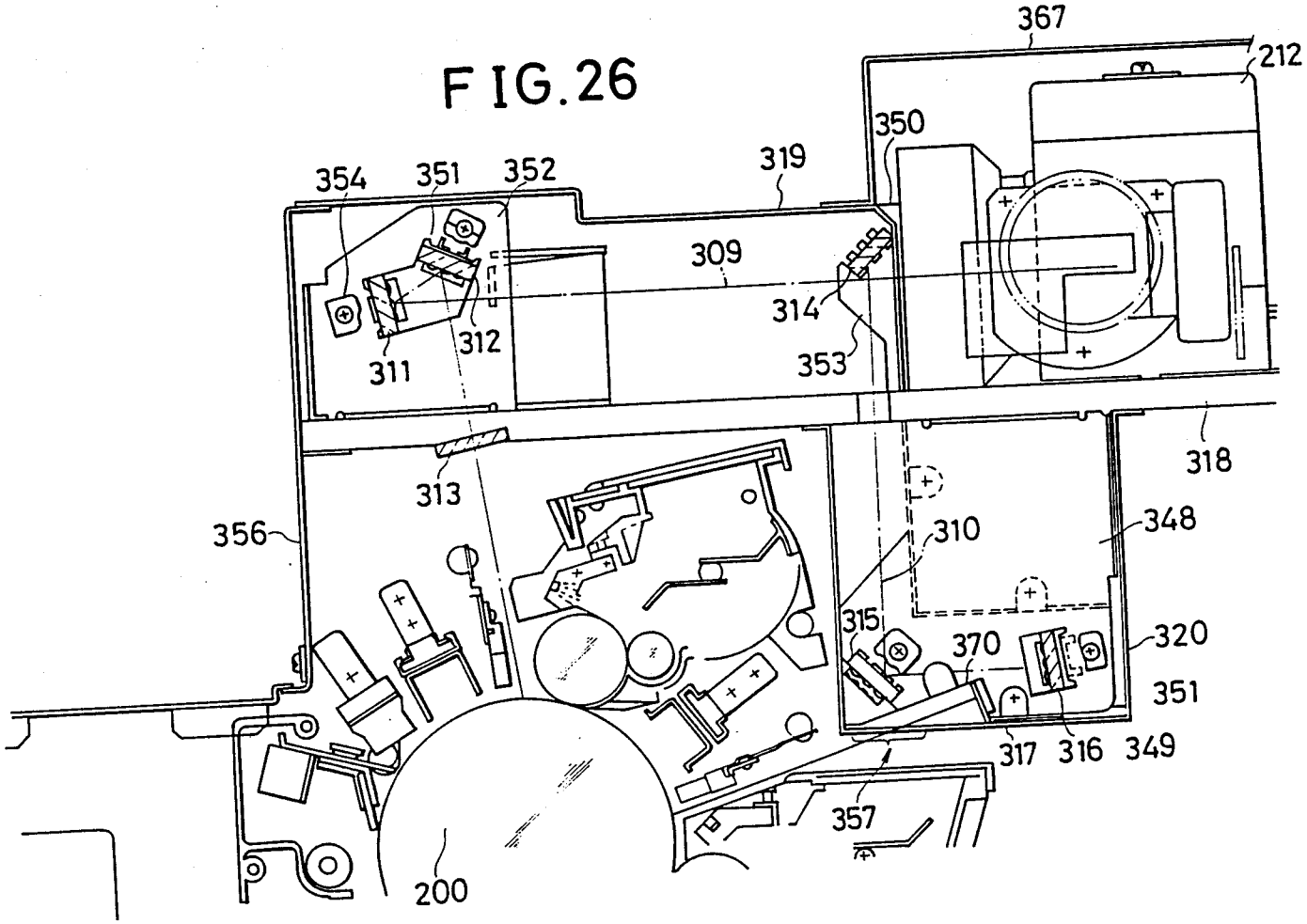
FIG. 26 is a transverse sectional view of the optical system.

FIG. 26 is a diagram which shows cover to the optical system and the mounting of the reflecting mirror. For the first laser beam 309, the 1-1 and 1-2 reflecting mirrors 311 and 312, respectively, are fixed by a pair of bracket 352 and fixing flat spring 354, and the bracket 352 are fixed to the base 318. The 1-2 reflecting mirroe 312 is supported on three points by three optical path adjusting screws 354 (one of them is not shown in the figure) so as to be capable of being adjusted. In addition, the first transparent glass 313 for dust prevention is fixed to the base by bracket 346, and a first cover 319 to the first laser beam 309 is fixed to the base 318 so as not to obstruct the first and the second laser beams 309 and 310 between the polygonal scanner unit 212 and the 2-1 reflecting mirror 314. Further, between the f$\theta$ lens 301 and the first cover 319 is covered with a sealing material 350 of MORUTOPUREN?.

Further, the polygonal scanner unit 212 is covered with a third cover 367. In the past, the entirety of the optical system including the polygonal scanner unit 212 was made into a sealed structure. With the above construction, however, exchange of the polygonal scanner unit 212 became facilitated by simply opening the third cover 367 without affecting other optical parts.

For the second laser beam 310, after it is reflected by the 2-1 reflecting mirror 314, it is reflected by the 2-2 and 2-3 reflecting mirrors 315 and 316 that are mounted on a pair of brackets 348. Of these two, the 2-3 reflecting mirror 316 are supported on three points by three adjusting screws 351' (one of them is not shown in the figure) so that it can be used for adjusting the light path. In addition, the second transparent glass 317 for dust prevention is fixed to a bracket 370. The second laser beam 310 is covered with the first cover 319 until it is reflected by the 2-1 reflecting mirror 314 and traverses the base 318 downward, and is covered thereafter with a second cover 320. Further, the second cover 320 that has a laser scanning window section 357 and the bracket 348 are sealed with a sealing material such as MORUTOPUREN?.

Figure 27:
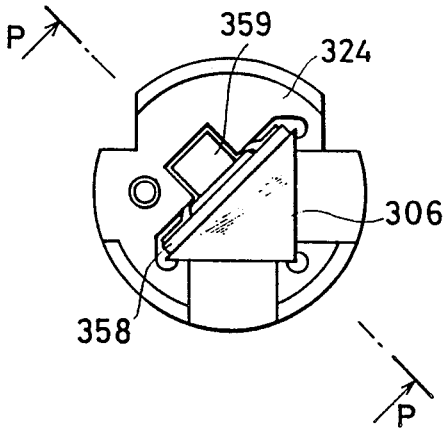
FIG. 27 is a detailed diagram of the prism holder for the two-beam adjustment.
Figure 28:
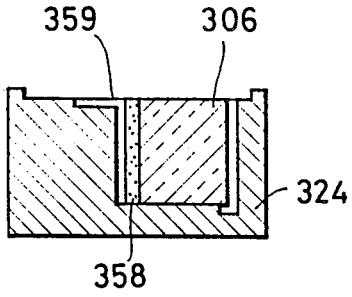
FIG. 28 is a sectional diagram of the holder.
Figure 29:
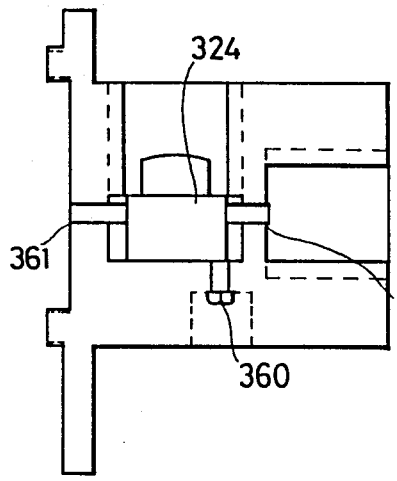
FIG. 29 is a diagram for showing the installation of the holder.
Figure 30:
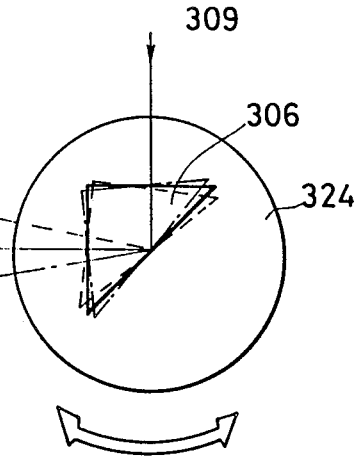
FIG. 30 is an explanatory diagram for the operation of the holder.
Figure 31:
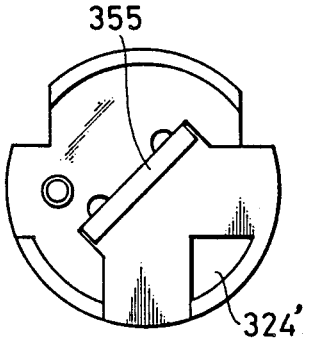
FIG. 31 is a detailed diagram for another embodiment of the holder.

FIG. 27 is a detailed diagram for the prism 306 and the prism holder 324 shown in FIG. 20, and FIG. 28 shows the P—P cross section of FIG. 27. As shown in the figures, the prism 306 is fixed to the cylindrical prism holder 324 with a plastic spacer 358 and a pressing flat spring 359, without the intermediary of screws or the like. The prism holder 324 is placed in the hollow portion of the holder 325, as shown in FIG. 22 or FIG. 29, and is attached to the holder 325 with a fixing screw 360. The prism holder 324 can be rotated by means of two angle adjusting screws 361 and 361' as shown in FIG. 29, permitting an easy and sure adjustment of the incidence angle of the first laser beam 309 to the polygonal mirror 300. FIG. 30 illustrates such adjustments. Further, the prism 306 may be replaced by a reflecting mirror which is shown in FIG. 31 where a reflecting mirror 355 is utilized in place of the prism 306.

Figure 32A:
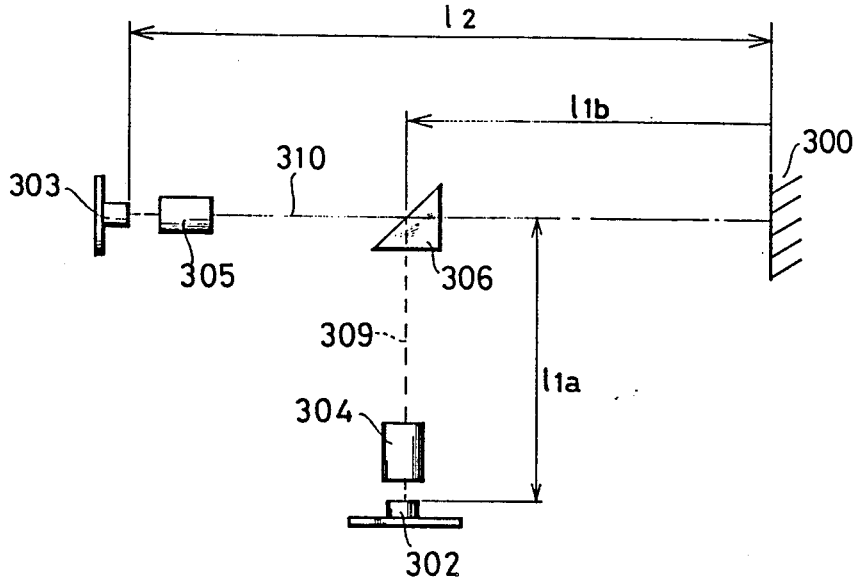
FIGS. 32A & 32B are a diagram for illustrating the arrangement of the double-beam generating section.
Figure 32B:
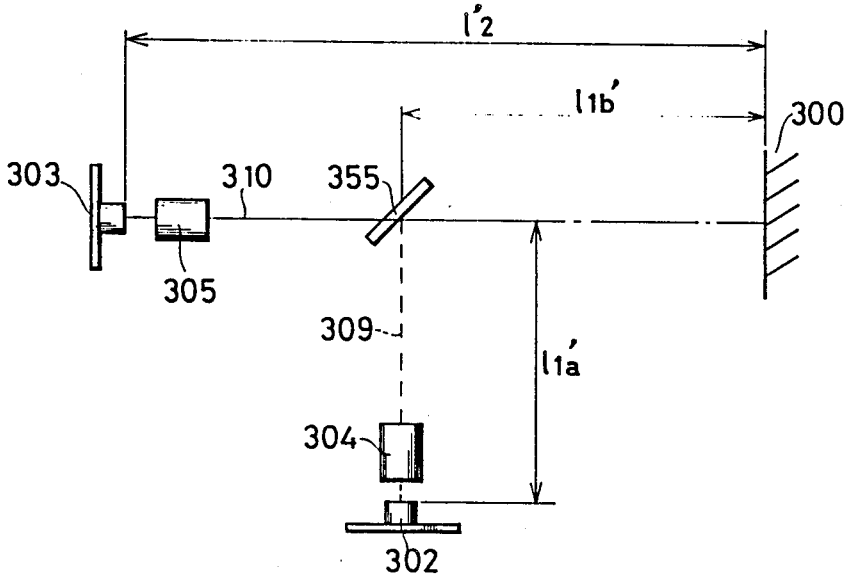
Figure 33:
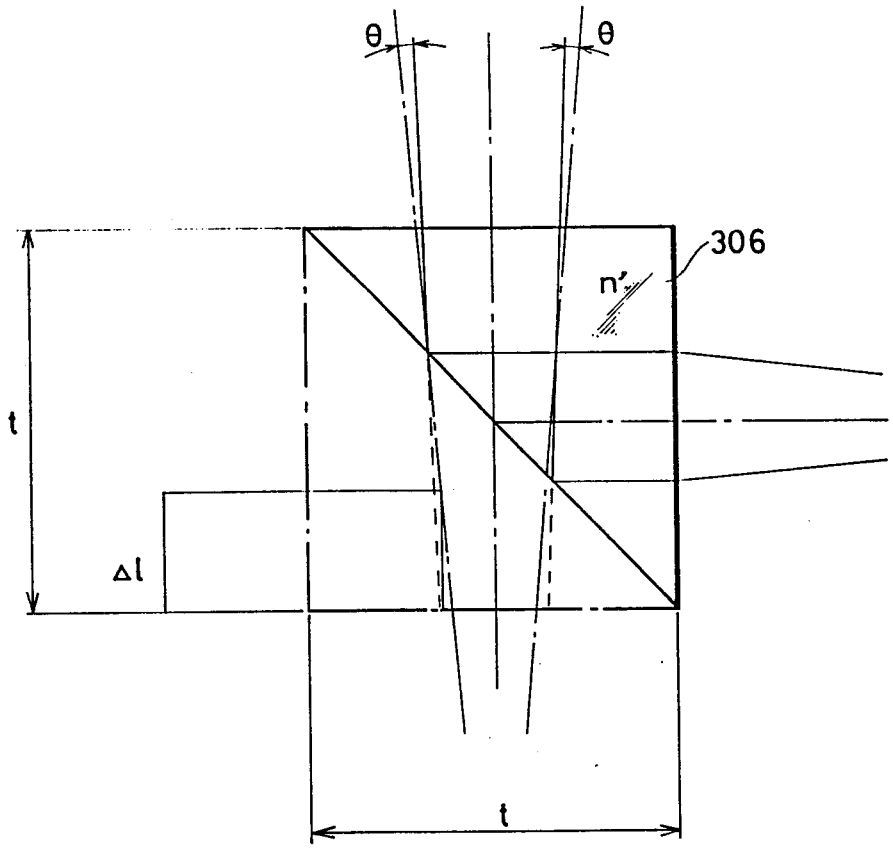
FIG. 33 is an explanatory diagram for the correction conditions of the prism.

FIG. 32(A) is a conceptual diagram which illustrates the positional relationship between the incident lasers of a two-bundle optical system of the present embodiment upon the polygonal mirror 300. FIG. 32(B) illustrates an example in which a reflecting mirror 355 is used in place of the prism 306. In FIG. 32(A), the first and the second semiconductor lasers 302 and 303 should be parallel ideally after passing the collimator lenses 304 and 305. However, in a semiconductor laser there exists a deviation (astigmatism) in the beam radiate point for the vertical and gorizontal directions, and hence the beam does not become parallel in practice. Accordingly, there will arise a difference in the actual beam inner diameters on the photosensitive drum 200 between the laser first beam 309 that propagates through the prism 306 and the second laser beam 310 that is not affected by the prism 306, unless the first laser beam 309 is given a path length longer by than the second laser beam 310 before impinging upon the polygonal mirror 300, as shown in FIG. 33. For that reason, in the present embodiment, the first and the second laser 302 and 303 are arranged to satisfy the relation $$2^{+} = {}_{1a} + {}_{1b} \cdot \text{Here, is given by}$$

$$= t\left(1 - \frac{1}{n'} \cdot \frac{\cos\theta}{\cos\theta}\right)$$

(where n' is the index of refraction of the prism, $\theta$ is the angle with the optical axis, and $n\sin\theta = n'\sin\theta'$)

With the above arrangement, it becomes possible to remove discrepancy between the diameters of the first and the second beams.

Further, although the correction for the case of using collimator lenses for the lens system is described in the present embodiment, similar correction will be required also for an optical system by which the beam is condensed on the reflecting surface of the polygonal mirror 300.

In FIG. 32(B), a reflecting mirror 355 is used in place of the prison 306 so that it is not necessary to give a correction such as is needed for the case of using the prism. However, because of the presence of the astigmation in the semiconductor laser as mentioned earlier, the distances from the semiconductor lasers 302 and 303 to the reflecting surface of the polygonal mirror 300 are chosen to satisfy approximately the relation $$2' = 1a' + 1b'$$

By so doing, it is possible to keep the beam diameters of the first and the second laser beams on the image surface at a predetermined value. Needless to say, similar situation will hold for the case of a lens system which condenses the beam light on the reflecting surface of the polygonal mirror 300.

Although the case of using two laser beams was described in the present embodiment, an optical system with a plurality of more than two lasers may also be employed.

Figure 34:
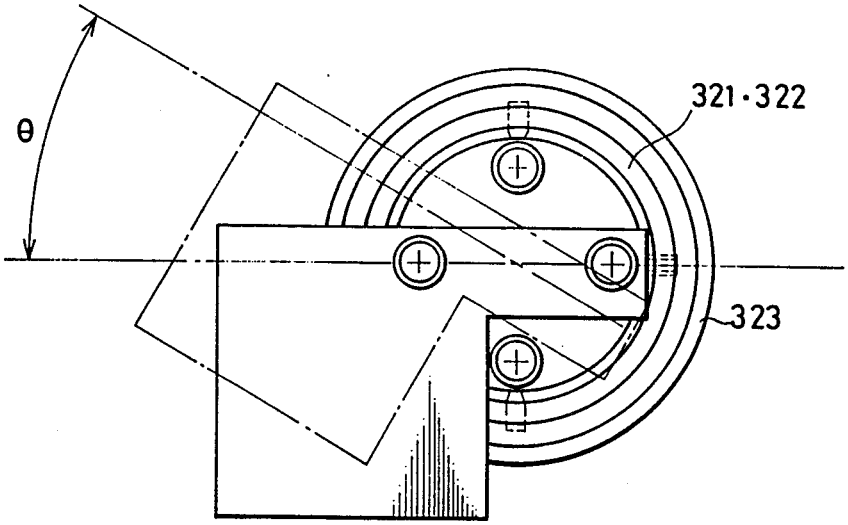
FIGS. 34, 35A and 35B show explanatory diagrams for the operation of the correction conditions.
Figure 35A:
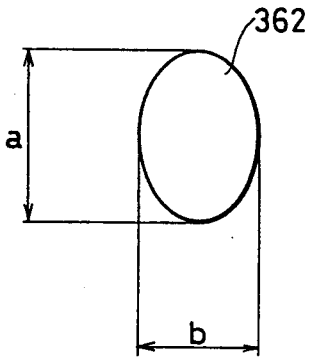
Figure 35B:
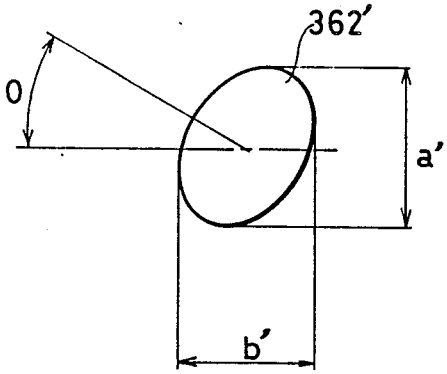

FIG. 34 shows a diagram which shows the laser units 321 and 322 from the rear. The laser units 321 and 322 are made in identical manner, and are fixable via insulating spacer 323 to the holder 325 at any angular position by the pressing screws 334 and 345. Accordingly, although the beam spot 362 of the semiconductor laser on the photosensitive drum 200 has an elliptic form of a×b as shown in FIG. 35(A), when the laser units are rotated by an angle $\theta$ as shown in FIG. 34, the beam spot on the photosensitive drum 200 becomes a'×b' with the spreads in the main and auxiliary scanning directions a' and b', respectively. Therefore, by varying the inclination angle $\theta$, it becomes possible to obtain desired beam diameters.

As a result, the difference in the beam diameter due to the radiation angle of the semiconductor laser may be given such an adjustment as equalizing the beam diameters in the main and auxiliary scanning directions on the photosensitive drum 200, by varying $\theta$ for each laser unit 321 and 322 according to each beam diameter.

Further, in a laser printer of a single light flux, some dispersion in the beam diameter becomes a dispersion between the individual apparatus, and for a specific printer, the dispersion of the beam diameter will not be much of a problem provided that the dispersion is within the designed range. However, for a multiple light flux laser printer with two or more light fluxes, dispersion in the beam diameter between the beams will appear directly as a defect in the image quality of that printer. Although two lasers are utilized in the present embodiment, the situation is equally applicable to an apparatus that employs more than two lasers. In addition, each of the laser units 321 and 322 employs identical system so that the entire apparatus is simplified and can contribute to a reduction of the number of parts used.

Figure 36A:
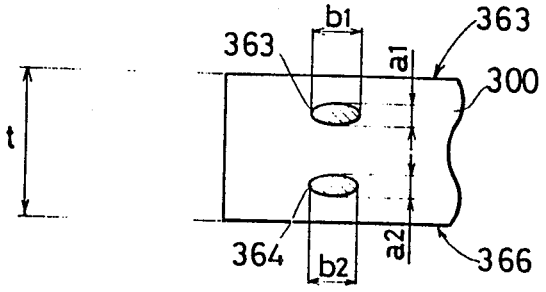
FIGS. 36A, 36B and 37 are explanatory diagrams for the measurement of the thickness of polygonal mirror surface.
Figure 36B:
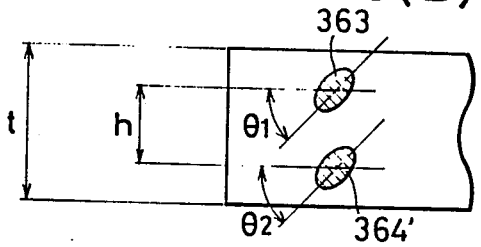

FIG. 36 is a diagram which illustrates that the laser beams which pas the collimator lenses 304 and 305 impinge upon the polygonal mirror 300. FIG. 36(A) shows the case in which the major axes of each of the laser beams 363 and 364 coincide with the horizontal direction of the polygonal mirror 300, and FIG. 36(B) shows the situation in which the laser beams are 10 inclined by the adjustment of the beam diameter by $\theta_1$ and $\theta_2$ to give beams 363' and 364', respectively.

In FIG. 36(A), $a_1$, $b_1$ and $a_2$, $b_2$ show the beam diameters for both beams. In this case, the thickness of the polygonal mirror 300 can be determined by the beam diameters of each laser beam as $$t > h + \frac{b1}{2}\cos 45° + \frac{b2}{2}\cos 45° + 1, \quad (1)$$

where h becomes the pitch $Th = h_1 + h_2$ of the first and second laser beam, and h satisfies the following inequality $$h > \frac{b1}{2}\cos 45° n + \frac{b2}{2}\cos 45°. \quad (2)$$

Figure 37:
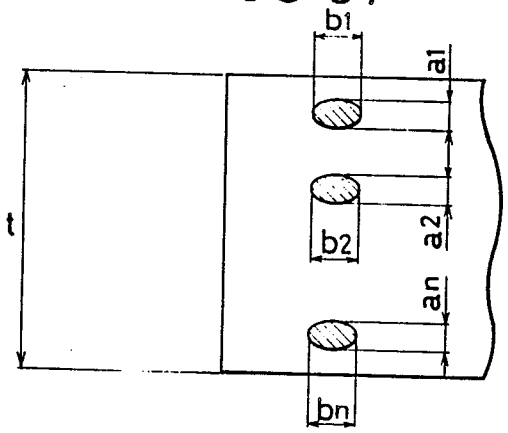

Hence, by substituting Eq. (2) into Eq. (1) there is obtained $$t > b_1 \cos 45° + b_2 \cos 45° + 1,$$

where the third term "+1" is included there to take into account of DARE? of both end surfaces 365 and 366 of the polygonal mirror. In the above is given the result for the thickness of the polygonal mirror 300 of the present embodiment which utilizes two light flux. The situation is analogous for the case of a plurality of beams of more than two, and for the general case of n beams, as shown in FIG. 37, there is obtained $$t > [b_n \cos 45°] + 1. \quad (3)$$

Further, the relation given by Eq. (3) is applicable also to the case which employs an optical system that has a focal point on the polygonal mirror 300 analogous to the case of the present embodiment where parallel light impinges upon the polygonal mirror 300. In this way, it is possible to provide a design value for the thickness which is minimum as well as economical of the polygonal mirror for a plurality of beams.

Figure 38:
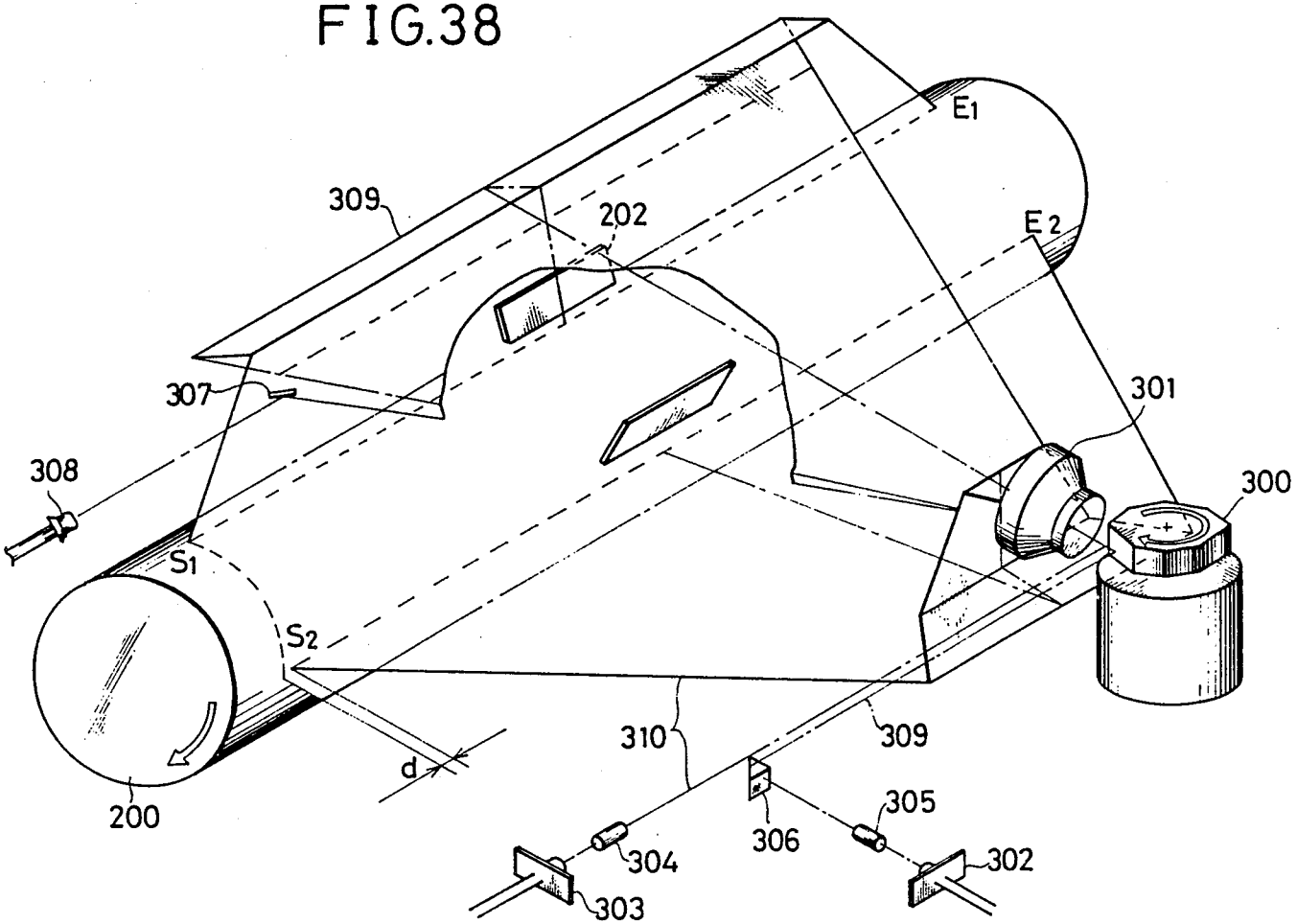
FIG. 38 is a perspective diagram which shows a schematic configuration of the double-beam laser optical system.

FIG. 38 is a perspective view for illustration an outline in carrying out recording of information in the photosensitive body 200 by means of two laser beams.

In the laser beam scanning of this kind, there are two problems that affect the image quality. Namely, if the starting point and the end point of scan in the main scanning direction on the photosensitive body 200 by the beam 309 that is radiated from the first semiconductor laser 302 are called $S_1$ and $E_1$, respectively, and similarly, the starting point and the end point of scan by the second semiconductor laser 303 are called $S_2$ and $E_2$, respectively, there arise problems as shown in FIGS. 39(A) and 39(B).

Figure 39A:
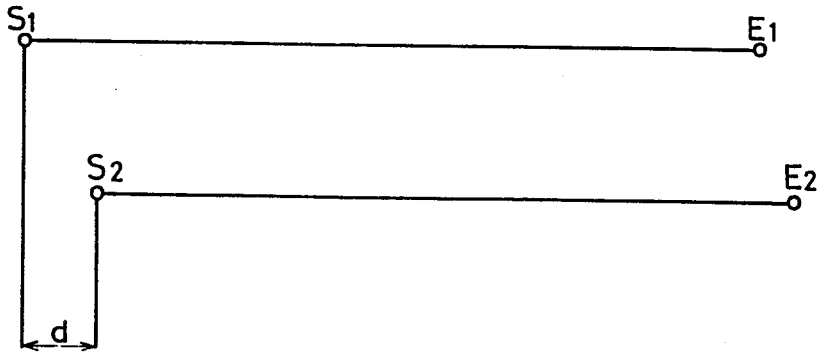
FIGS. 39A & 39B are a diagram which shows the changes in the scanning speed of the optical system.
Figure 39B:
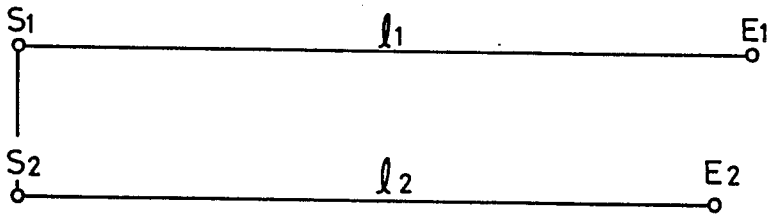

FIG. 39(A) represents the case the starting points Sl and $S_2$ of both scans are not flush having an error of d, and as the causes for which one may think of the following two cases.

(1) The case in which the optical axes in the horizontal plane of the laser beams 309 and 310 from the first and the second semiconductor lasers 302 and 303 were not parallel prior to their incidence upon the polygonal mirror 300.

(2) The case in which, when there is provided a beam detector 308 for each of the laser beams 309 and 310, there are errors in the fixing positions of the two beam detectors 308.

For the above problems, electrical measures were taken in the past.

FIG. 39(B) represents the case when the scanning lengths 1 and 2 in the main scanning direction of the laser beams 309 and 310 of the first and the second semiconductor lasers 302 and 303 are different. This situation arises when there is a difference in the optical path lengths of the laser beams 309 and 310 after each of them passed the f8 lens 301 and before carrying out exposure.

Further, in FIG. 38, 202 and 205 shows the first and the second surface potential sensors, respectively. In the past, the surface potential sensors 202 and 205 were set in the nonimaging portion of the photosensitive drum 200, which led to a drawback in that the photosensitive drum 200 had to be made long in its longitudinal direction. In the present embodiment, the surface potential sensors 202 and 205 are set at approximately the center of the photosensitive drum 200 so that it can contribute to a reduction in the length of the photosensitive drum, miniaturization and space sawing of the apparatus.

Next, referring to FIG. 4, the paper feeding system of the transfer paper will be described.

On one side area of photosensitive body 200, there are provided upper and lower paper feeding devices as a paper feeding device 213 in a forwarding section. In what follows, the upper paper feeding device will be described.

The upper paper feeding device includes a cassette 214 for housing transfer papers A which is taken out one by one by a paper feeding roller 215. A transfer paper A thus taken out is transported toward the photosensitive body 200 via a first transporting route 216 as a first forwarding section. In midpoints of the first transporting route 216, there are arranged a first detector 217 and resist rollers 218 along the transporting direction of the transfer paper A. In addition, on the transporting route 216, along the transporting direction of the transfer paper A there are arranged successively a stripping charger 200, an adsorption belt 220, a fixing unit 221, a second detector 222, and paper ejection rollers 223.

To describe image formation, a transfer paper A is taken out from the paper feeding cassette 214, and its position is put in order by being pushed against the resist rollers 218. The transfer paper A is detected by the first detector 217, sent to the transfer charger 208 by re-starting the resist rollers 218 by synchronizing the timing with the image on the photosensitive body 200, and the image is transferred on one side of the paper. The transfer paper to which image transfer is completed, is removed of static electricity that was accumulated on the paper, detached from the drum, sent to the fixing unit 221 where the image is fixed. The transfer paper A with image fixing completed, is ejected to a tray for ejected paper 224 via rollers 223 after passing the fixing unit 221.

Now, in the configuration of dichromatic LBP that has been described in FIG. 2 to FIG. 40, there occur frequently the necessity of making a print in one color only.

In that case, the following conditions have to be satisfied. Namely, (a) there will occur no problem for development and transfer of the color desired to be output.

(b) There should be no mixing of the color of one of the developing unit with the color of the other developing unit, and the color of the other developing unit should not be mixed in an image on the photosensitive body.

(c) There should not occur unnecessary allover extended development in the area on the photosensitive body where there are no image information.

Figure 41A:
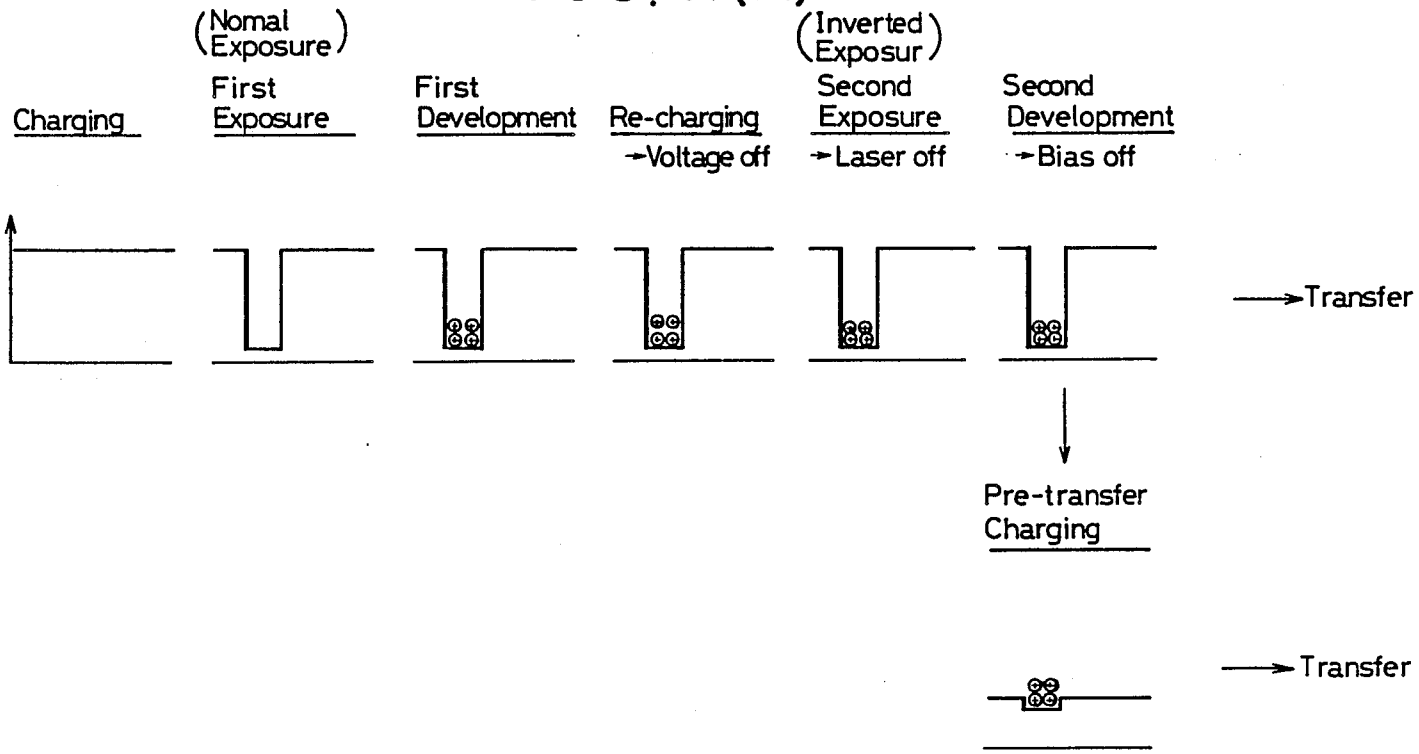
FIGS. 41A & 41B are a transitional diagram which shows schematically the conditions on the photosensitive body, for the case of the first development alone and of the second development alone, in accordance with the process, in the dichromatic LBP to which is applied the present invention.
Figure 41B:
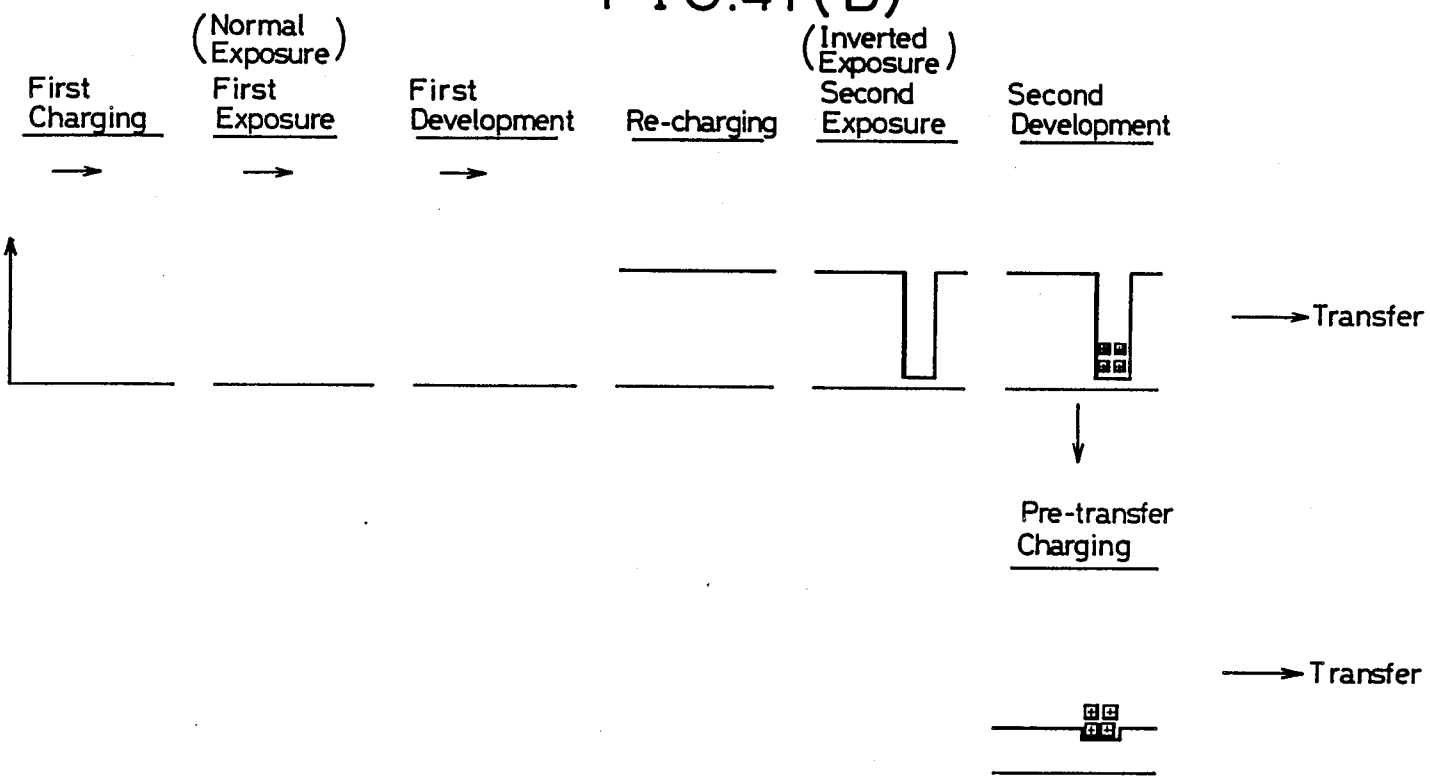

For these reasons, for the case of a monochromatic printing in a first color alone, the same process as in the dichromatic printing that was described in accordance with FIG. 3 is given up to the first development, and the process from re-charging (second charging) to the second development is discontinued, as shown in FIG. 41(A).

Further, in the dichromatic LBP configuration described in connection with FIG. 2 to FIG. 40, the surface potential of the photosensitive body 200 varies due to (a) difference in the solid material used for the photosensitive body, (b) fatigue caused by continued copying operation, and (c) changes in temperature.

In order to eliminate such variations in the surface potential of the photosensitive body 200, there is carried out a surface potential feedback as will be described below.

Figure 42A:
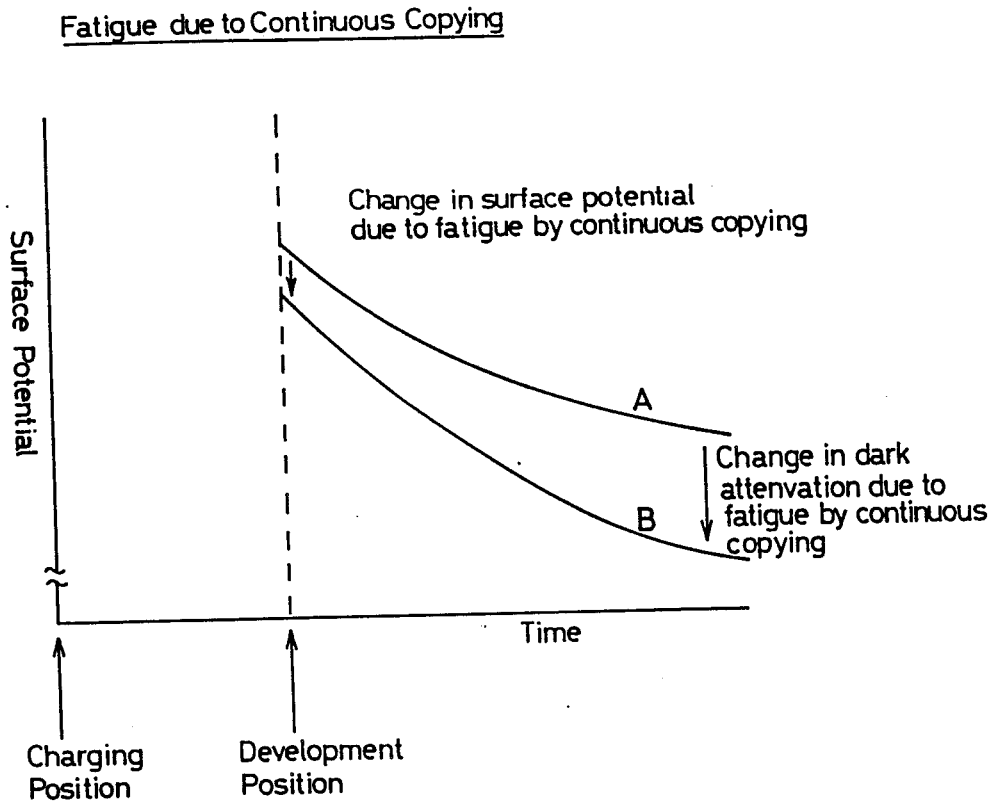
FIGS. 42A and 42B are a curve which shows the surface potential characteristic of the photosensitive body.
Figure 42B:
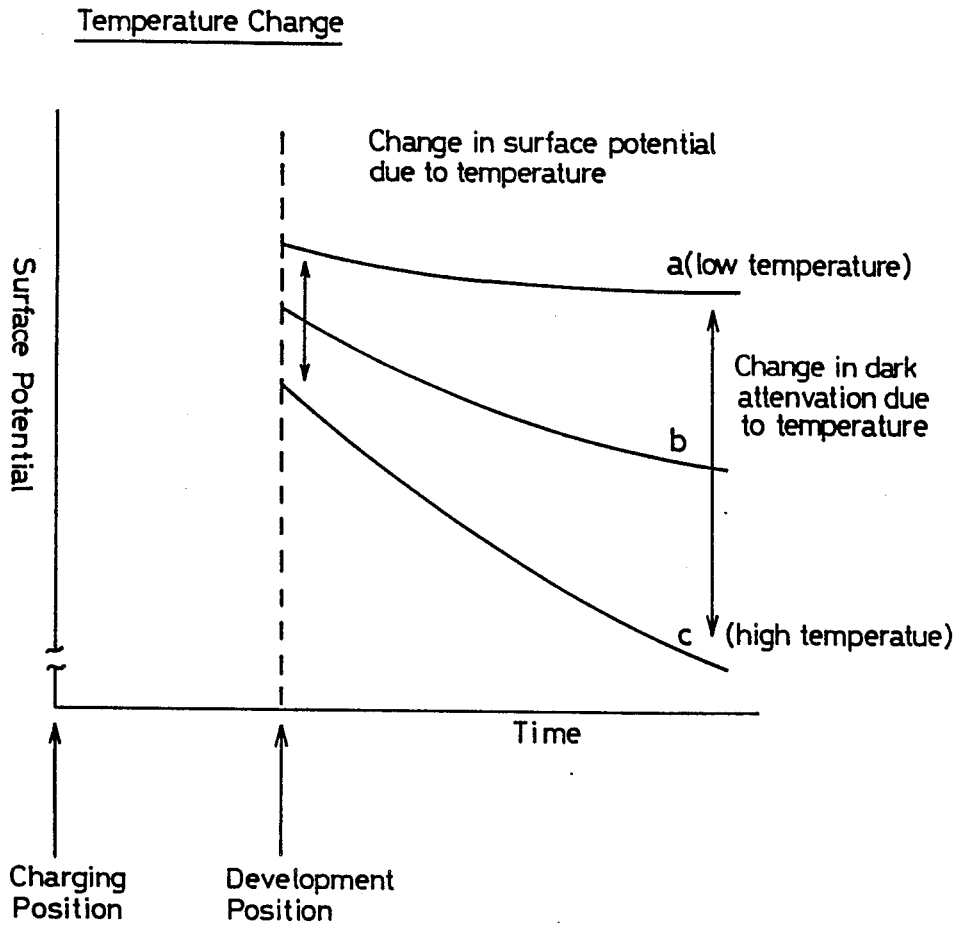

In FIG. 42 are shown examples of surface potential change due to fatigue caused by continuous use and surface potential change due to temperature. Generally speaking, dark attenuation is accelerated by fatigue due to continuous use, and the surface potential at the development position is lowered because of that.

As for the changes due to temperature, dark attenuation is generally faster for higher temperature so that the surface potential at the development position is reduced.

The data shown in the graphs were those obtained by a surface potentiometer which is located at the development position that is separated from the charging position by a predetermined angle that is determined by the arrangement for machine processing. The potential of the photosensitive body which is charged to a predetermined level at the charging position decreases due to dark attenuation during the time the photosensitive body is turned from the charging position to the development position. The potential at the development position is referred to as the surface potential which affects greatly the development conditions and influences the copied image directly. Accordingly, it is important to keep the surface potential at the development position at a constant value.

In the present invention, there are provided two charging devices (the first charging and the second charging), and both images, after exposure, are brought out to be visible by the first and the second developing units. Further, in order to set the surface potentials at the positions of both developing units at respectively predetermined values there are provided respective surface potential sensors between the first charging and the first development positions as well as between the second charging and the second development positions. The first charging and the second charging are controlled respectively by the outputs of these sensors. In particular, to set the potential at the second development section at a predetermined level through the control on the second charging is important in dichromatic printing in connection with prevention of color mixing on the photosensitive body and on the second developing unit sleeve.

There may be thought of a variety of ways for controlling the charging units. In the present invention use were made of a KOROTORON? for the first charging unit and a SUKOROTORON? for the second charging unit. It was arranged in the present invention to control the DC high tension to be applied to the wire by the KOROTORON? and to control the grid voltage by the SUKOROTORON?.

Next, the method of their control will be described.

Figure 43:
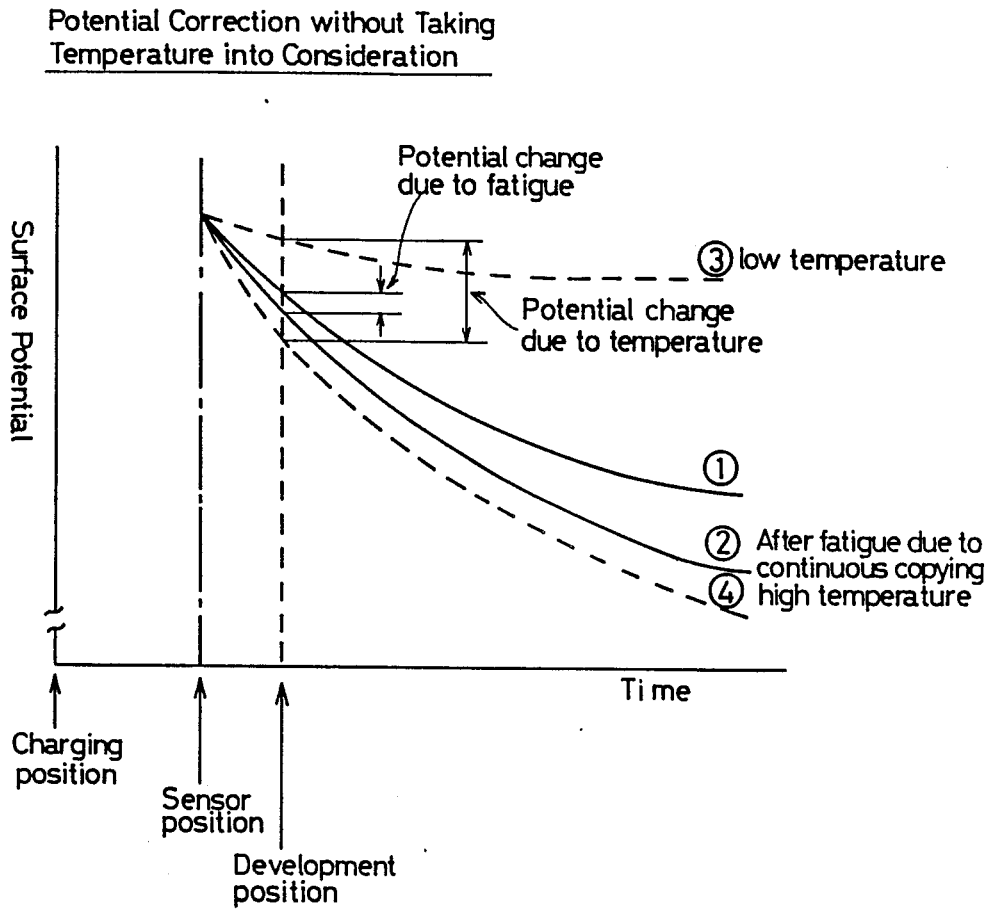
FIG. 43 is a curve which shows the case of compensating the surface potential characteristic without taking temperature into account.

A first method as shown in FIG. 43 is to measure the surface potential with a sensor that is located between the position of the charging unit and the position of the developing unit to control the potential at that position to be at a constant value. In comparison to large variations in the surface potential that varied due to the difference in the dark attenuations between the charging position and the development position in the case of without control, it becomes to vary due to the difference in the dark attenuations between the sensor position and the development position when there is introduced the control, so that the amplitude of variations becomes smaller because of the shortening of the attenuation time.

Although the variations in the surface potential may be lessened by the first method, a complete correction becomes difficult to achieve especially for photosensitive bodies with large temperature changes or fatigue due to continuous copying. In such a case a second method that follows may be adopted.

It is a method of lessening the variations in the surface potential at the development position that is required in practice, by changing the converging value of the potential at the sensor position in the rear, for different condition, by estimating the variations from the characteristics of the photosensitive body. First, the method of giving more accurate correction for variations due to temperature.

Figure 44:
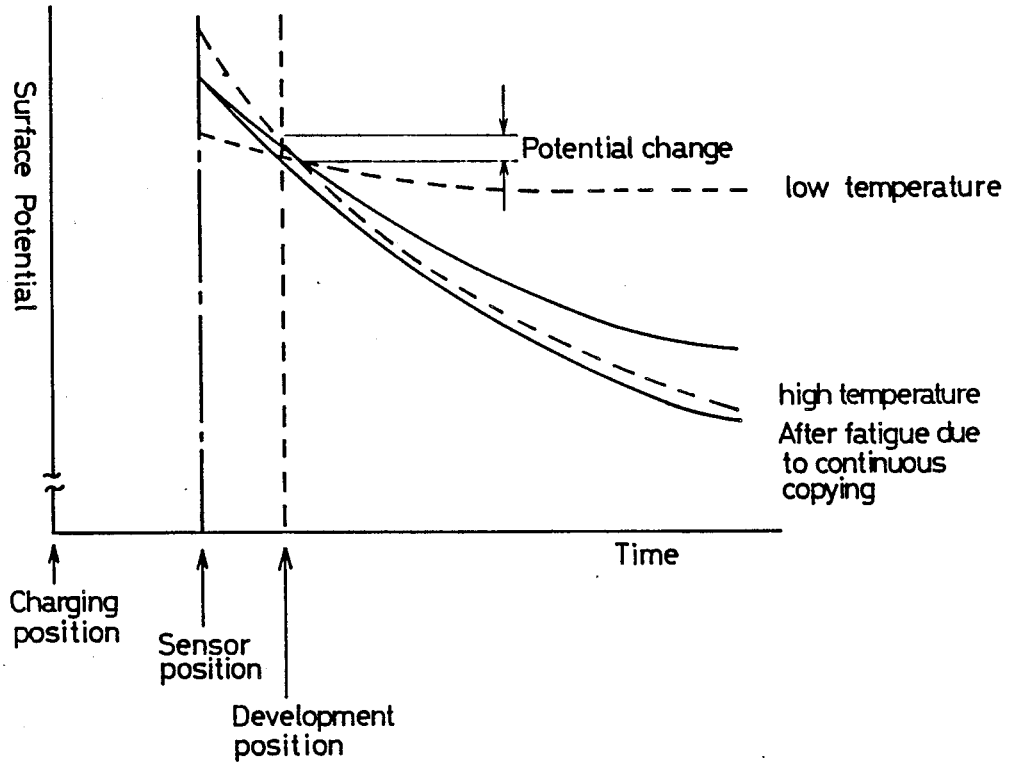
FIG. 44 is a curve which shows the case of compensating the surfade potential characteristic by taking temperature into account.

FIG. 44 is a diagram for illustrating the method of controlling the surface potential for the case of a photosensitive body which has a slow dark attenuation at low temperatures and a faster dark attenuation at high temperatures. In this method, the potential is kept at a constant value at the development position by setting the surface potential at the sensor position to be low for low temperatures and high at high temperatures. The situation is similar for fatigue due to continuous copy, so that the potential at the sensor position needs only be controlled by estimating the changes in the dark attenuation during continuous copying.

These situations may be summarized that, by calling the time for the photosensitive body to travel between the sensor position and the development position T, dark attenuation V during the time T varies according to the temperature conditions and the conditions for continuous copying, so that the potential at the sensor position is given by $$V+V$$

where V is the necessary potential at the development position.

To make a correction to the changes due to temperature, it can be achieved by detecting the temperature of the photosensitive body with a temperature detection element to change automatically the valur of V.

To make a correction to the changes due to continuous copying, it can be achieved by counting the number of copies to vary the value of V.

Next, a detailed description of an embodiment of the present invention will be given based on its electrical comfiguration.

Figure 45:
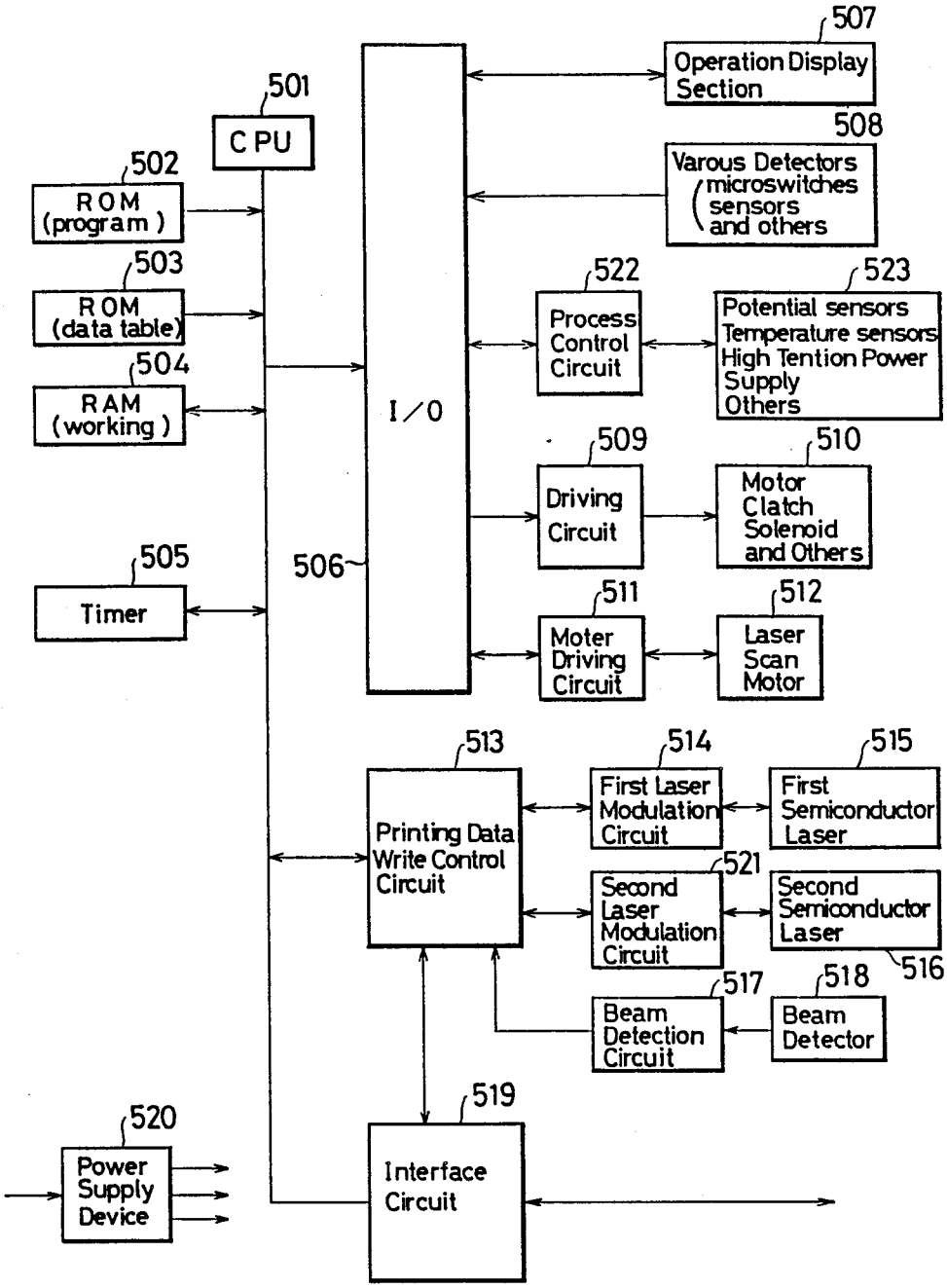
FIG. 45 is a block diagram which shows the configuration of the control in the dichromatic LBP that employs the present invention.
Figure 76:
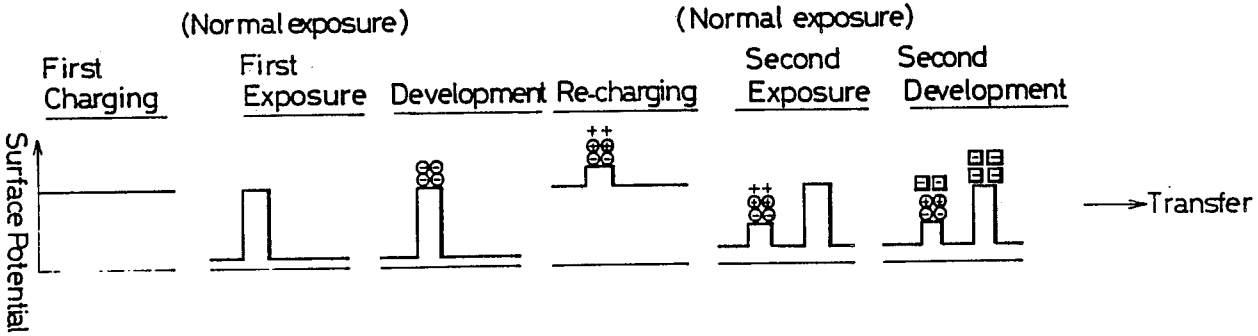
FIGS. 76A & 76B are a transitional diagram which shows schematically the conditions of the conventional photosensitive body in accordance with the processes.
Figure 76:
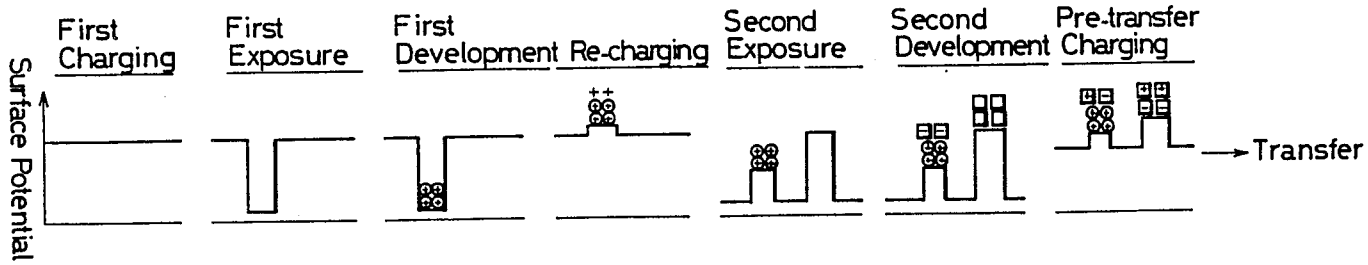

FIG. 45 is a block diagram which shows the configuration of the control section of the dichromatic LBP.

The control section of the dichromatic LBP includes basically a ROM 502 which houses a system program with CPU 501 as the control center, a ROM 503 which houses a data table, a ROM 504 which is used as a working memory, a timer 505, an I/O device 506 for I/O data, a writing control circuit 513 for printing data, and an interface circuit 519.

As shown in FIG. 46, the contents of the data table housed in the ROM 503 consist of top margin control data for a first color stored in addresses (4000) and (4001), top margin control data for a second color stored in addresses (4002) and 4003), and left margin control data stored in addresses (4004) and (4005).

Further, in addresses (4006) and (4007) there are stored bottom margin control data in the case of paper size of A3, and in addresses (4008) and )4009) right margin control data for the same size of the paper are stored. In a similar manner, tables corresponding to various sizes of the paper are stored up to the address (4083).

in addresses starting with (4090) there are stored coarse adjustment data for top margin, in addresses starting with (40B0) there are stored fine adjustment data for top margin, in addresses starting with (40D0) there are stored coarse adjustment data for left margin, in addresses starting with (4100) there are stored fine adjustment data for left margin, and in addresses starting with (4120) there are stored data for correcting scanning length for two beams, each of the foregoing data corresponding to switches from 1 to n.

These margin control data, coarse adjustment data, and fine adjustment data will be used as the setting data a margin controlling counter and a binary counter, of a printing data write control circuit 513 that will be described later.

In addresses (6000) and (6001) there is stored a first development bias data for red toner, and in addresses (6002) and (6003) there is stored a second development data for the same color. Similarly, first and second development bias data for blue toner, green toner, and black toner are stored in the addresses up to (600F). These will be used as the setting data for development bias control for a process control circuit 522 that will be described later.

In addresses (6100) and (6101) there are stored target surface potential table data for a first charging potential control, having a reference value of 25° C.

n addresses (6102) and (6103) there are stored error table data in convergence, which represents a tolerance control range for the target surface potential. In the addresses (6104) and (6105) there are stored output table data for a first time control, which will be used as a setting value for a first corona charger which is output for the first time during the warning up.

In the addresses (6106) and (6107) there are stored minimum correction table data.

In addresses (6108) and (6109) there are stored surface potential limits table data, in addresses (610A) and (610B) there are stored control output upper limits table data, an in addresses (610C) and (610D) there are stored control output lower limits table data. The surface potential limits table data, the control output upper limits table data, and the control output lower limits table data will be used for self diagnosis of the control system.

Following them tables that correspond to second charging potential control are stored in addresses up to (611B). In addresses starting with (6120) there are stored charge transition temperature correction table data for a temperature range of 10° C. to 40° C., which serves as a temperature correction data for the target surface potential table data of 25° C.

The time 505 is a general purpose timer and generates fundamental timings for controlling the paper transportion processes around the photosensitive body, and so forth.

The I/O device 506 carries out outputting of display data to a scan display section 507, inputting of various kinds of switch data or the like, inputting to each of the detector in the control section, outputting to driving circuits for driving elements such as motor clatches, solenoids, outputting to a driving circuit 511 for driving a laser scan motor 512 that scans the two laser beams, and inputting and outputting to and from a process control circuit 522 that controls the output of a high tension power supply 523 and others in response to the inputs of detected signals such as potential sensors, temperature sensors, and so forth.

The printing data write control circuit 513 controls the driving of a first laser modulation circuit 514 for optically modulating the first semiconductor laser 302 for image data writing of the first color and a second laser modulation circuit 521 for optically modulating the second semiconductor laser 303 for image data writing of the second color, and controls the writing of the printing data of video image sent from a host system 500 in a predetermined position on the photosensitive body. In this case, a beam detector 518 which makes use of pin diode of luminous response, detects one of the two light beams that are scanned by a laser scanning motor, horizontal synchronized pulses are generated by a beam detector 517 by digitizing analog signals from the beam detector 518 with a luminous comparator, and the detector 517 sends out the pulses to the printing data write control circuit 513.

An interface circuit 519 carries out outputting of status data to the host system 500 as well as receiving of command data and printing data from the host system 500.

In addition, there is provided a power supply 520 to supply power to each of these control sections.

In what follows a detailed description will be given for the major blocks in FIG. 45.

Figure 47:
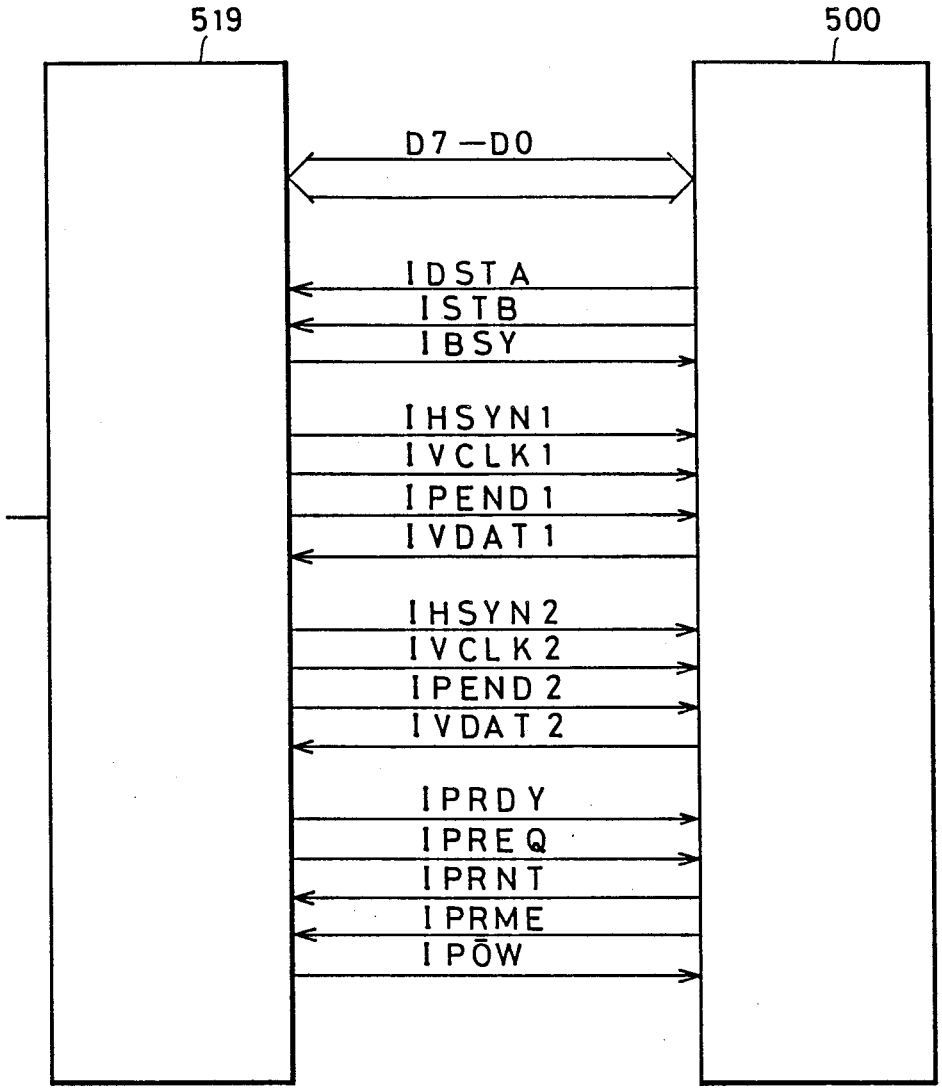
FIG. 47 is a diagram which shows the details of the interface signal between the interface circuit and a host system.

FIG. 47 is a diagram for illustrating the details of the interface signals that are transferred between the interface circuit 519 and the host system 500. In the figure, D7-D0 is an 8-bit both-way data bus, IDSTA is a selection signal for the data bus, which will be used for selecting which one is to be used between a status data bus to the host system 500 and a command data bus from the host system 500. Further, ISTB is a strobe signal for latching the command data within the interface circuit, and IBSY is a signal for approving the sending of a strobe signal ISTB and for approving the reading of the status data.

A signal IHSTN1 is a horizontal synchronized signal of the first color which requests sending of one line of printing data.

A signal IVCLK1 is a video clock signal of the first color which requests sending of one dot of printing data.

A signal IPEND1 is a page end signal which informs the completion of one line of printing.

The host system 500 sends out a video data signal IVDAT1 for the dot image data of the first color, based on IHSYN1 and IVCLKl signals, and discontinues the sending upon receipt of an IPENDl signal.

Figure 48:
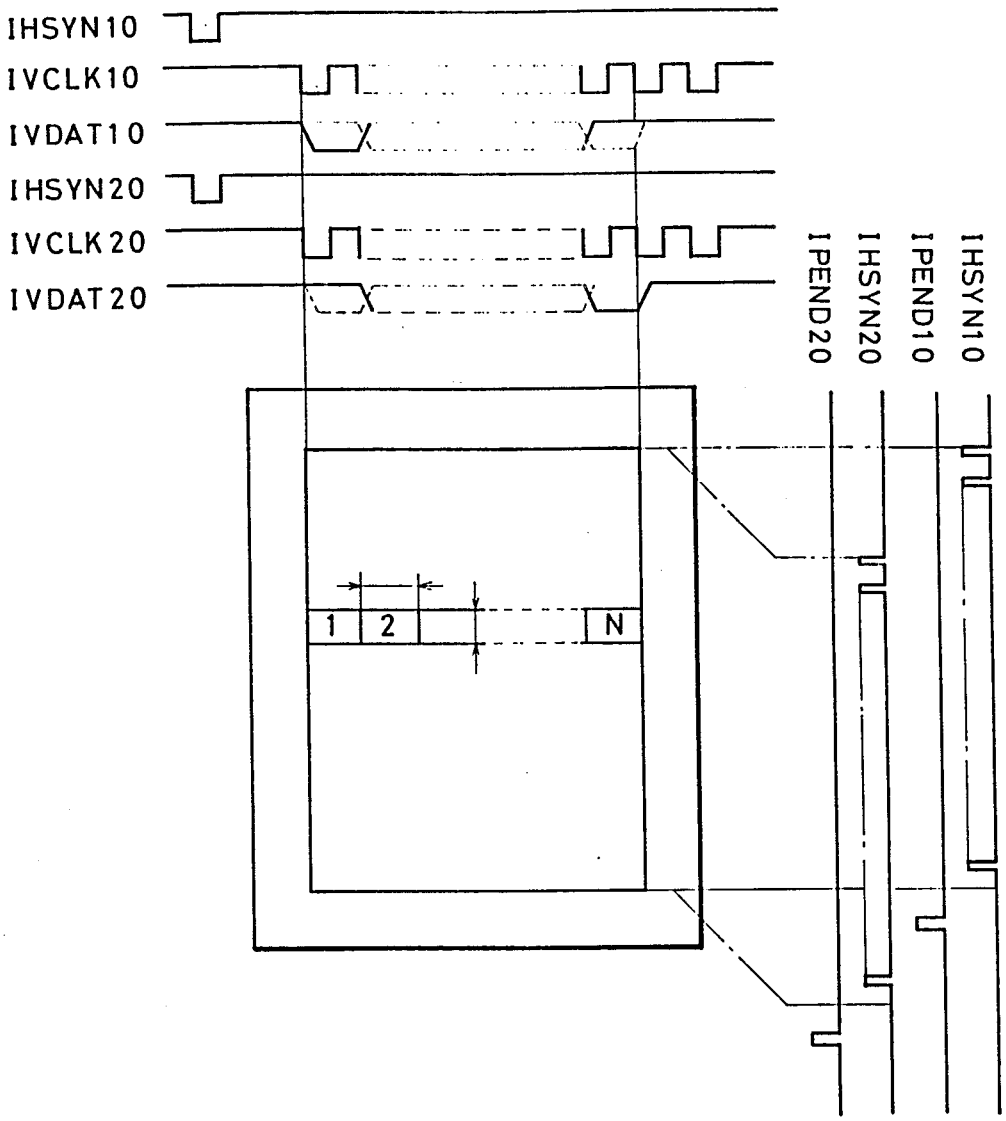
FIG. 48 is a diagram for illustrating the relationship between the interface signal and the data writing position.

Similarly, IHSYN2 is a horizontal synchronized signal of the second color, IVCLK2 is a video clock signal for the second color, and IPEND2 is a page end signal for the second color. The host system sends out a video data signal IVDAT2 of dot image data for the second color based on IHSYN2 and IVCLK2, and discontinues its sending upon receipt of an IPEND2. These video data signals IVDAT1 and IVDAT2 are sent to the printing data write control circuit. The relationship described in the above is shown in FIG. 48.

A signal IPRDY is a signal that informs that the dichromatic LBP 199 is a ready state, IPREQ is a signal which approves sending of a print starting signal IPRNT from the host system 500, IPRME is a prime signal which brings the dichromatic LBP 199 to an initial state, IPOW is a signal which informs that the dichromatic LBP 199 is the on-state.

Next, details of the command and status used for the dichromatic LBP 199 in FIG. 49(A) and FIG. 49(B), respectively.

In FIG. 49(A), SRl to SR7 are status request command which correspond to statuses 1 to 7 in FIG. 49(B), CSTU is a command indicating paper feeding for the upper part of the cassette, CSTL is a command indicating the same for the lower part, VSYNC is a command indicating the start of sending printing data from the host system 500, SP1, SP2 and DP1 are commands indicating the printing mode, where SP1 is the printing operation with the first color alone, SP2 is the printing operation with the second color alone, and DP1 is a mode which indicates the printing operations of both of the first color and the second color. Finally, ME1 to ME9 are command indicating manual modes of various kinds.

In FIG. 49(B), "paper in transportation" is a status which shows that paper is fed and it is in transportation within the dichromatic LBP 199, VSYNC request is a status which indicates that the dichromatic LBP 199 received a print start position and that receipt of printing data is now possible, "manual" is a status which indicates that the paper feeding mode is in the manual state, "cassette top/bottom" is a status which indicates the state of cassette selection of the cassette paper feeding, "printing mode-first color mode, second color mode, two color mode" is a status which indicates the printing mode state that is selected, "cassette size (top)" and "cassette size (bottom)" are status that show the size code of cassette installed, "toner color (first color)" and "toner color (second color)" as status that show the toner color code of the developing unit installed, "test-/maint" is a status that indicates that it is in the test-/maintenance state, "data re-sending request" is a status which shows that re-printing is necessary due to jamming of a paper or the like, "during wait" is a status which indicates that the dichromatic LBP is in the warming-up state of the fixing unit, and "operator call" indicates an occurrence of a factor for an operator call of status 5. "Serviceman call" indicates that a factor for serviceman call of status 6 occurred. "Toner pack exchange" indicates that the toner is full in the toner pack. "No paper" indicates that there remains no paper in the cassette indicated. "Paper jam" indicates that a paper is jammed in the apparatus. "No first color toner" indicates that no toner exists in the first developing unit, "no second color toner" indicates that no toner exists in the second developing unit, "first laser failure" indicates that the first laser diode is not reaching a prescribed output yet or that the beam detector cannot detect the beam, "second laser failure" indicates that the second laser diode is not reaching a prescribed output yet. "Scan motor failure" indicates that the scan motor does not reach a prescribed speed of rotation even after elapse of a predetermined length of time or it deviates for some reason from the prescribed speed of rotation after reaching the prescribed speed of rotation. "First potential sensor failure" and "second potential sensor. failure" show respectively that the surface potential of the photosensitive body cannot be detected, and "re-sending page number" indicates the number of pages for re-printing when there occurred a data re-sending request status.

Figure 50:
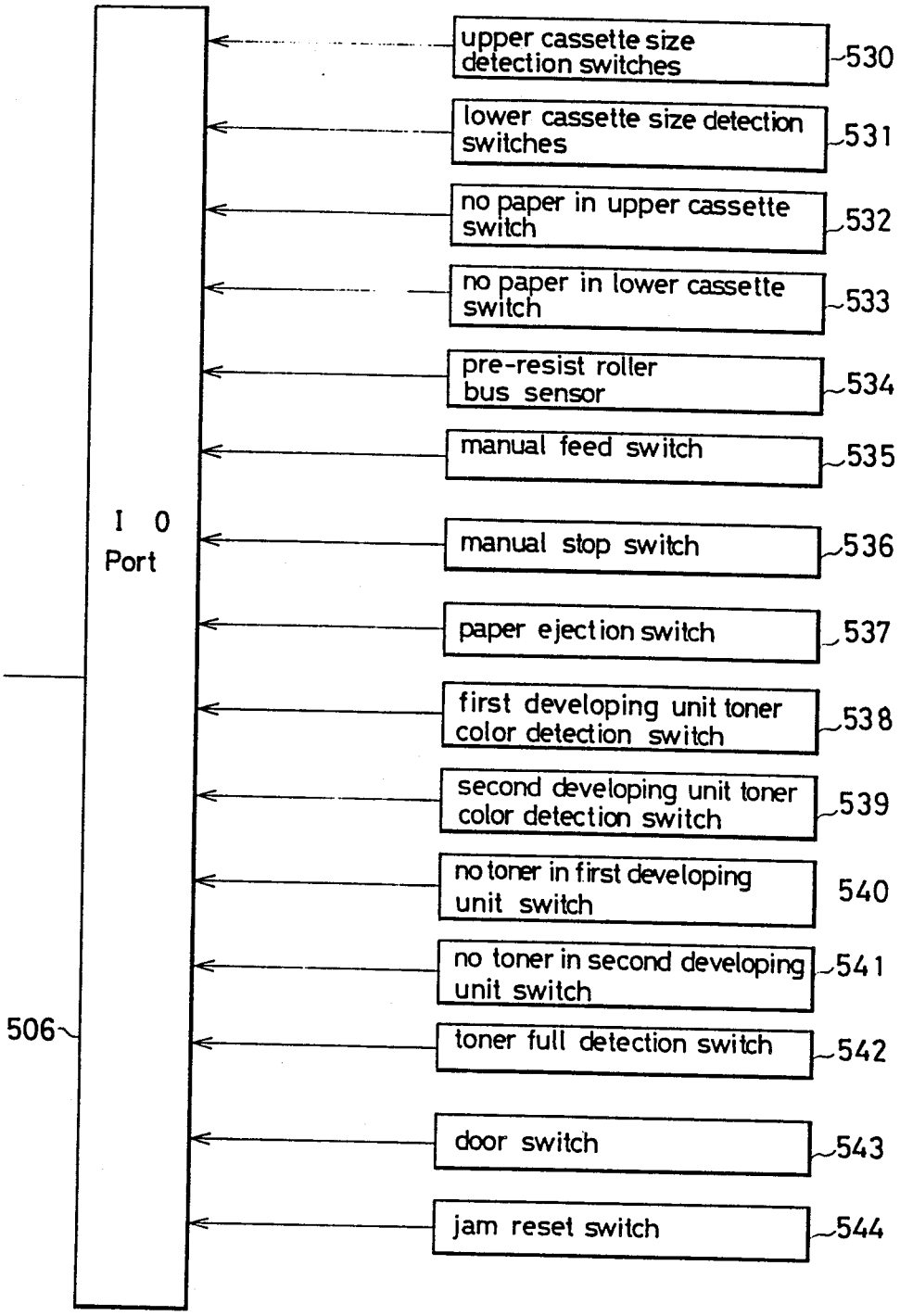
FIG. 50 is a block diagram which shows various kinds of detectors in detail.

FIG. 50 is a detailed block diagram for various kinds of detectors 508 shown in FIG. 45. In FIG. 50, signals from various kinds of detectors are input to the I/O port 506. Reference numeral 530 represents upper cassette size detection switches which consist of four switches where various paper sizes are represented by combinations of these switches. Reference numeral 531 represents lower cassette size detection switches with configuration which is similar to the upper cassette size detection switch Reference numeral 532 is a no paper in upper cassette switch which is turned on when there is no paper in the upper cassette Reference numeral 533 is a no paper in lower switch. Reference numeral 534 is a pre-resist roller bus sensor detects presence or absence of the papers sent from the paper feeding cassette Reference numeral 535 is a manual feed switch which detects a paper which is fed through manual feeding guide, and 537 is a paper ejection switch which is located in the fixing roller section. Reference numeral 538 first developing unit toner color detection switches that consist of three switches and designate toner colors by their combinations. Reference numeral 539 are second developing unit toner color detection switches whose configuration is similar to the first developing unit toner color detection switches. Reference numeral 540 is a no toner in first developing unit switch which detects that there exists no toner in the first developing unit, 541 is a no toner in second developing unit switch which detects that there exists no toner in the second developing unit, and 542 is a toner full detection switch which is activated when the toner pack is filled with toner.

Reference numeral 543 is a door switch which is turned on or off by opening and closing of the front cover, and 544 is a jam reset switch which is provided in the front cover. The am reset switch is a switch which is turned on to confirm that a paper jamming is taken care of or that the toner pack is replaced when a paper jamming occurred or there is generated an operator call for filling of the toner. Accordingly, the operational display for a jam or filling the toner will not be cleared unless this switch is closed.

Figure 51:
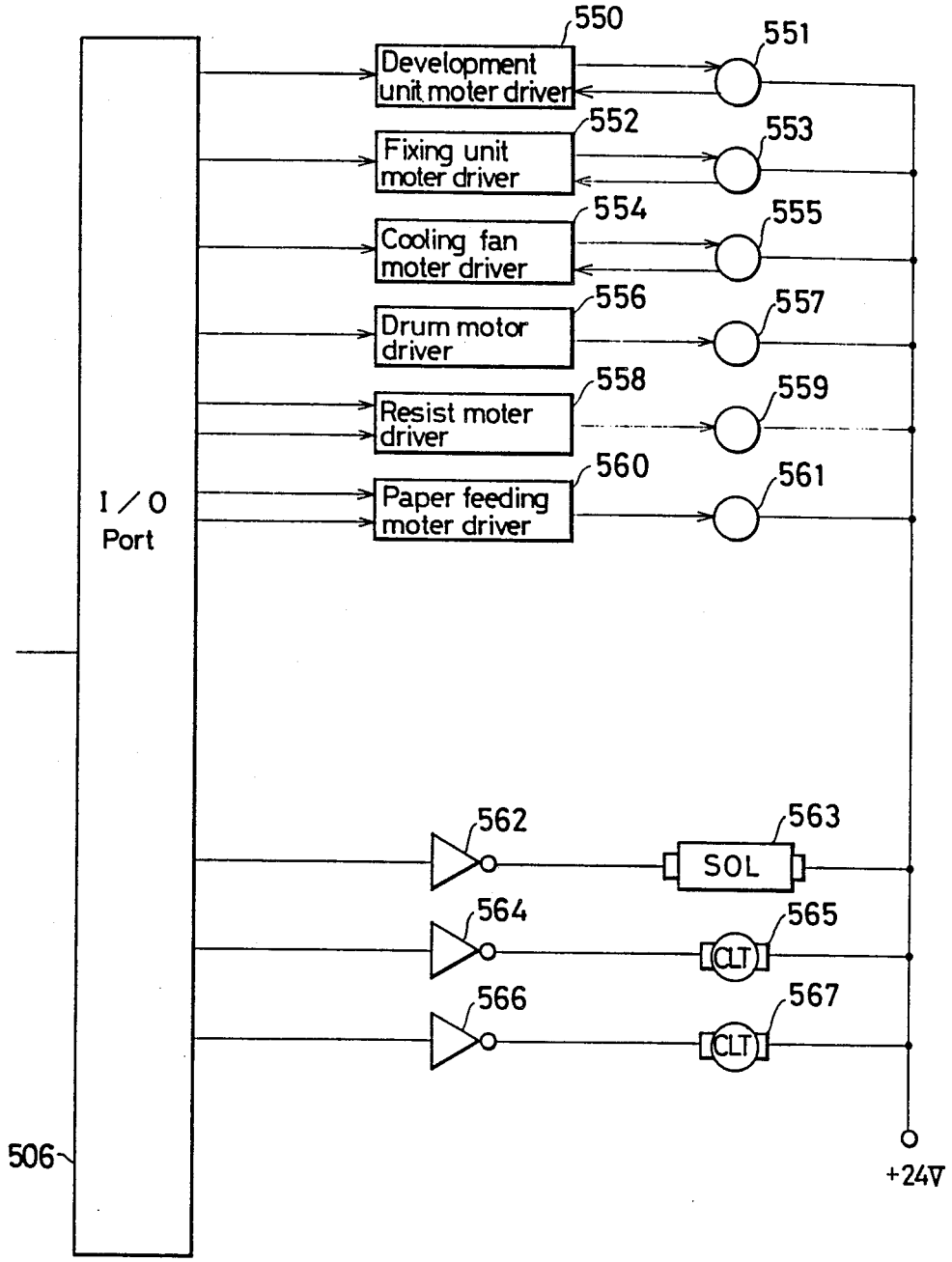
FIG. 51 is a block diagram which shows the details of the driving circuits and the output elements.

FIG. 51 is a block diagram which shows the details of a driving circuit 509 and an output element 510 shown in FIG. 45. In FIG. 51, 551 is a motor for developing units for which use is made of a Hall motor which is DC driven. Reference numeral 550 is a driver of the motor for the developing units, and is PLL controlled. Reference numeral 553 is a motor for the fixing units, and use is made of a Hall motor of DC drive. Reference numeral 552 is a driver of the motor for the fixing units, and is PLL controlled. Reference numeral 555 is a fan motor for cooling the interior of the apparatus for which use is made of a Hall motor driven by DC. Reference numeral 554 is a driver for the cooling fan motor, but is not PLL controlled as in the developing units and the fixing units. Reference numeral 557 is a driving motor for the photosensitive drum 200 which makes use of a four-phase pulse motor. Reference numeral 556 is a driver for the drum motor which makes use of a constant current 1–2 phase excitation type. Reference numeral 559 is a resist motor for driving the resist rollers 218 and manual feeding roller, which makes use of a four-phase pulse motor. Reference numeral 558 is a driving motor for the resist motor for which use is made of a constant voltage two-phase excitation type. Further, if the resist motor 559 is rotated in the forward direction, it rotates the resist rollers and if it is rotated in the reverse direction, it rotates the manual feeding roller.

Reference numeral 561 is a paper feeding motor which drives the lower paper feeding roller and the upper feeding roller, and makes use of a four-phase pulse motor. Reference numeral 560 is a driver for the paper feeding motor, and makes use of a constant voltage two-phase excitation type similar to the resist motor driver 558.

Reference numeral 563 is a solenoid for collecting toner, and when it is turned on, the blade 210 is pushed against the photosensitive body 200. Reference numeral 562 is a driver for the blade solenoid.

Reference numeral 565 is an electromagnetic clatch for first developing unit, and when the developing units are turned on in the state of turning-on of the clatch, the sleeve in the first developing unit is arranged to be rotated. Reference numeral 564 is a driver for the first electromagnetic clatch for the first developing unit. Reference numeral 567 is an electromagnetic clatch for the second developing unit, and when the motor 551 for developing units is turned on while the clatch is in on-state, the sleeve in the second developing unit is rotated. Reference numeral 566 is a driver for the electromagnetic clatch for the second developing unit.

Figure 52:
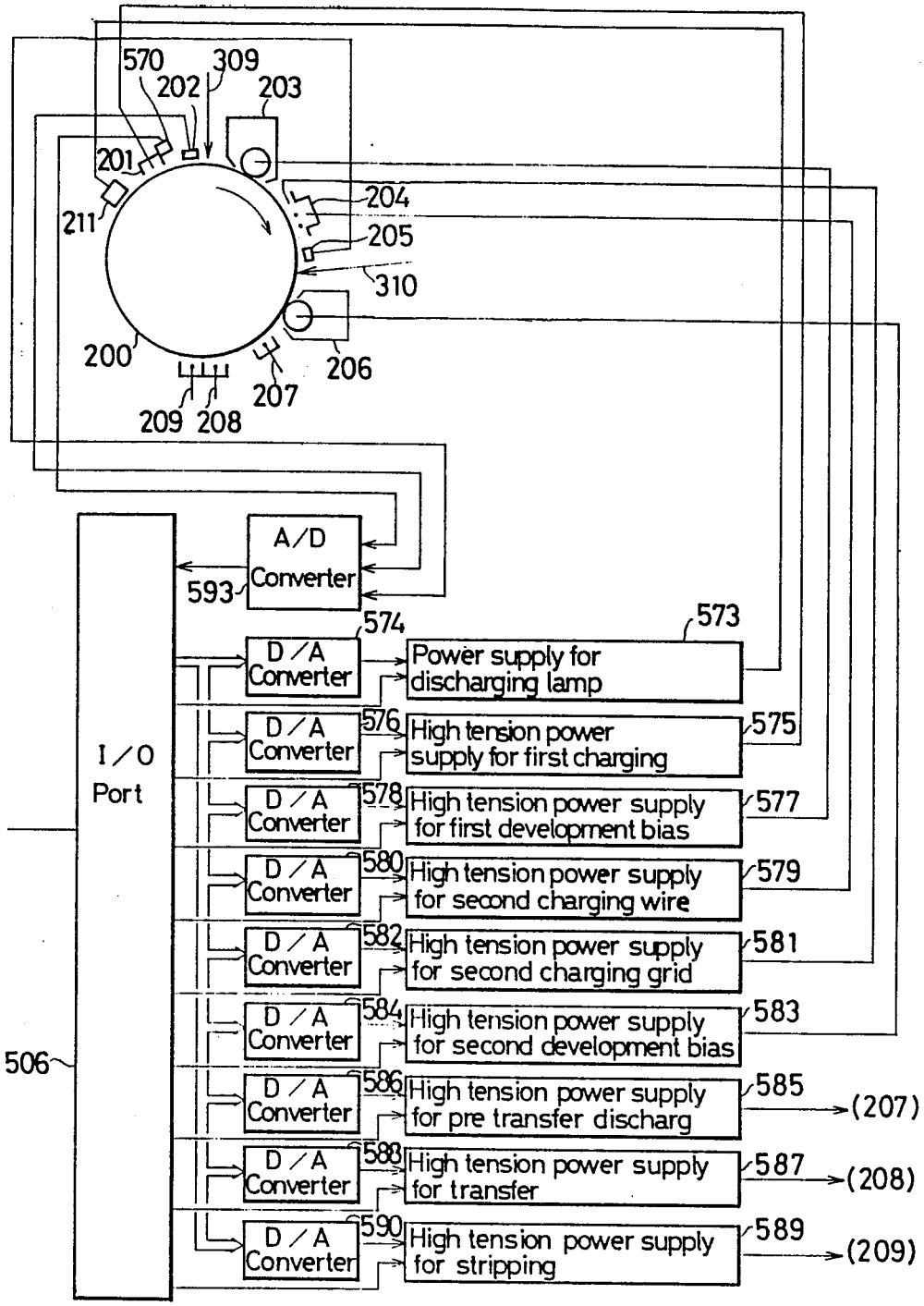
FIG. 52 is a block diagram which shows the details of the process control circuits and its input-output terminals.

FIG. 52 is a block diagram which shows the details of the process control circuit 522 and its input-output elements 523 shown in FIG. 45. In FIG. 52, 201 is a first charger for charging with its corona discharge wire connected to the output terminal of the high tension power supply 575 for first charging. The input terminals of the high tension power supply for first charging are connected to the output of a D/A converter 576 which changes the high tension output current and to a signal from the I/O port which carries out ON/OFF of the high tension output. The input of the D/A converter 576 is connected to the I/O port 506, and CPU 501 controls the output current of the high tension power supply 575 for fist charging via the D/A converter 576. Reference numeral 570 is a drum temperature sensor which detects the temperature in the neighborhood of the photosensitive body 200, and its output is input to an A/D converter 593. The output of the A/D converter 593 is input to the 1/0 port 506 and is processed in the CPU 501. Reference numeral 202 is the first potential sensor which detects the surface potential of the photosensitive body 200, and its output is input to the A/D converter 593. Reference numeral 309 is the beam of the first semiconductor laser, 203 is the first developing unit, the sleeve of the developing unit is connected to the output terminal of the high tension power supply 577 for first development bias, and the input terminals of the high tension power supply 577 for first development bias are connected to the output of a D/A converter which changes the high tension output voltage and to a signal from the I/O port which carries out ON/OFF of the high tension output. The output of the high tension power supply for first development bias is an output of AC+DC.

Reference numeral 204 is a second charger for charging, and the corona discharge wire of the charger are connected to the output terminal of a high tension power supply 579 for second charging wire, and the grid of the charger is connected to the output terminal of the high tension power supply 581 for second charging. To the input terminals of the high tension power supply 579 for second charging wire are input the output of a D/A converter 580 which varies the high tension output voltage and a signal from the I/O port which carries out ON/OFF of the high tension output. To the input terminals of the high tension power supply 581 for second charging grid are input the output of a D/A converter 582 which varies the high tension output voltage and a signal from the I/O port which carries out ON/OFF of the high tension output. For the chargers except for the second charger for charging, use are made of general and charger.

Reference numeral 205 is the second potential sensor which detects the surface potential of the photosensitive body 200, and its output is input to the A/D converter 593. Reference numeral 310 is the beam of the second semiconductor laser, 206 is the second developing unit, the sleeve of the developing unit is connected to the output terminal of the high tension power supply 583 for second development bias, and the input terminals high tension power supply 583 for second development bias are connected to the output of a D/A converter 584 which varies the high tension output voltage and a signal from the I/O port which carries out ON/OFF of high tension output. The output of the high tension power supply for second development bias is a DC output. Reference numeral 207 is the pre-transfer discharging charger which is connected to the output terminal of a high tension power supply 585 for pre-transfer discharger, and the input terminals of the high tension power supply 585 for pre-transfer discharge are connected to the output of a D/A converter 586 which varies the high tension output voltage and a signal from the I/O port which carries out ON/OFF of the high tension output.

Reference numeral 208 is the transfer charger which is connected to the output terminal of a high tension power supply 587 for transfer, and the input terminals of the high tension power supply 587 for transfer are connected to the output of a D/A converter 588 which varies the high tension output voltage and a signal from the I/O port which carries out ON/OFF of the high tension output.

Reference numeral 209 is the stripping charger which is connected to the output terminal of a high tension power supply 589 for stripping, and the input terminals of the high tension power supply 589 for stripping are connected to the output of a D/A converter 590 which varies the high tension output voltage and a signal from the I/O port which carries out ON/OFF of the high tension output.

Reference numeral 211 is the discharging lamp which is connected to a power supply 573 for discharging lamp, and the input terminals of the power supply 573 for discharging lamp are connected a D/A converter 574 which varies the amount of output light of the discharging light and a signal from the I/O port which carries out ON/OFF of the output of the discharging lamp.

Figure 53:
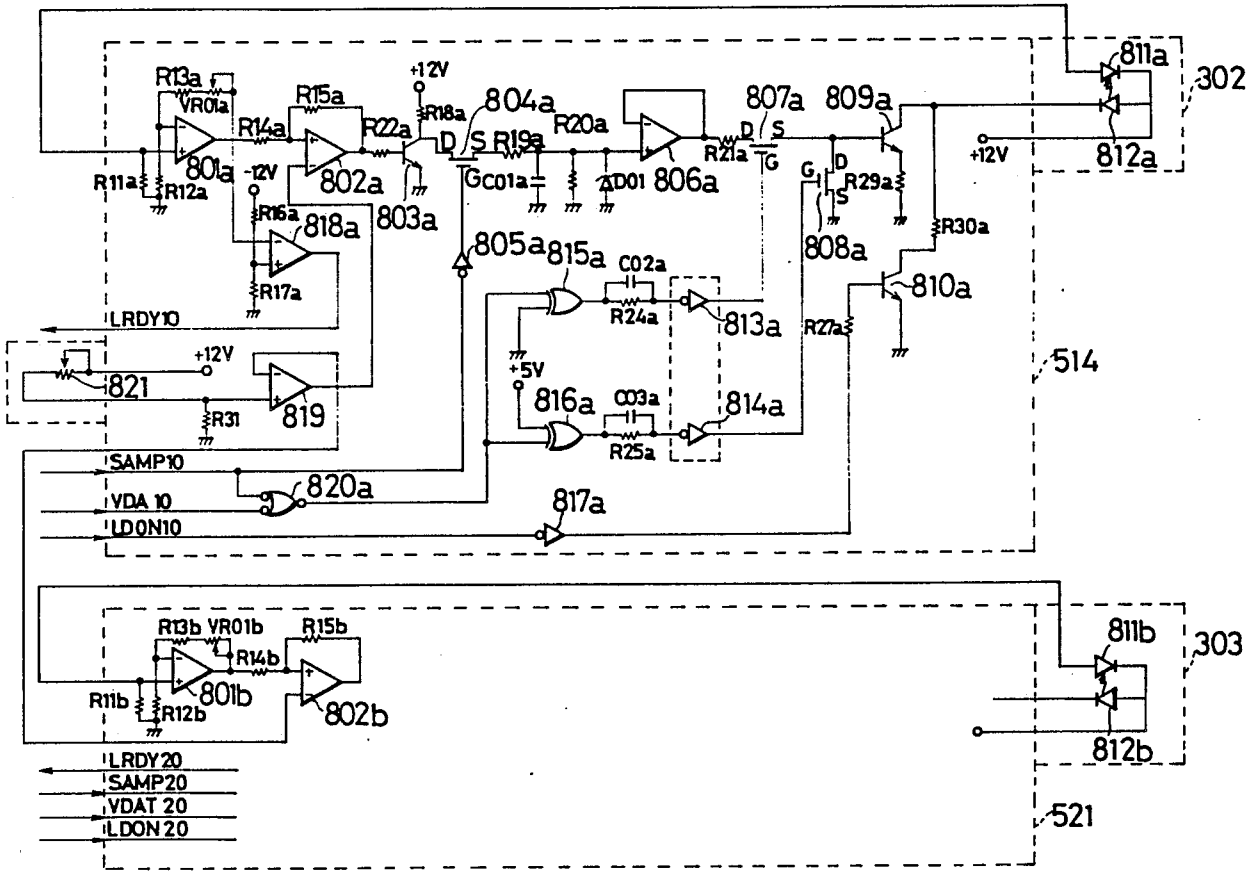
FIG. 53 is a block diagram which shows the details of the laser modulation circuits and the semiconductor lasers.

FIG. 53 is a detailed circuit diagram for the first laser modulation circuit 514, the first semiconductor laser, the second laser modulation circuit 521, and the second semiconductor laser. First, the first laser modulation circuit 514 and the first semiconductor laser 302 will be described.

In FIG. 53, 302 is a first semiconductor laser diode which consists of a light-emitting laser diode 812*a* and a photodiode 811*a* for monitoring the output beam intensity from the laser diode.

Reference numeral 809*a* is a high frequency transistor, a resistor R29*a* which carries out optical modulation for the first laser diode 812*a* is a current detecting resistor, 810*a* is a transistor for lowing a bias current in the first laser diode 812*a*, R30*a* is its current limiting resistor, R27*a* a base current limiting resistor for the transistor 810*a*, and 817*a* is an inverter. To the input of the inverter 817*a* there is input a first laser diode enable signal LDON10, and when the signal becomes LOW level, the transistor 810*a* is turned on and a bias current flows in the first laser diode 812*a*. Reference numerals 807*a* and 808*a* are luminous analog switches for giving modulations to the first laser diode 812*a*, and each of the analog switches becomes on-state when a HIGH level signal is applied to the gate (G) and the resistance between the drain (D) and the source (S) becomes low. On the contrary, when a LOW level signal is applied to the gate, the resistance becomes high and the switch becomes off-state. Reference symbol R21*a* is a short-circuit protective resistor during ON-OFF changes of the analog switches 807*a* and 808*a*, and 813*a* and 814*a* are date drivers for the analog switches 807*a* and 808*a*. Reference symbols C02*a* and C03*a* are capacitors for speeding up, and R24*a* and R25*a* are input resistors for the gate drivers 813*a* and 814*a*. Reference symbols 815*a* and 816*a* are EXCLUSIVE-OR gates which can be changed by the output of a 2 AND gate 820*a*. The output of the 2 AND gate 820*a* becomes LOW level when either one of its inputs becomes LOW level, then the output of the EXCLUSIVE-OR gate 815*a* becomes LOW level, the analog switch 807*a* is turned on, and the first laser diode 812*a* becomes on-state. The condition for bringing the output of the AND gate 820*a* to LOW level is either the first video data signal VDAT10 is on LOW level or a first sample signal SAMP10 is on LOW level. When both of the inputs to the 2 AND gate are HIGH level, the output of the EXCLUSIVE-OR gate 816*a* becomes LOW level, the analog switch 808*a* is turned on, and the first laser diode 812*a* becomes off-state.

Reference numeral 806*a* is an operational amplifier and forms a voltage follower circuit. DOl is a Zener diode which regulates the output of the first laser diode 812*a* within the maximum rated value. Further, a resistor R19*a* and the capacitor COl*a* constitute an integration circuit, and R20*a* is a discharge resistor to discharge the charges on the capacitor C01*a* at a fixed rate. Reference numeral 804*a* is an analog switch whose gate (G) is connected to the inverter 805*a*, and the input of the inverter 805*a* receives the first sample signal SAMP10. Reference numeral 803*a* is a transistor for level transformation, R22*a* is a base current limiting resistor for the transistor 803*a*, and R18*a* acts as a current limiting resistor during charging of the capacitor CO1*a*. Reference numeral 802*a* is a comparator which is endowed with a hysteresis characteristic by the action of resistors R14*a* and R15*a*.

To the + input side of the comparator 802*a* there is impressed through a resistor R14*a* the output voltage of a first laser monitoring amplifier 801*a*. The amplifier 801*a* amplifies the output of a photodiode 811*a* which detects the light output from the first laser diode 812*a*. Resistors R12*a*, R13*a*, and VR01*a* regulate the degree of amplification of the operational amplifier 801*a*. Accordingly, the degree of amplification of the operational amplifier 801*a* can be varied by varying VRO1*a*. Reference numeral R11*a* is an effective loading resistor for the output of the photodiode within the first laser diode, and between the ends of the resistor there is obtained a voltage which is proportional to the output current of the photodiode 811*a*. Since the output current of the photodiode 811*a* is proportional to the light output of the laser diode 812*a*, the light output of the laser diode can be adjusted by varying the volume VRO1*a*.

Reference numeral 818*a* is a comperator for confirming 10 whether the first laser diode is emitting light, and to the side input there is impressed the output voltage of the operational amplifier 801*a*. To the + side input there is impressed a voltage that is divided by resistors R16*a* and R17*a*. Accordingly, when the first laser diode 812*a* emits light and its output becomes greater than the voltage that is divided by the resistors R16*a* and R17*a*, the output level of the comparator 818*a* changes from HIGH level to LOW level, and a first laser ready signal LRDY10 is output.

Further, to the − side input terminal of the comparator 802*a* there is impressed a setting voltage for laser light quantity. The setting voltage used is the output of a voltage follower 819. To the + input terminal of the voltage follower 819 is input a voltage that is divided by an exposure adjusting volume 821 and a resistor R31 so that it is possible to vary the output voltage of the voltage follower 819 by varying the exposure adjusting volume 821.

Next, the operation of a first laser modulation circuit 514 and a first laser diode 512 will be described. First, when the first laser diode enable signal LDON10 becomes LOW level, a bias current flows in the first laser diode 812*a*. Next, when the first sample signal SAMP10 becomes LOW level, the output of a voltage follower 806*a* becomes 0 V and a modulating transistor 809*a* is not turned on, since the analog switches 804*a* and 805*a* are turned on but the capacitor CO1*a* is not charged. Consequently, there is flowing a current in the first laser diode 812*a* to an extent in which it will not radiate. At this time, there is no current in the first photodiode 811*a* so that the output of the comparator 802*a* is on LOW level and the transistor 803*a* is turned off, and hence, the capacitor CO1*a* is charged through resistors R18*a* and R19*a*. The time constants of the resistors R18*a* and R19*a* and the capacitor CO1*a* for the charging are chosen in the range of 20 to 50 msec.

If the values of the time constants are too small, response of the stabilizing circuit is too fast and the variations in the light output level of the laser become large. On the contrary, if they are too large, the response becomes poor and it takes long time before the light output becomes stabilized. Due to charging of the capacitor CO1*a*, the output voltage of the voltage follower 806*a* is raised gradually. Accordingly, a collector current begins to flow in response to the rise in the base voltage of the laser modulating transistor 809*a*.

In the first laser diode 812*a* there flows a resultant of the bias current from the transistor 810*a* and the collector current from the transistor 809*a*, and when the resultant current exceeds the threshold current for the first laser diode 812*a*, the first laser diode 812*a* emits light. Through the emission from the first laser diode 812*a*, a current flows in the first photodiode 811*a* for monitoring, the voltage of the + input terminal of the operational amplifier is raised, and the amplifier outputs a voltage which is an amplification of the input voltage. When the output voltage of the operational amplifier 801*a* becomes greater than the voltage divided by the resistors R16*a* and R17*a*, the output of a comparator 818*a*, namely, the first laser ready signal LRDY10, changes from HIGH level to LOW level. When the output voltage of the operational amplifier 801*a* exceeds the voltage at the input terminal of the comparator 802*a*, namely, the set voltage for the first laser light quantity, the output of the comparator 802*a* changes from LOW level to HIGH level, the transistor 803*a* is turned on, and the condenser CO1*a* is discharged through the resistor R19*a*. Accordingly, the base voltage of the modulating transistor 809*a* is also lowered and the light output of the first laser diode is lowered. When the light output of the first laser diode is lowered, the voltage of the + input terminal of the comparator 802*a* also becomes lower than the set voltage for the light quantity of the first laser, so that the transistor 803*a* is turned off again and the capacitor CO1*a* is charged again through the resistors R18*a* and R19*a*. In this manner, when the light output of the first laser diode 812*a* reaches the set voltage at the − terminal for light quantity of the first laser, the comparator 802*a* thereafter repeats gradually ON and OFF in the neighborhood of the set voltage for light quantity of the first laser, and the light output of the first laser diode 812*a* is stabilized.

When the CPU 501 confirms via the I/O port that the first laser ready signal LRDY10 becames LOW level, the sample timer that will be described later is started to operate, the first sample signal SAMP10 is kept on LOW level for a fixed length of time in the region outside of printing for each line, to stabilize the laser light quantity by turning on the analog switches 804*a* and 807*a*.

Next, when the dichromatic LBP 199 becomes in the printable state and the first video data signal VDAT10 is sent out from the host system 500, the analog switches 807*a* and 808*a* repeat ON and OFF in response to the first video data signal VDAT10, the first laser diode 812*a* is modulated by the modulating transistor 809*a*, and writes a dot image data on the photosensitive body 200.

In the above, the first laser modulation circuit 514 and the first semiconductor laser 302 were described in detail. The second laser modulation circuit 521 and the second semiconductor laser 303 have similar configurations. However, to the light quantity setting voltage of the second laser diode 812*b*, namely, to − input terminal of the comparator 802*b*, is applied the output of the voltage follower 819. Hence, by varying the exposure adjustment volume 821, the output voltage of the voltage follower 819 is varied, so that the − voltages at the − input terminals of comparators 802*a* and 802*b* are varied simultaneously. Therefore, by varying the exposure volume 821, the light output of the first laser diode 812*a* and the light output of the second laser diode 812*b* can be adjusted at the same time.

Figure 54:
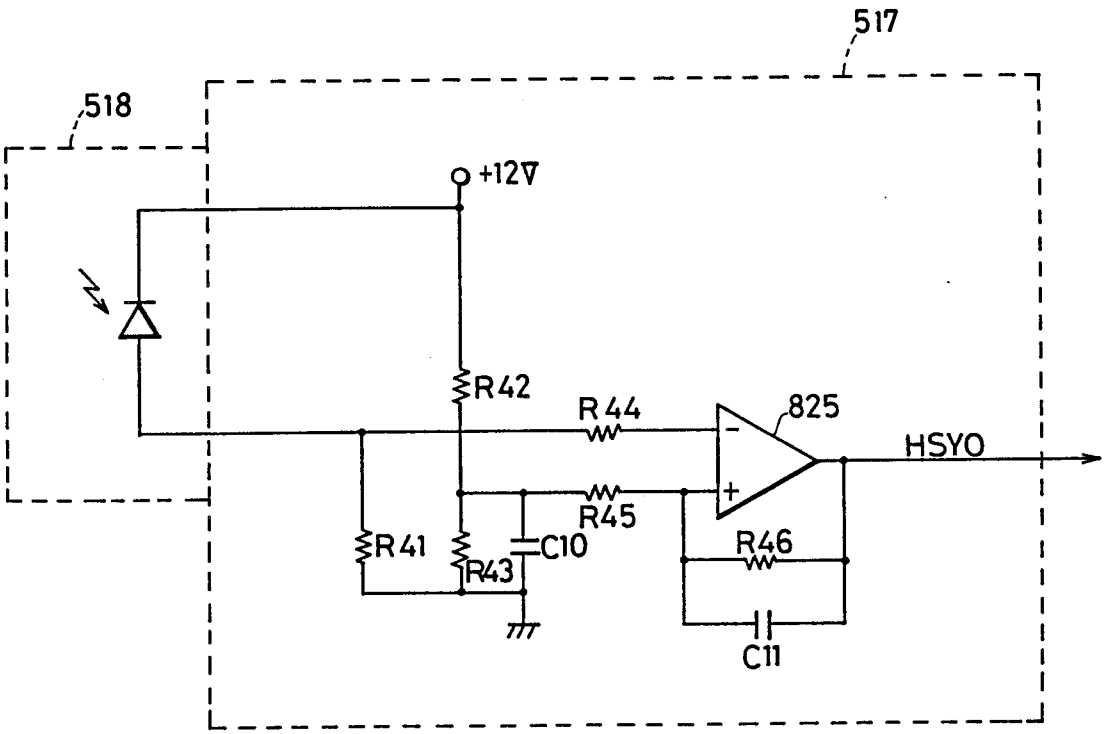
FIG. 54 is a circuit diagram which shows the details of the beam detector circuit and the beam detector.

FIG. 54 is a detailed circuit diagram for the beam detection circuit 517 and the beam detector 518 shown in FIG. 45. In FIG. 54, 518 is a beam detector for which use is made of a PIN diode with very fast response. The beam detector 518 serves also as a reference pulse in writing printing data in the photosensitive body 200 so that the generating position of the pulse has to be kept stable all the time.

The anode side of the beam detector 518 is connected to the − side input terminal of a high speed comparator 825 via load resistor R41 and a resistor R44. Further, to a resistor R43 there is connected in parallel a capacitor C10 for noise removal. In addition, R46 is a resistor for positive feedback to provide the hysteresis characteristic and C11 is a capacitor for feedback to improve the output waveform by producing a fast feedback.

Next, the operation of the beam detector 518 and the comparator 825 will be described. When a laser beam passes the beam detector 518 at high speed, there flows a pulsed current in the beam detector 518, generating a positive pulsed voltage at the − input terminal of the comparator 825. The pulsed voltage is compared with the voltage at the + input terminal, and a negative pulse HSYO is output from the comparator 825.

Figure 55:
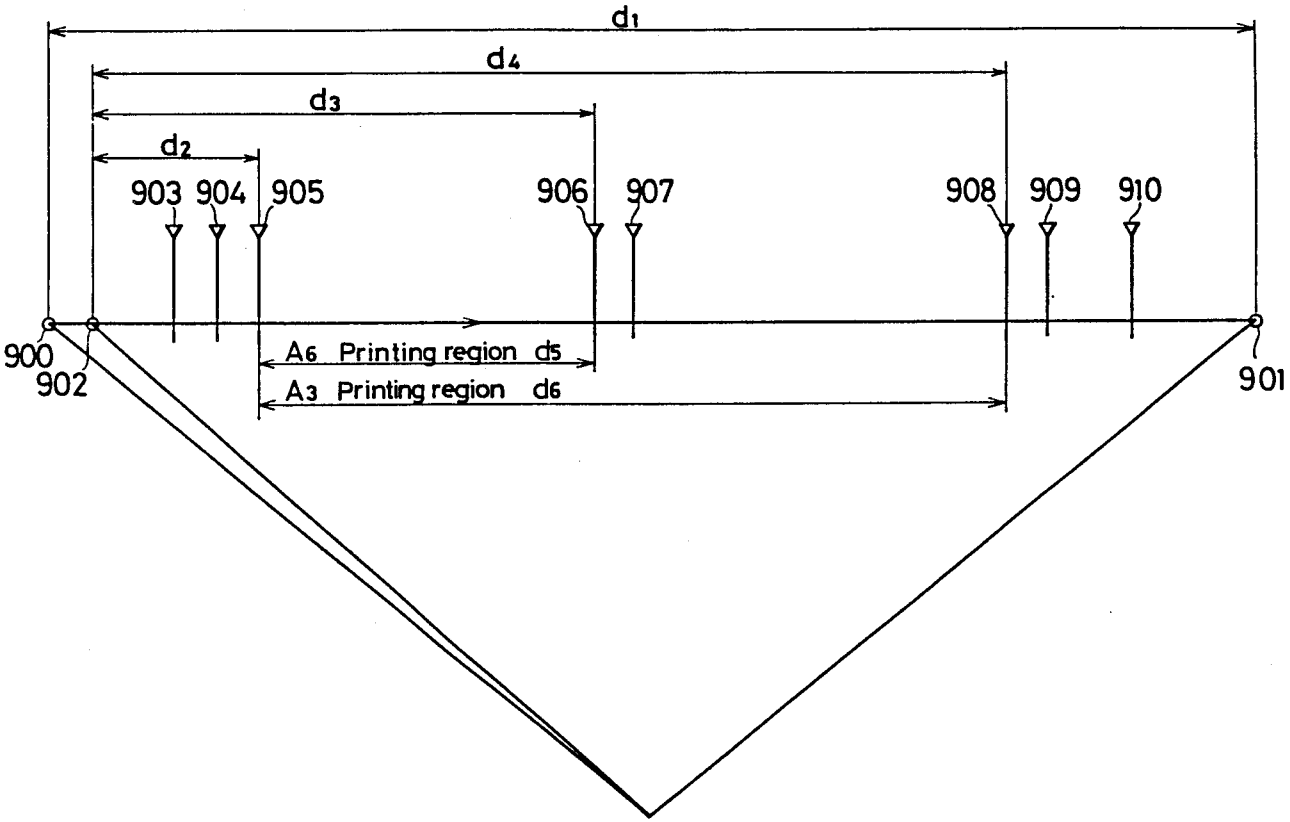
FIG. 55 is a diagram which shows the relationship between the range of one scanning of the laser beam and each of the positions of the beam detector position and the data writing position.

FIG. 55 is a diagram which shows the range of one scanning of taser beam on the photosensitive body 200, and the positional relationship between beam detection position, data write position, and so on within the range.

In FIG. 55, 900 is a beam scan starting point, and 901 is a beam scan end point, and a beam which arrived the beam scan end point 901 starts the next cycle of beam scan from the beam scan starting point 900 by the next surface of the polygonal mirror, with time zero. Reference numeral 902 is a beam detection starting point of the beam detector 518, 903 is the left side-surface of the photosensitive body, and 910 is its right side-surface. Reference numeral 904 is the left end surface of the paper, 909 is the right end surface of the paper size A3, and 907 is the right end surface of the paper size A6. Reference numeral 905 is the data write starting point, 908 is the data write end point of the paper size A3, and 906 is the data write end point of the paper size A6.

Reference symbol d2 is the distance from the beam detection starting point 902 to the write starting point, d3 is the distance from the beam detection starting point to the write end point for A6 size, and d4 is the corresponding distance for A3 size. Further, dl is the range of one scan of the beam.

Figure 56:
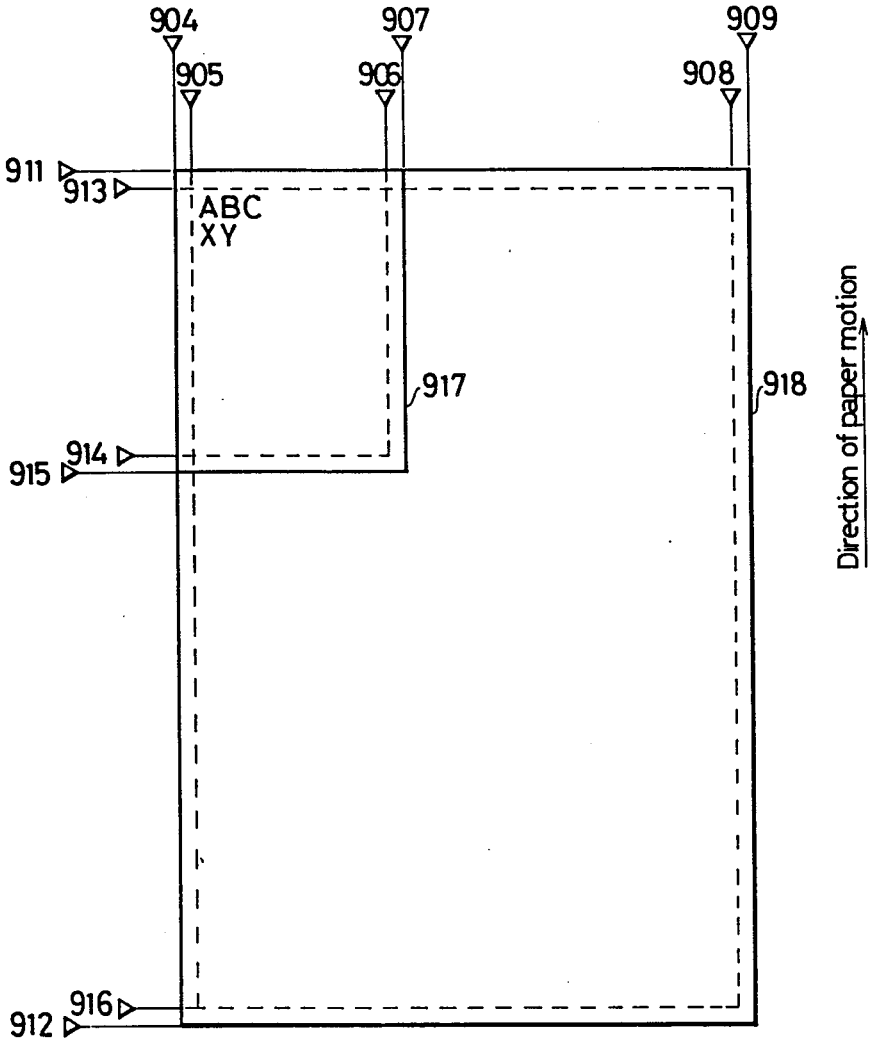
FIG. 56 is a diagram for showing the positional relationship of the data writing positions for the entire paper.

The distances d5 and d6 are effective printing ranges for sizes A6 and A3. As may be seen from the figure, the papers for the present printer is fed always with the left end surface as the reference so that the distance the beam detection starting point 902 to the print starting point 905 is the same for papers of all sizes. Therefore, data writing needs be started after elapse of time that corresponds to the distance between the point the beam detector detected the beam and the write starting point. FIG. 56 shows the entire sizes of papers and their printing areas, not only their horizontal dimensions as shown in FIG. 55.

In FIG. 56, 917 and 918 represent A6 paper and A3 paper, respectively. Reference numerals 904, 905, 906, 907, 908, and 909 are the same positions as shown in FIG. 55.

Reference numeral 911 is the front end of the paper, 913 is the data write starting point in the vertical direction of the paper, 912 is the rear end of an A3 size paper, and 916 is represents the data write end point for an A3 size paper. Reference numeral 915 is the rear end of an A6 size paper and 914 represents the data write end point for an A6 size paper.

Figure 57:
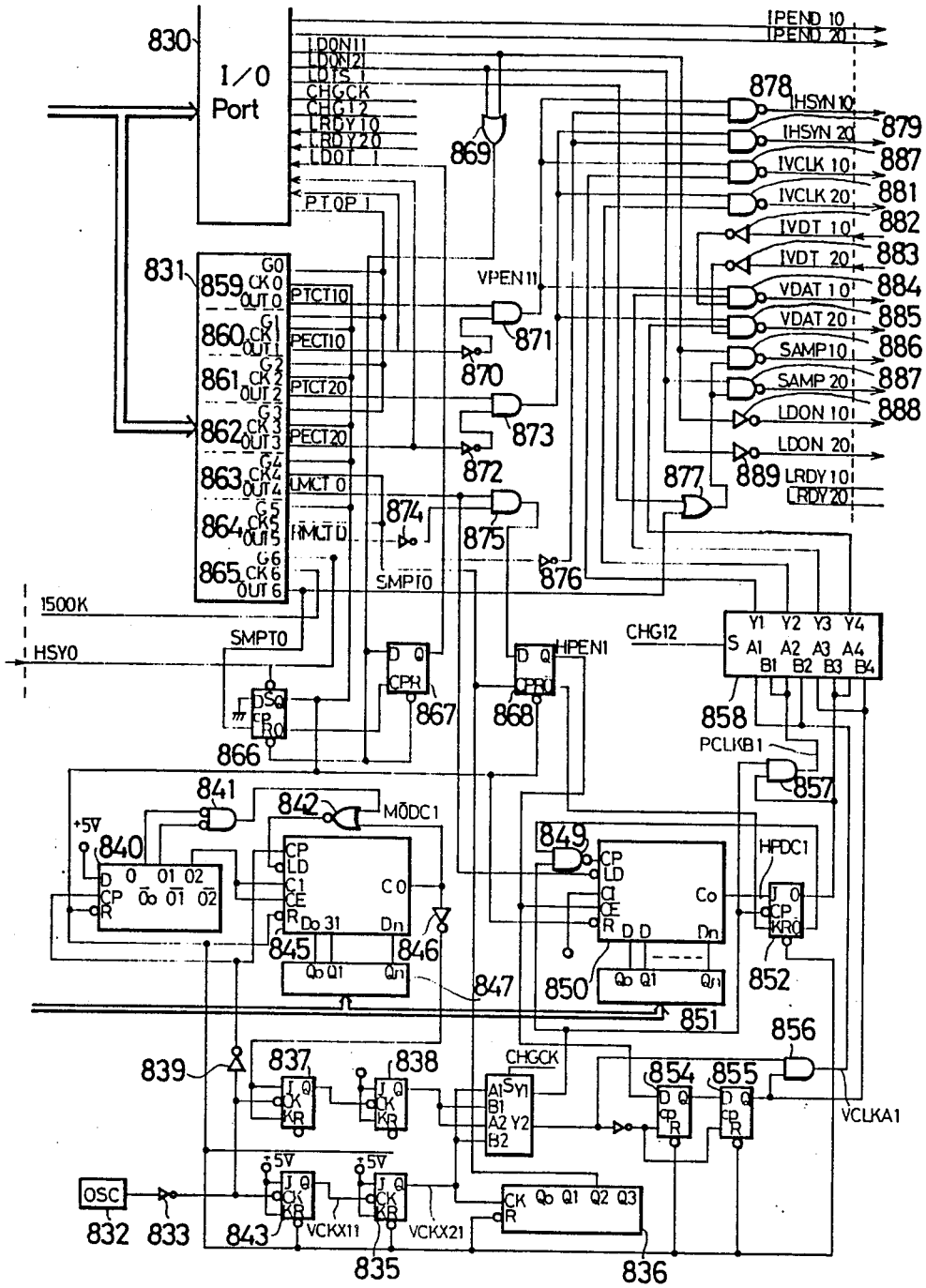
FIG. 57 is a circuit diagram which shows the details of the printing data writing circuit.

FIG. 57 is a detailed circuit diagram for the printing data write control circuit 513 in FIG. 45. The principal functions of the printing data write control circuit 513 includes to send two printing data to the laser modulation circuits 514 and 521 in order to write them in predetermined areas on the photosensitive body 200 in response to the size of the paper to be printed. In addition, it sends necessary signals to the laser light output stabilizing circuits of the laser modulation circuits 514 and 521. Further, it sends timing signals necessary for sending of printing data to the host system 500.

In FIG. 57, 830 is an I/O port which carries out sending and receipt of signals necessary for control of the laser modulation circuits 514 and 521 and the printing data write control circuit 513. Reference numeral 831 consists of counter/timer which carry out control of printing data write control, laser light output sampling, and so forth, and the setting of the operational mode and the setting of the pre-set values for the counter/timer can be done programmably in the CPU 501.

Reference numeral 865 is a laser light output sampling timer, and to its gate input G6 there is input a beam detection signal HSYO which is the output of a beam detection circuit 517. The timer is started when the beam detection signal HSYO is shifted from LOW level to HIGH level, and the completion of the timer operation is arranged to coincide with the completion of the operation of the beam detector 518 to be ready to the next detection operation.

Consequently, every time when a beam detection signal HSYO is input to the input G6, the timer 865 is activated. To the clock input CK6 of the timer 865, there is input a clock of 1500 kHz. The output SMPTO of the timer 865 is input to one input of a 2 OR gate 877 whose output is sent via two 2 NAND gates 886 and 887 to the first laser modulation circuit 514 and the second laser modulation circuit 517 as first sample signal SAMP10 and second sample signal SAMP20, respectively. The other input of the 2 NAND gate 886 receives the first laser diode enable signal LDON21 which is output from the I/O port 830 so that it is possible to forbid independently the first sample signal SAMP10 and the second sample signal SAMP20. Further, to the other input of the 2 0R gate 877, there is input the laser test signal LDTSl output from the I/O port 830, and it is possible to set the first semiconductor laser 515 and the second semiconductor laser 516 in the forced emission state. To the I/O port 830 there are input the first laser ready signal LRDY10 and the second laser ready signal LRDY20 so that by judging the forced emission state of each of the first and the second ready signal it is possible to confirm whether or not each laser is emitting.

Reference numeral 866 is a D-type F/F which generates a line start signal LSTl, and it is set by a beam detection signal HSYO and is reset by the rising of a sample timer output SMPTO. Reference numeral 867 is a D-type F/F which generates a beam detection ready signal LDOTl is input to the I/O port 830. The D-type F/F's 866 and 867 can also be reset by the output of the 2 OR gate 869. The inputs to the 2 0R gate 869 are the first and the second laser diode enable signals.

Reference numeral 832 is a crystal oscillator with oscillation frequency of about 1 Hz which generates reference clocks for image clock pulses. Reference numerals 834 and 835 are J-F/F which form quartervary counter and generate a first video clock VCKX21 (about 8 MHz) that corresponds to the minimum modulation unit, one dot, of the laser beam, by dividing the output of the crystal oscillator 832 into four.

Reference numerals 837 and 838 are J-F/F similar to 834 and 835, and forms a quarternary counte. To the J-K input of the J-K F/F 837 there is input the carry out CO of an n-bit binary counter 845 via an inverter 846. The Q outputs of the J-K F/F 834, 835, 837, and 838 carry out toggle operation synchronized with the clock input CK when the J-K inputs are on HIGH level, and discontinue the toggle operation when the J-K inputs are on LOW level. As a result, the second video clock signal VCKY21 which is the output of the last stage J-K F/F 838 becomes, when the pulse separation in the ordinary operation is called "1", during the time of generation of carry out signal CO of the n-bit binary counter 845, "11/4", prolonged by a quarter clock. The preset inputs $D_0$ to $D_n$ are connected to the outputs $Q_0$ to $Q_n$ of the n-bit latch 847, and their set values can be given values that correspond to DIP-OW or the like of the CPU 501. These set values are for setting the carry out numbers of the n-bit binary counter 845 during one line (that is, during the time when LST1 is on HIGH level), and eventually set the clock generation number of "11/4". An inverter 839, a shift register 840, 2 NOR gates 841 and 842 are circuits for giving a predetermined operation to the n-bit binary counter 845.

The second video clock signal VCKY21 is used for correcting the difference between the scan length 1 and 2 of the two laser beams shown in FIG. 39 (B). For that purpose, one needs only to designate the first video clock signal VCKX21 to the longer scan length 1 of the laser beam and the second video clock signal VCKY21 to the shorter laser beam 2. Reference numeral 848 is a selector to carry out the designation with the output CHGCK of the I/O port 830.

Next, the correction method will be described by making reference to an example. For instance, if the laser beam with longer scan length is 200 mm and the laser length 2 with shorter scan length is 199 mm, the difference in the scan length is 1 mm. If the resolving power is 12 lines per 1 mm, 12 sot clocks of the video clock signal VCKY 21 for laser beam 2 with shorter scan length need be prolonged per 2,400 dot clocks ($200\times12$). In this case, correction of $\frac{1}{4}$ dot clock has to be carried out for a number of $12\times4=48$ times for 2,400 dots since $\frac{1}{4}$ dot clock is prolonged in one correction.

Accordingly, in the n-bit binary counter 845 for which the clock input CP is $\frac{1}{4}$ dot clock, 48 carry outs need be output during clock counts of 9,600 (namely, $2{,}400\times4$). In other words, it needs be preset so as to generate one carry for every 200 counts.

Reference numeral 836 is a binary counter whose Q2 output HCT31 outputs an 8-dot clock (about 1 MHz) which is obtained by dividing the first video clock VCKX21 into eight parts. Reference numeral 863 is a left margin counter which sets the data write starting point based on the beam scan starting point. Reference numeral 864 is a right margin counter which sets the data write end point based on the beam scan starting point. To the gate input G4 of the left margin counter 863 and the gate input G5 of the right margin counter 864 there is input the line start signal LST1, and to the clock input CK4 of the left margin counter 863 and the clock input CK5 of the right margin counter 864 there is input the 8-dot clock HCT31. Both counter with a single counter for each can give corrections for the variations in the data write starting point and the data write end point due to mechanical errors in attaching the beam detector 518, simultaneously for the two laser beams. The reason for giving corrections to the errors are that both deviations in the 8-dot clock unit position and the data write end position remain in the tolerable range provided that the setting for both counter is changed in response to DIP-SW or the like, and that adjustment of the errors beyond the above value can be carried out easily. The set value for the right margin counter is varied for different size of the paper.

Reference numeral 875 is a 2 AND gate to whose one input receives the output LMCTO of the left margin counter 863 and the other input receives the output RMCTO of the right margin counter 864 via an inverter 874, so that the output of the 2 AND gate 875 represents the horizontal printing region.

The output of the 2 AND gate 875 is shifted for 4 dot portion by a shift register 868 whose Q output provides a horizontal printing region signal HPEN 1.

The horizontal printing region signal HPEN 1 is input to the CE input of an n-bit binary counter 850 and to the shift register 854. The n-bit binary counter 850, a 2 NAND gate 849, an n-bit latch, and a J-K F/F 852 has a configuration which can shift the data write starting point by one dot unit, and the output of the J-K F/F 852 outputs a horizontal printing region signal HPENB 1. The preset inputs Do to Dn of the n-bit binary counter 850 that are connected to the outputs of the n-bit latch 851, sets the number of shifts to the right, and the set value can be set by CPU 501 to values in response to DIP-SW or the like. The shift registers 854 and 855, inverter 853 form a circuit which shifts the horizontal printing region signal HPEN 1 by 2 dot clocks to the right, and the output of the shift register 855 outputs a second horizontal region signal HPENA 1. This is arranged in this manner because the first horizontal printing region signal HPENB 1 is shifted to the right by 2 dot clocks even for a minimum setting value.

The output of an AND gate 857 is a first video clock signal VCLKB which shows the video clock signal for the first horizontal region. One of the inputs to the AND gate 857 is the first horizontal region signal HPENB 1, and the other input is the Y1 output of the selector 848. Further, the output of an AND gate 856 is the second video clock signal VCLKA 1 that shows the video clock signal for the portion of the second printing region, and one of the inputs to the AND gate 856 is the second horizontal printing region signal HPENA 1 and the other is the Y2 output of the selector 848.

As described in the above, a signal that can adjust the data write starting point in the unit of 1 dot, the first horizontal region signal HPENB 1, and the first video clock signal VCLKB 1 are used for correcting the error in the scan starting point of two laser beams as shown in FIG. 39(A). In this case, the error may be adjusted by designating the second horizontal printing region signal HPENA 1 and the second video clock signal VCLKA 1 to a laser beam S2 whose scan starting point comes earlier and by designating the first horizontal printing region signal HPENB 1 and the first video clock signal VCLKB 1 for a laser beam S1 whose scan starting point comes later.

A selector 858 is the selector for carrying out the above designation which is carried out by the output CHG 12 of the I/O port 830.

Reference numerals 859 to 862 are counters for setting the data write starting point and the data write end point for the vertical direction (direction of motion of the paper), where 859 is a first page top counter for setting the data write starting point for the first color, 860 is a first page end counter for setting data write end point for the first color, 861 is a second page top counter for setting data write starting power for the second color, and 862 is a second page end counter for setting data write end point for the second color.

The gate inputs Go to G3 for the counters 859 to 862 are connected to a page top signal PTOP 1 which is an output of the I/O port and is activated by VSYNC command.

The clock inputs CK0 to CK3 of the counters 859 to 862 are connected to the line start signal LST 1, and as a result, it becomes possible to count with one line of scan as the unit (one dot as the unit). The method of setting each counter will be described later.

Reference numeral 871 is a 2 AND gate whose one input is the output PTCT 10 of the first page top counter 859 and the other input is the output PECT 10 of the first page end counter 860 via an inverter 870. Accordingly, the output of the 2 AND gate 871 becomes a vertical printing region signal VPEN 11 for the first color.

Reference numeral 873 is a 2 AND gate whose one input the output PTCT 20 of the second page top counter 861 and the other input is the output PECT 20 of the second page end counter which is input via an inverter 872. Accordingly, the output of the 2 AND gate 873 represents a vertical printing region signal VPEN 21 for the second color.

The output PECT 10 of first page end counter and the output PECT 20 of the second page end counter are input to the 1/0 port 830, and after the completion of each counting operation send a first page end signal IPEND 10 and a second page end signal IPEND 20 to the host system 500.

Reference numerals 878 and 879 are 2 NND gates that send a horizontal synchronized signal IHSYN 10 for the first color and a horizontal synchronized signal IHSYN 20 for the second color, respectively, to the host system 500.

Reference numerals 887 and 881 are 2 NAND gates that send a video clock signal IVCLK 10 for the first color and a video clock signal IVCLK 20 for the second color, respectively, to the host system 500.

Reference numeral 884 is a 3 NAND gate which sends a video data signal IVDT 10 for the first color from the host system 500 to the first laser modulation circuit 514 as a first video data signal VDAT 10.

Reference numeral 885 is a 3 NAND gate which sends a video data signal IVDT 20 for the second color from the host system 500, to the second laser modulation circuit 521 as a second video data signal VDAT 20.

Reference numeral 888 is an inverter which sends a first laser diode enable signal LDON 10 to the first laser modulation, and 889 is an inverter which sends a second laser diode enable signal LDON 20 to the second laser modulation circuit 521.

Figure 58:
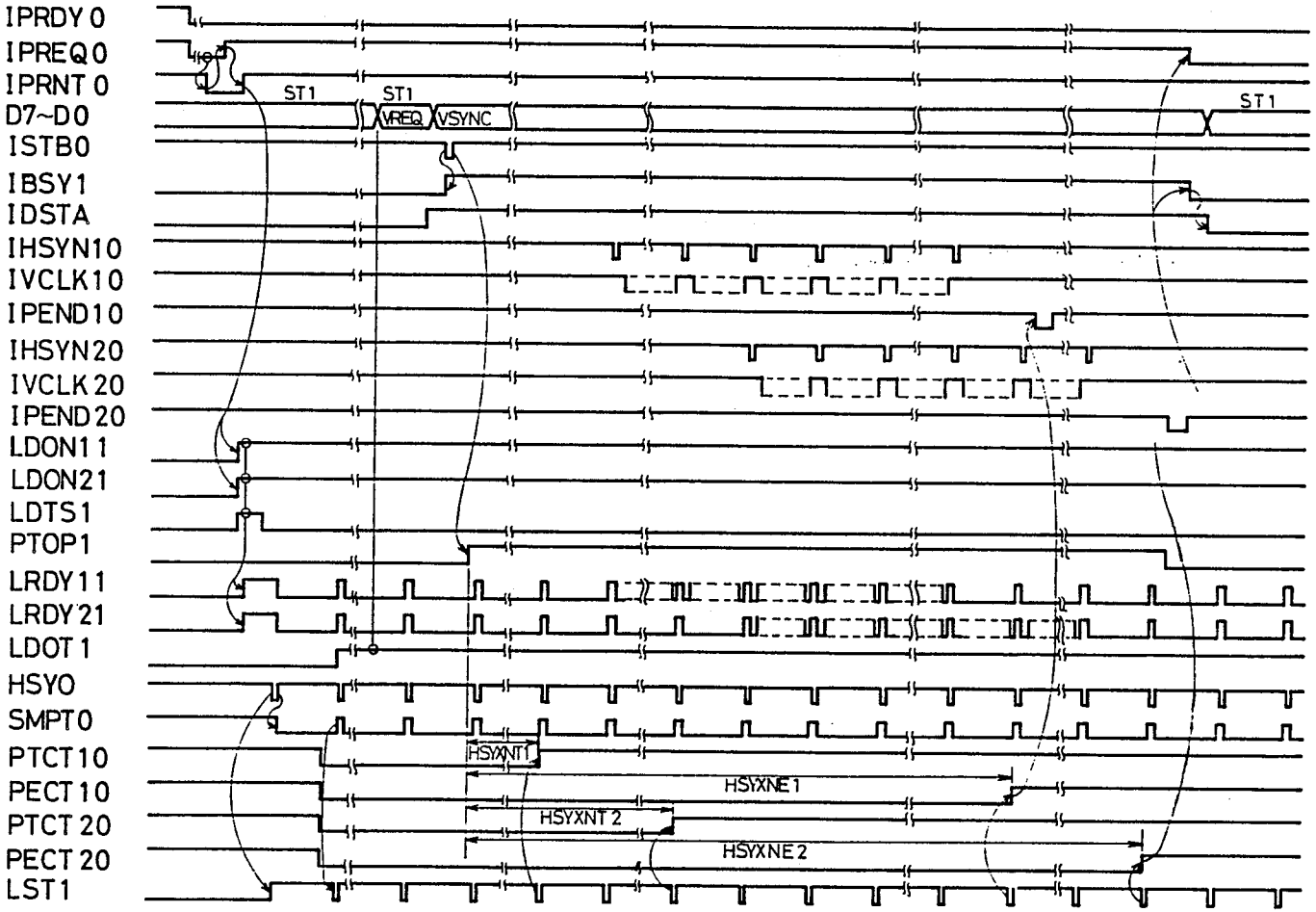
FIG. 58 is a timing chart for the printing data writing control signal in the dichromatic printing mode.
Figure 59:
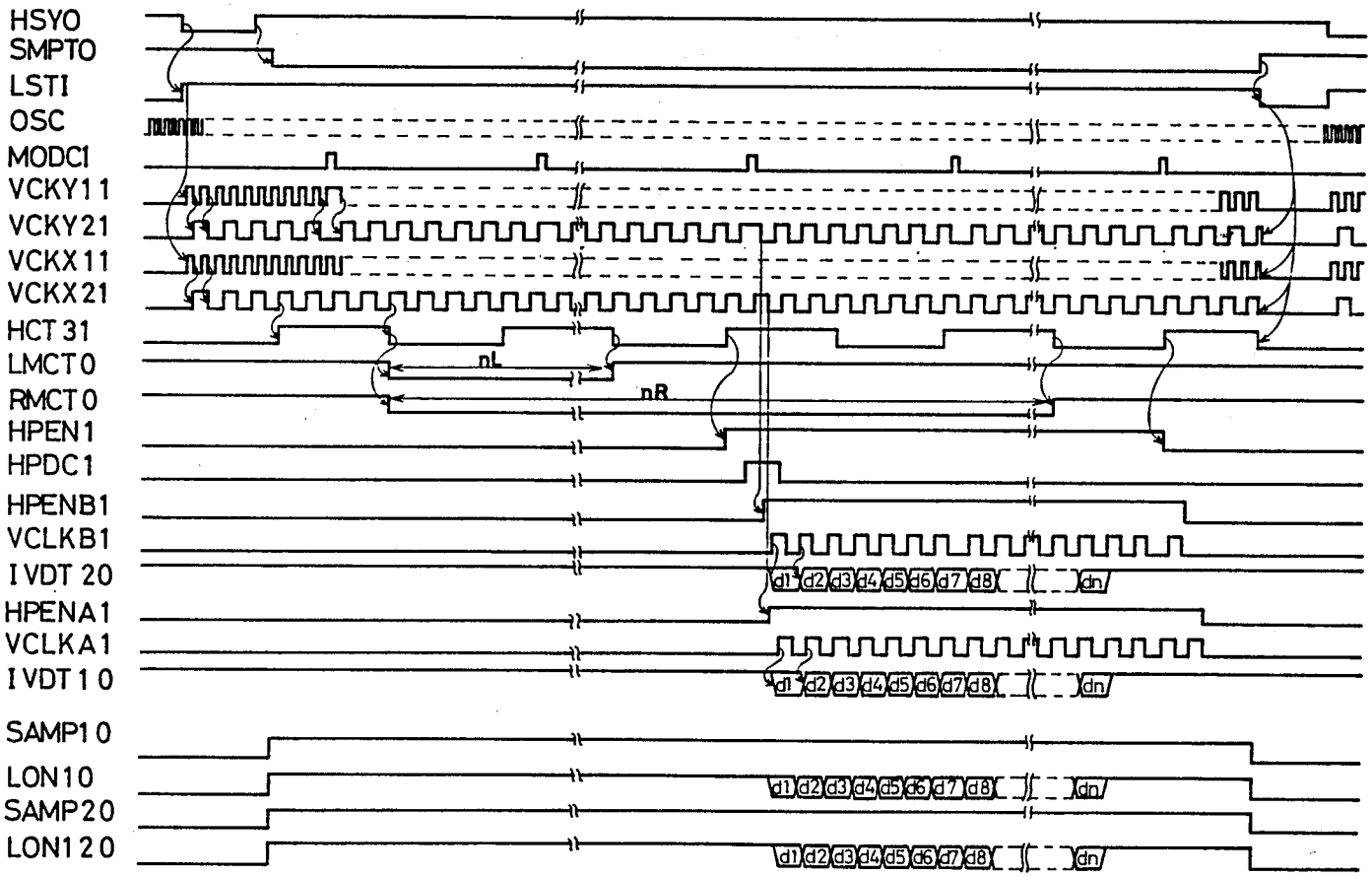
FIG. 59 is a timing chart for one line portion of the data writing control signal.
Figure 60:
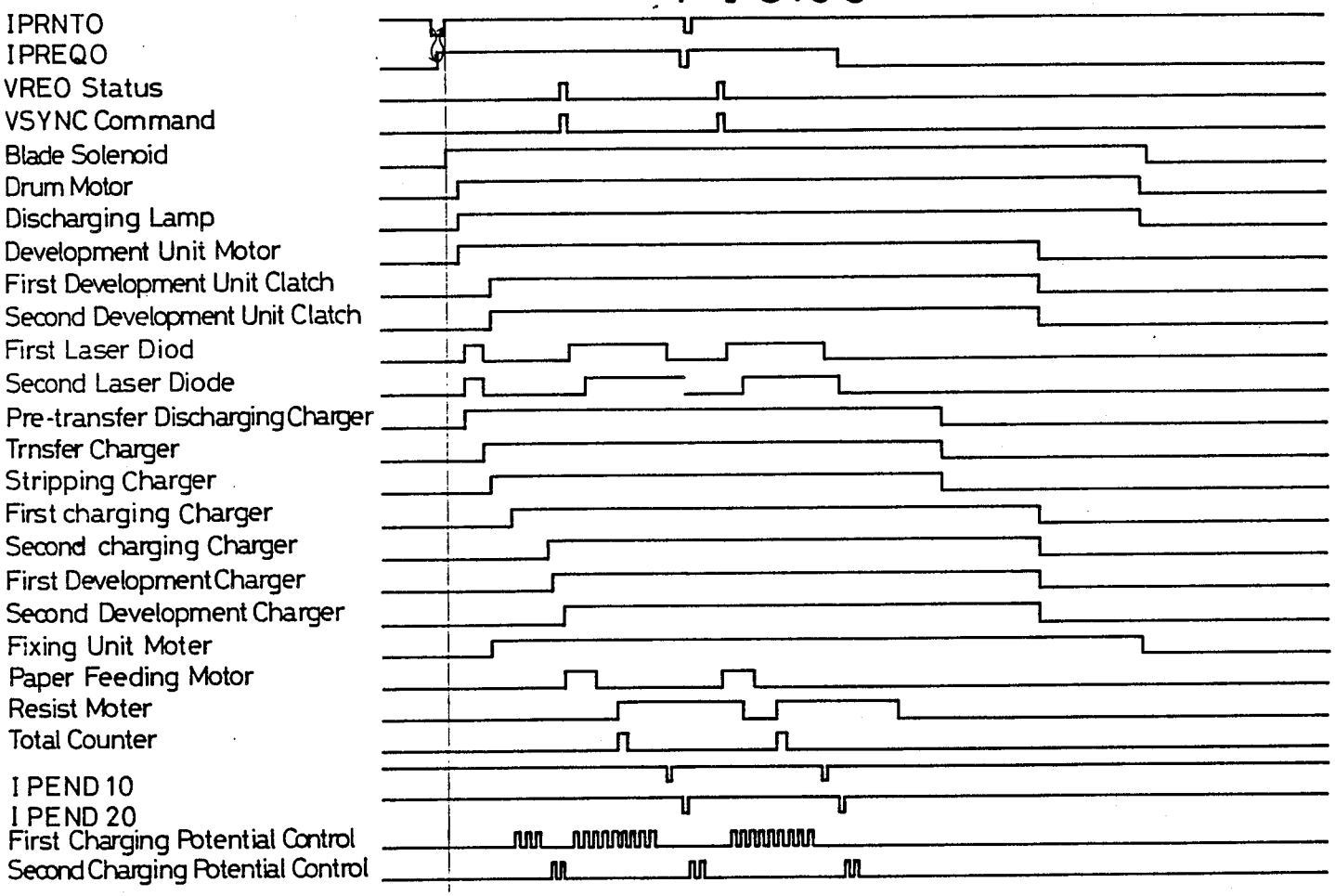
FIG. 60 is a timing chart for the process control signal in the dichromatic printing mode.
Figure 61:
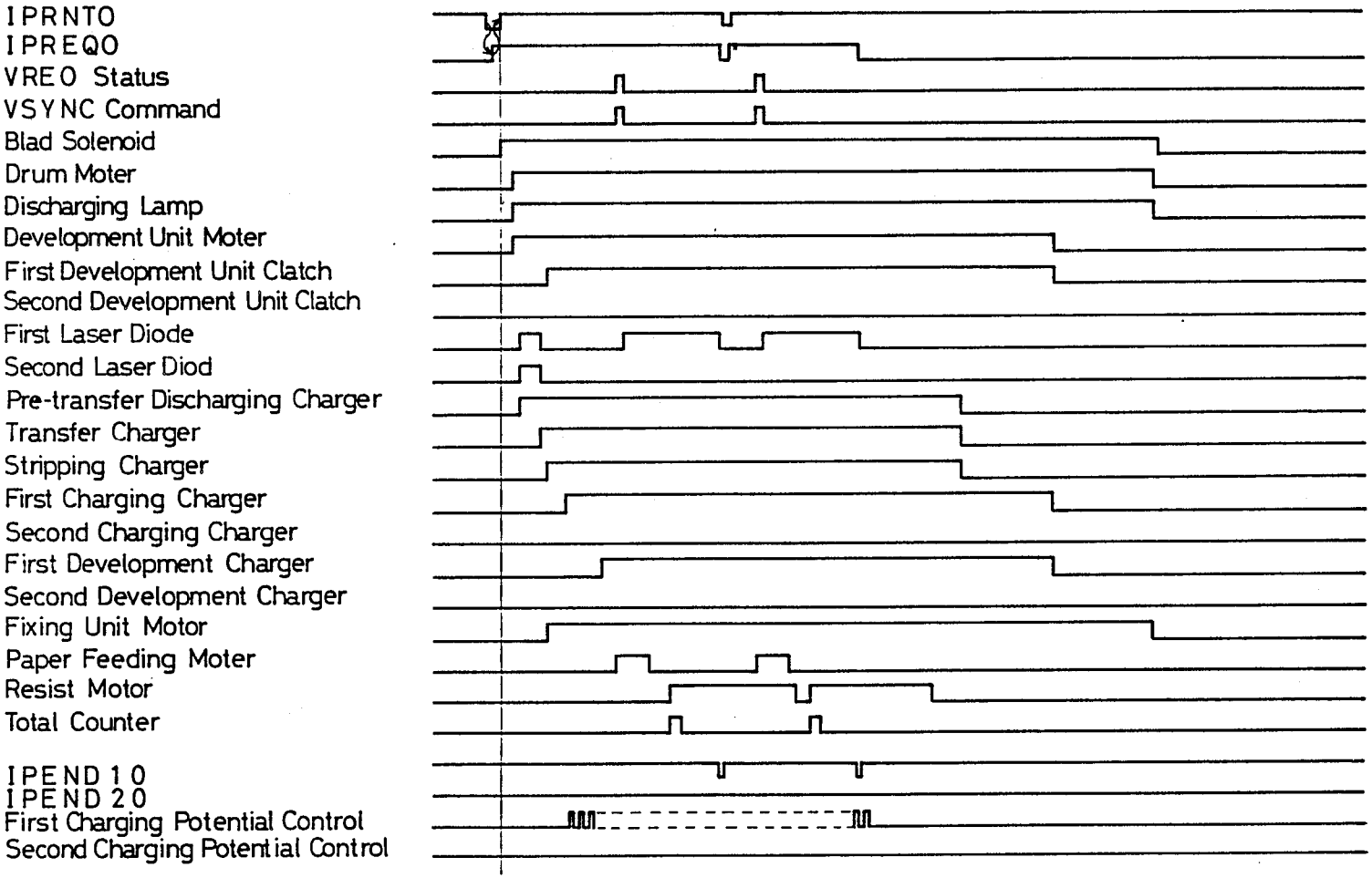
FIG. 61 is a timing chart for the process control signal in a first color printing mode.
Figure 62:
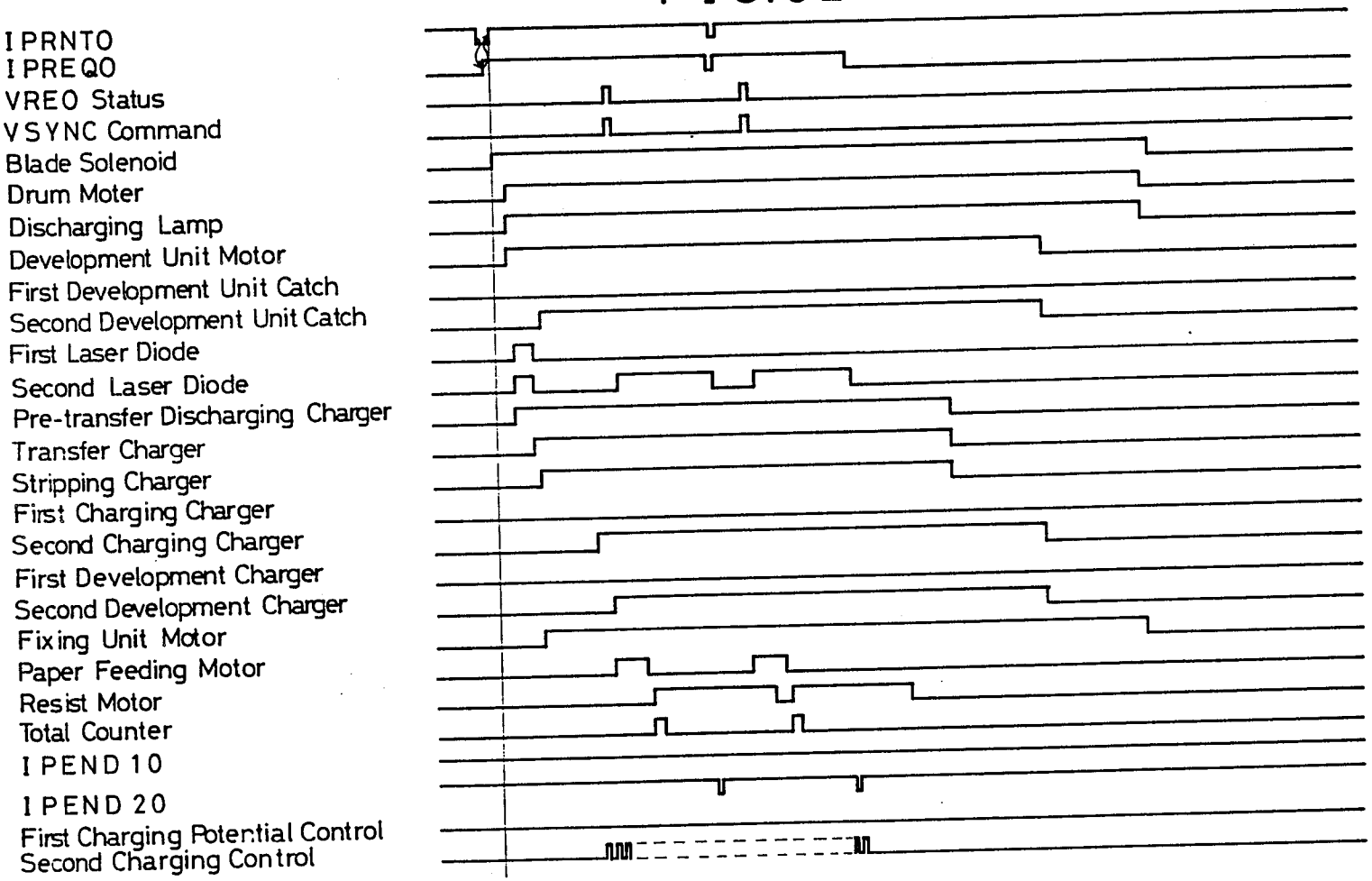
FIG. 62 is a timing chart for the process control signal in a second color printing mode.

A timing chart for the principal signals for a portion of one page and for one line in the dichromatic printing mode are shown in FIG. 58 and FIG. 59, respectively.

Next, the operation of each component which is activated in response to control command issued from the control section of the dichromatic LBP 199 will be described in detail by making reference to the flow charts shown in FIG. 63 to FIG. 72.

FIG. 63 to FIG. 67 are flow charts that illustrate the overall operation of the dichromatic LBP.

Figure 63A:
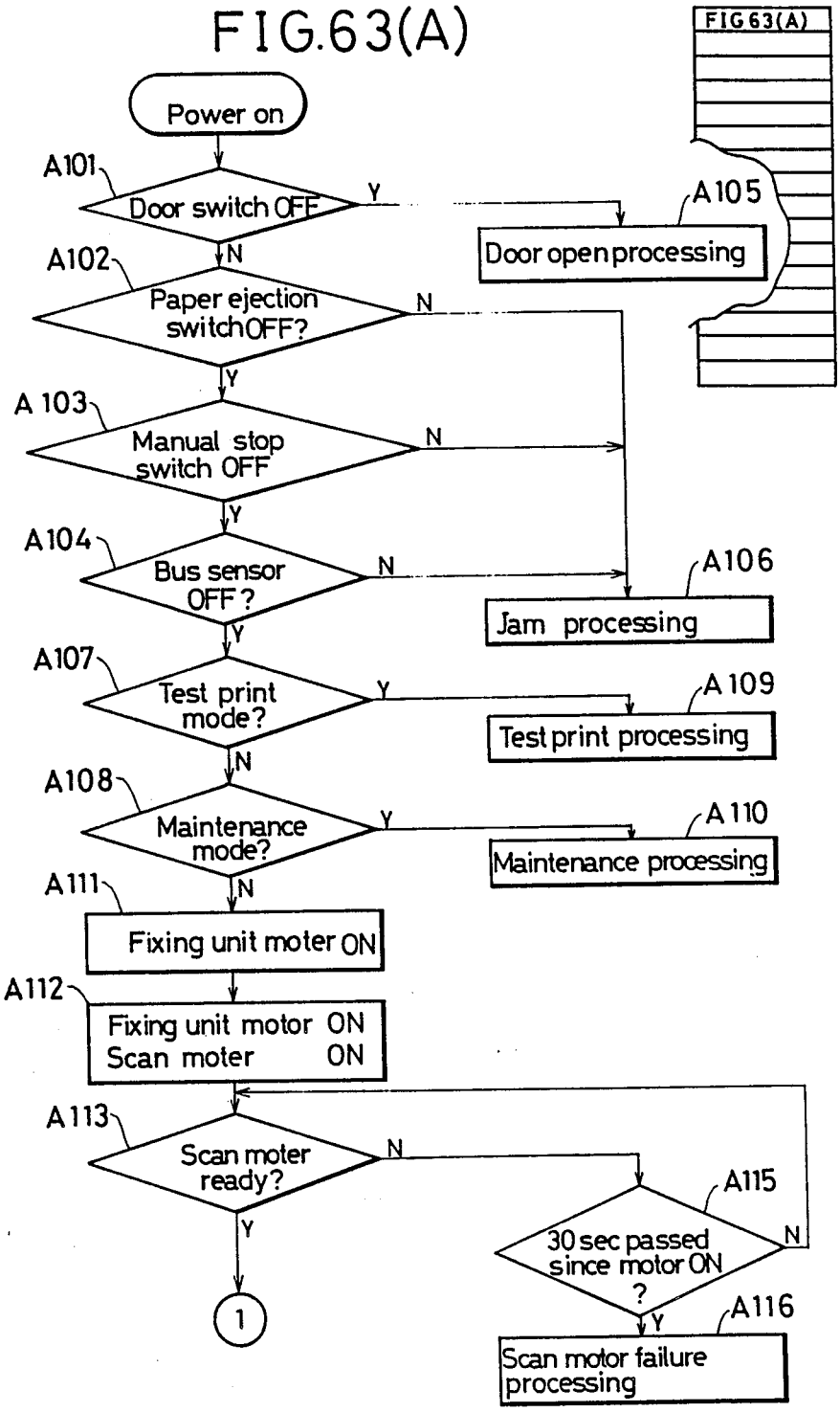
FIGS. 63A to 67B are flow charts for showing the overall operation of the dichromatic LBP.
Figure 63C:
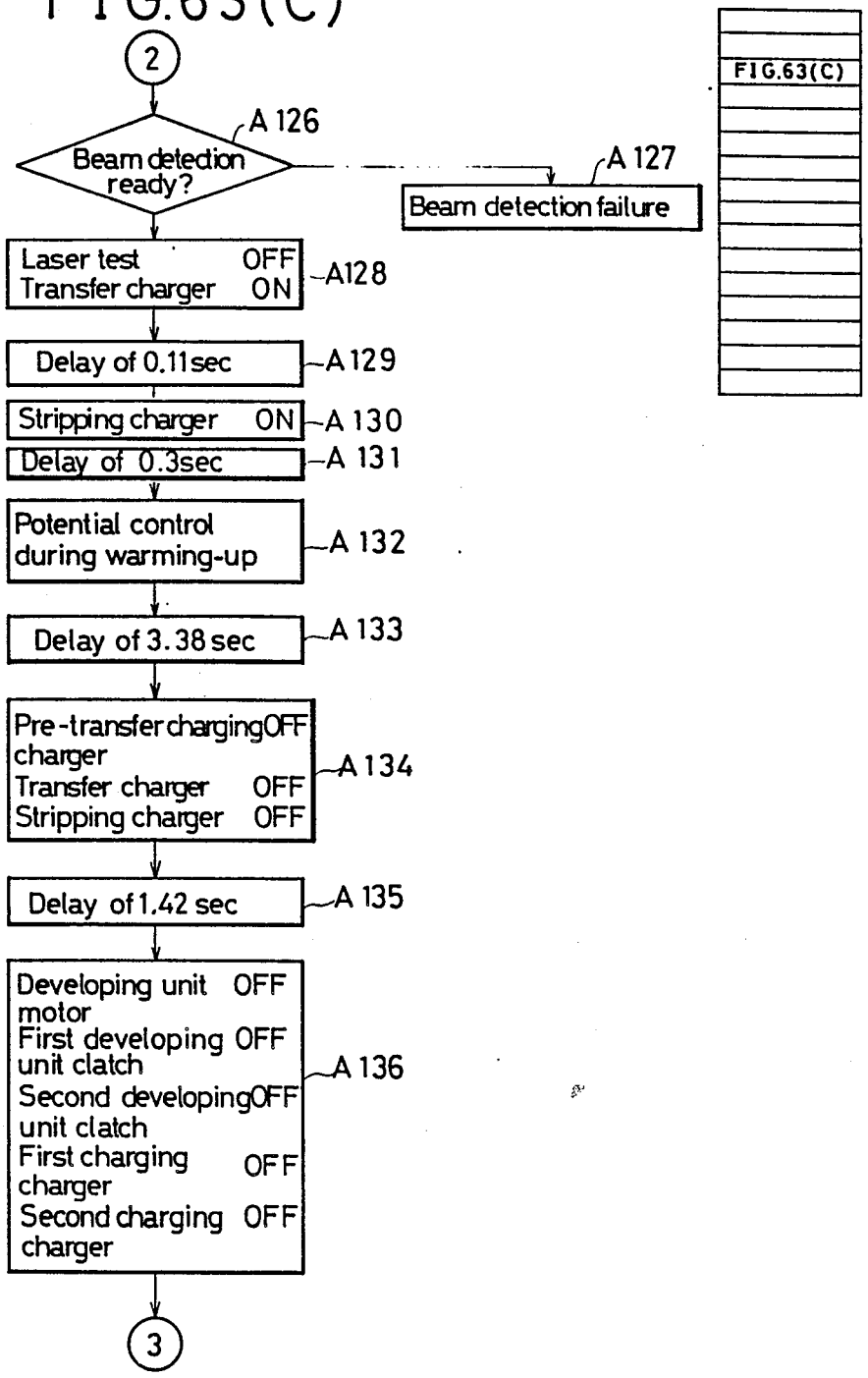

In FIG. 63 are shown a self-diagnosis and warm-up processings for the dichromatic LBP.

In FIG. 63, when the operator closes a power supply 520, the system program housed in the ROM 502 is started, first the self-diagnostic processing of steps A101 to A104 are executed, and when the door switch is ON (negation of step A101), it goes to door opening processing (step A105), and becomes jam processing (step A106) through paper ejection switch ON, manual stop switch ON, and bus sensor ON.

Then, if it is not in the test print mode nor in the maintenance mode (negation of step A107 and negation of step A108), the heater lamp, which heats the fixing unit 221 that takes a relatively long time before the apparatus becomes ready, is turned on (step A111) to start warm-up processing. Next, the motor and the scan motor 512 of the fixing unit 221 is turned on (step A112). Here, if it is in the test print mode (affirmation of step A107), the test print processing is given (step A109), and if it is further in the maintenance mode, the maintenance processing is carried out (step A110).

When the scan motor 512 becomes in the ready state by being turned on (affirmation of step A113), the blade solenoid is turned on (step A114). Further, if the scan motor 512 does not become ready state even after 30 seconds from the turning-on of the motor (negation of step A113 and affirmation of step A115), the failure processing of the scan motor 512 is executed (step A116).

After a subsequent delay processing (step A117), each of the drum motor of the photosensitive body 200, the motor 425 for the developing units, the clatch for the first driving unit 203, the clatch for the second developing unit 206, and the lamp of the discharger 211 is turned on (step A118), and after a delay processing (step A119), each of the first laser unit 321, the second laser unit 322, the laser test device, the pre-transfer charger 208 is turned on (step A120).

After an ensuing delay processing (step A121), failure is checked of the first laser unit 321 and the second laser unit 322 by the use of the monitors (steps A122 and A123), and if they are found to be normal (affirmation of step A122 and affirmation of step A123), it is checked with the horizontal synchronized signals HSYNC whether their beam detection is ready or not (step A126). Further, if the first laser unit 321 has a failure (negation of step A122), a failure processing for the first laser (step A124) is carried out, and if the second laser unit 322 is in failure negation of (step A123), a failure processing for the second laser (step A125) is carried out. In addition, if beam is not detected with a horizontal synchronized signal HSYNC (negation of step A126), there is carried out a beam detection failure processing (step A127).

Figure 70A:
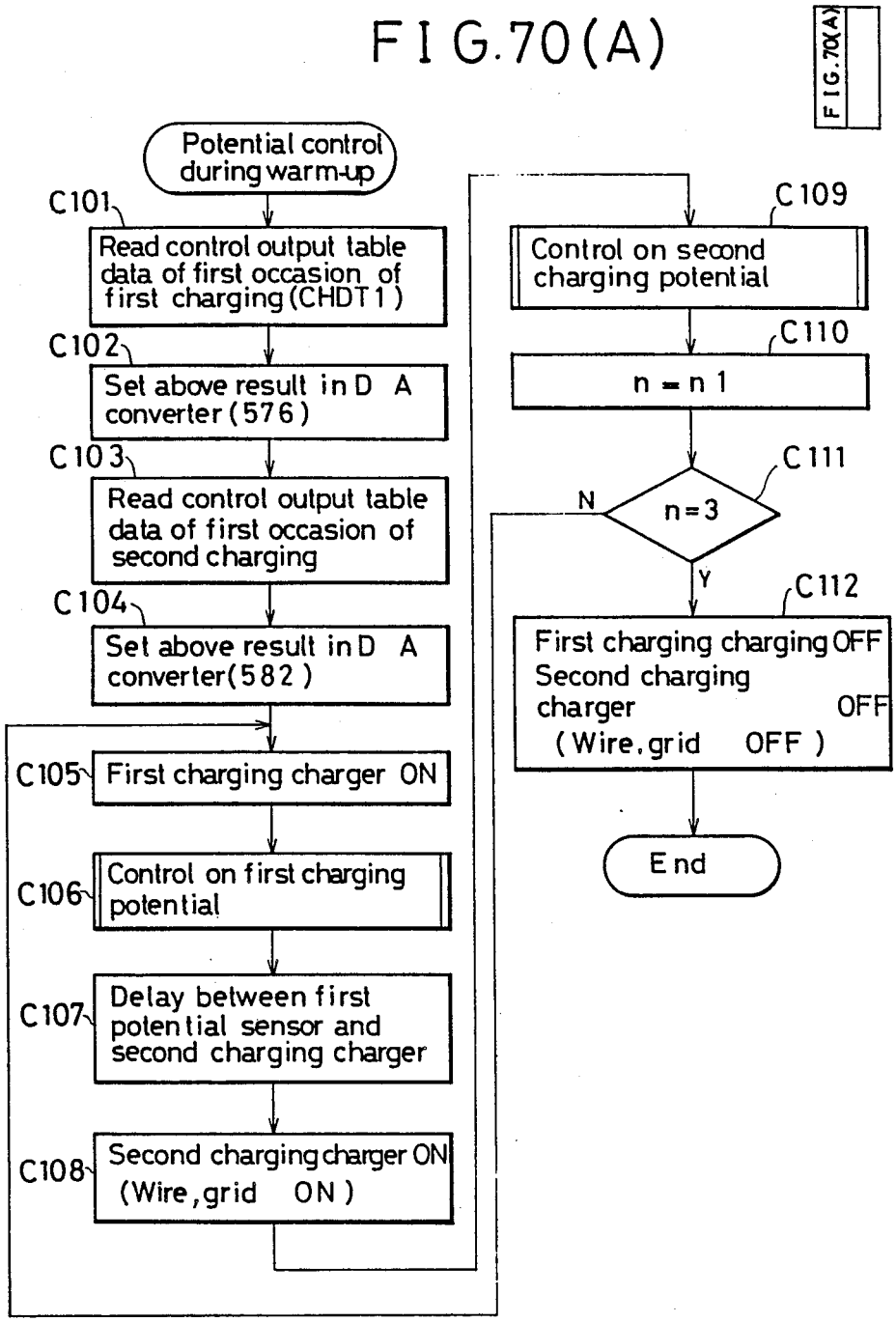
FIGS. 70A and 70B are a flow chart showing the subroutine for the potential control during the warming-up and the potential control prior to the first printing.
Figure 70B:
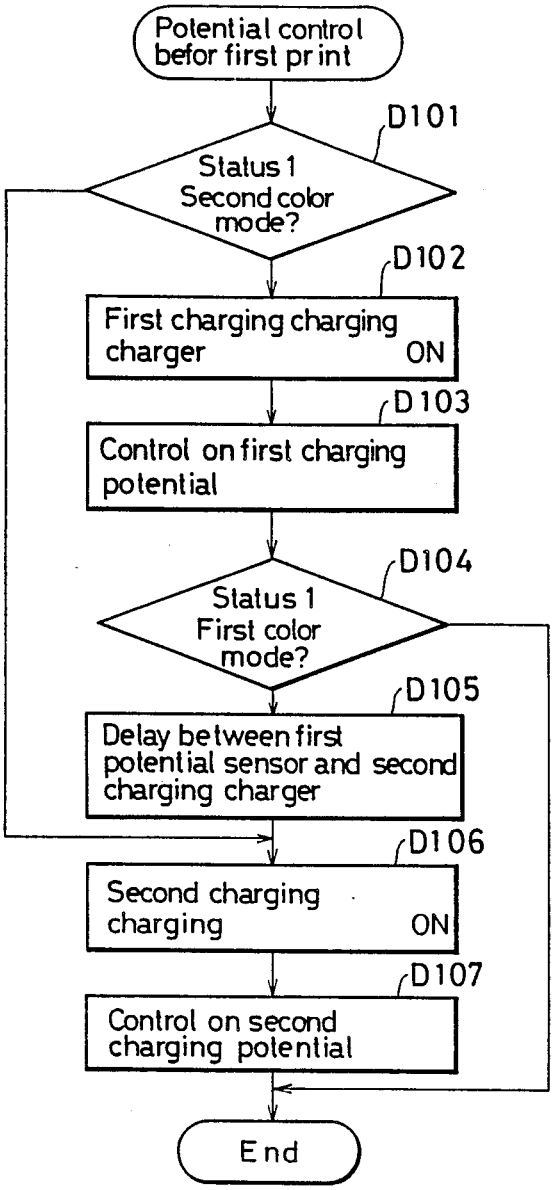
Figure 71A:
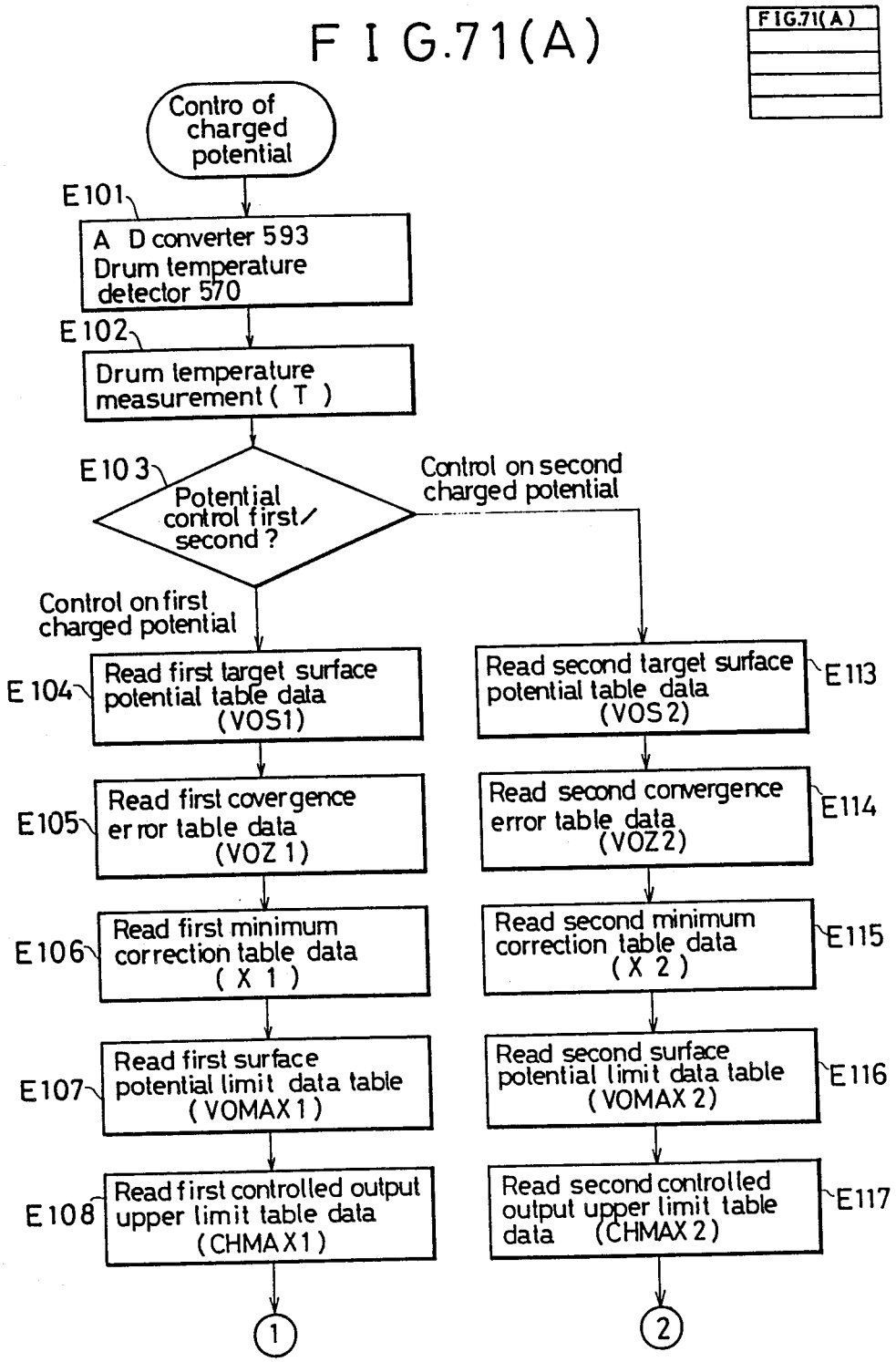
FIGS. 71A to 72 are flow charts showing the subroutine for the charged potential control.
Figure 71B:
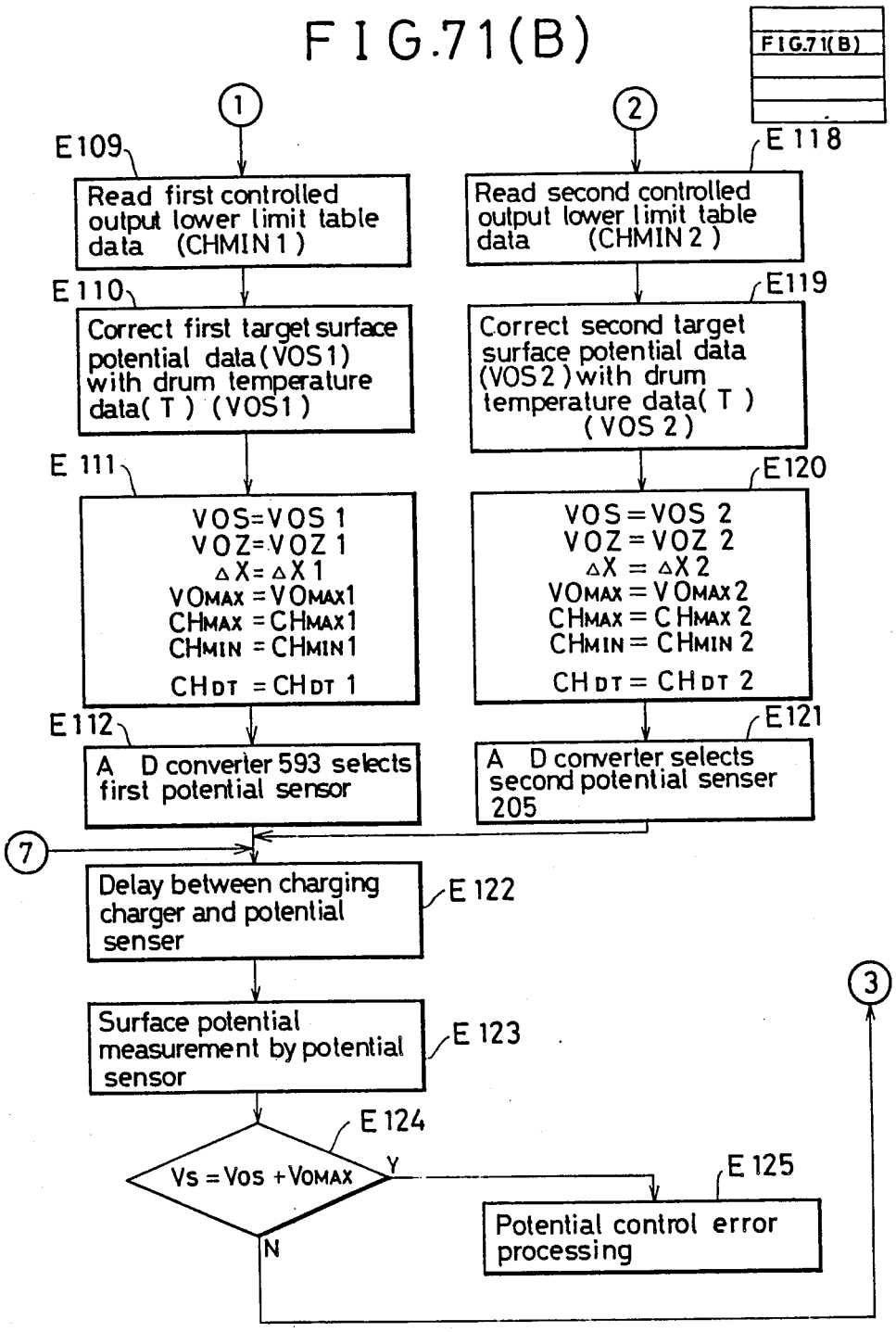
Figure 71C:
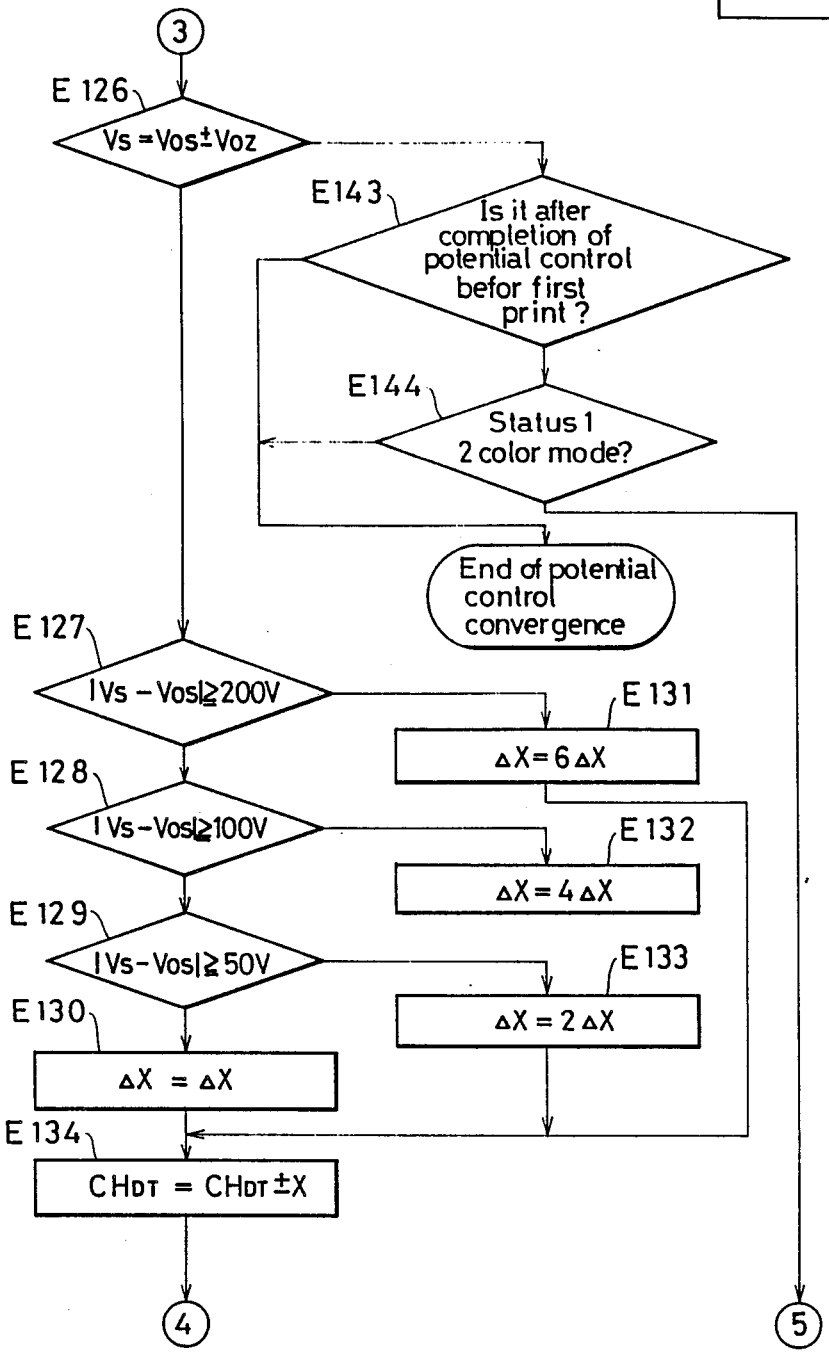
Figure 71D:
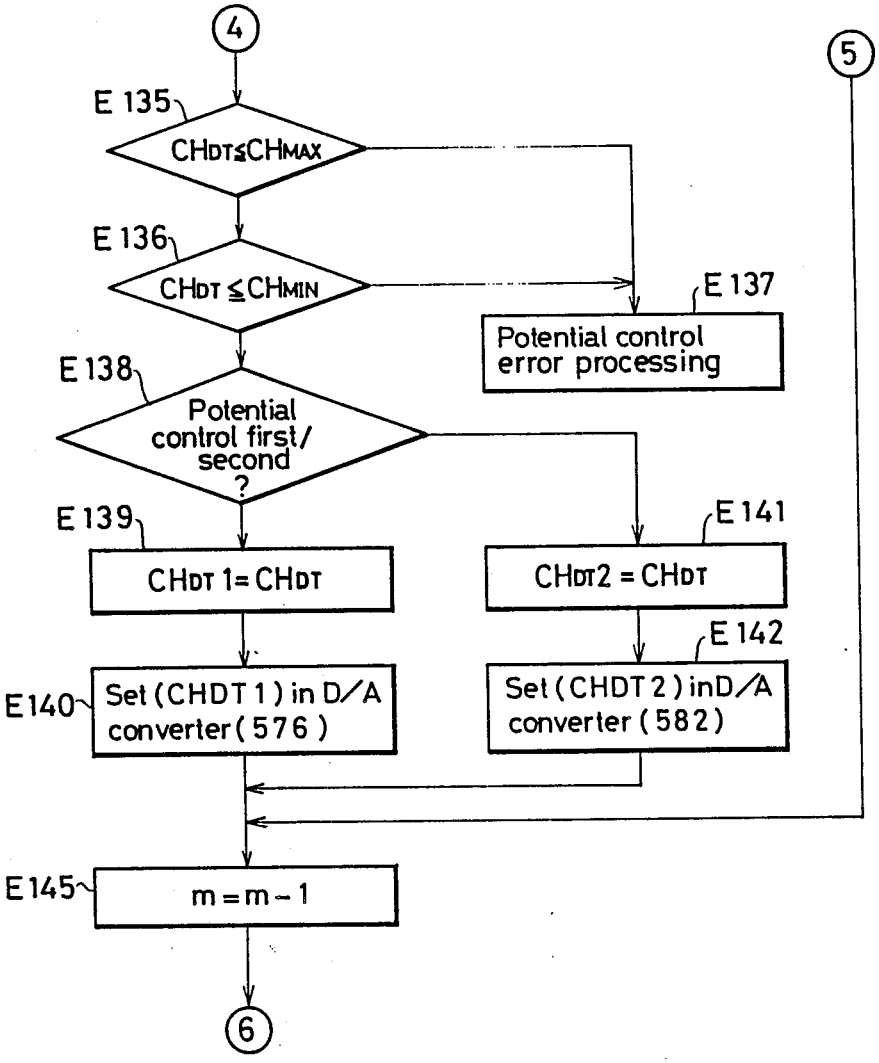

After an ensuing delay processing (step A129), the stripping charger 209 is turned on (step A130), a potential control during warm-up such as shown in FIG. 70, via a delay processing (step A131) is carried out (step A132). Here, step A132 is a processing for preparing the apparatus as soon as possible for the first printing.

After an ensuing delay processing (step A133), it proceeds to the processings of step A134 to step A140. Namely, in step A134, each of the pre-transfer charger 207, the transfer charger, and the stripping charger 209 are turned off. In step A136, the motor 425 for the developing units, the clatch of the first developing unit 203, the clatch of the second developing unit 206, the first charging unit 201, and the second charging unit 204 are turned off. in step A136, the motor 425 for the developing units, the clatch for the first developing unit 203, the clatch for the second developing unit 206, the first charger 201, and the second charger 204 are turned off. In step A138, the drum motor of the photosensitive body 200, the discharger 211, the first laser unit 321, the second laser unit 322, and the motor for the fixing unit 222 are turned off. In step A140, the blade solenoid is turned off. Further, the steps A134 to A140 may be carried out at the same time en bloc. However, from the viewpoint of avoiding to have steps of potential in one sheet of transfer paper, delay processings are provided in steps A135, A137, and A139.

Figure 64A:
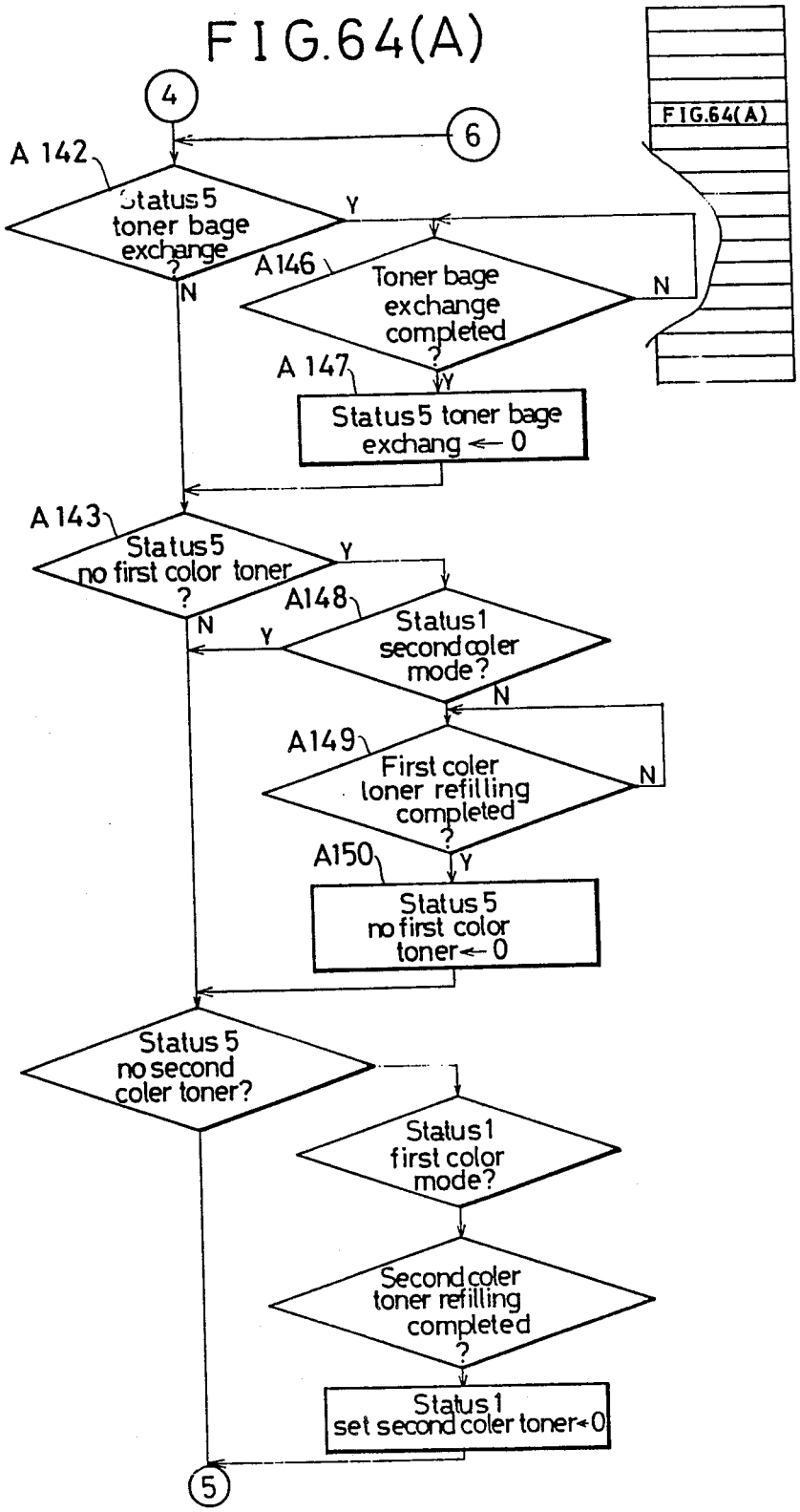
Figure 64B:
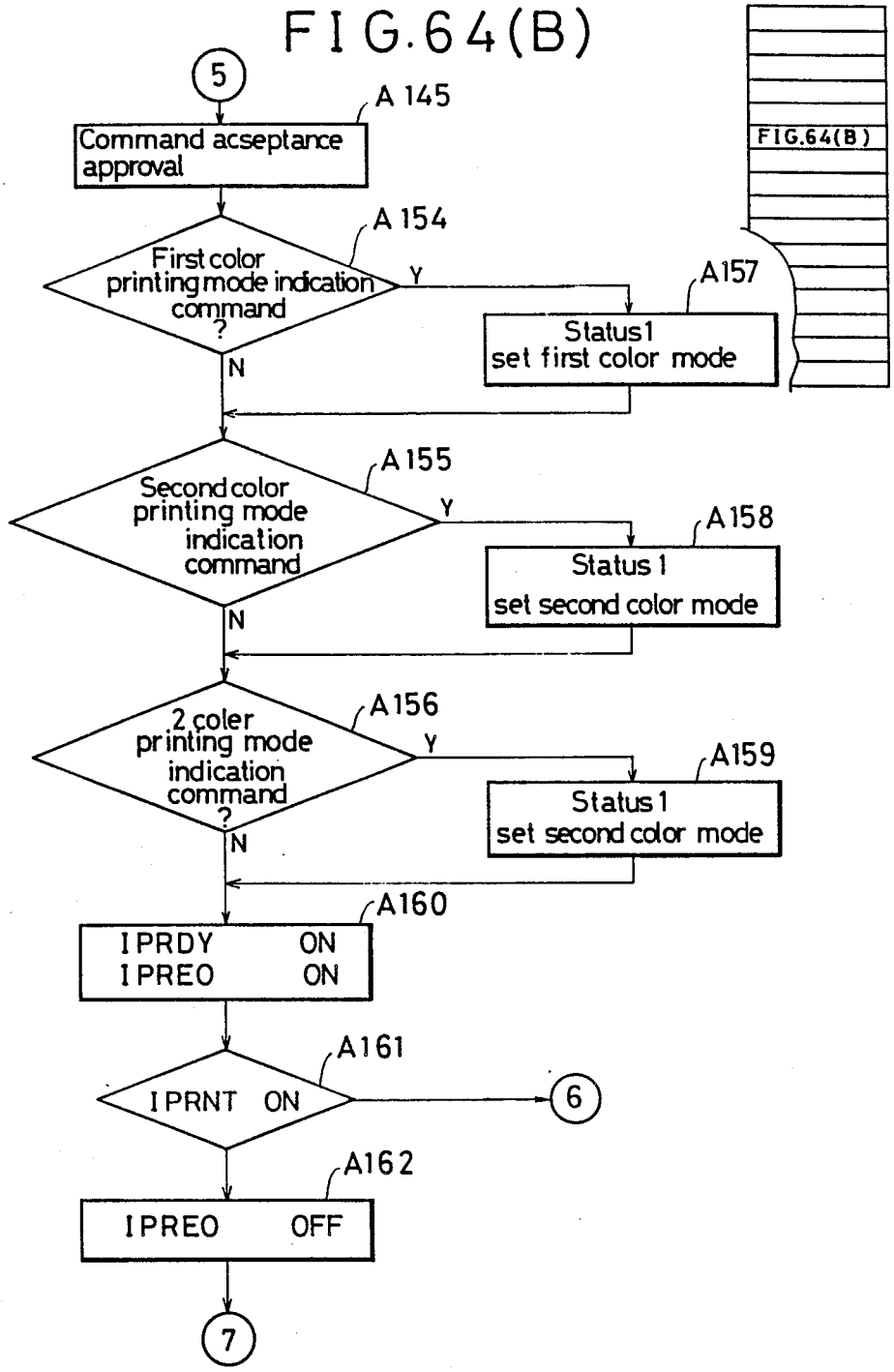

Thereafter, with the fixing unit 221 in ready state (affirmation of step A141), each step of the self-diagnosis and warm-up are completed, and it proceeds to the routine shown in FIG. 64.

In FIG. 64, there are shown processings of reporting the condition of each part of the dichromatic LBP 199 to the host system, and outputting the print request when there are received normal judgment about the condition of each parts from the host system 500.

In FIG. 64, judgment is obtained first from the host system about the contents of status 5 read from the table housed in the ROM 503 (steps A142 to A145). Namely, in step A142, whether or not the toner bag is to be exchanged is judged. If it is necessary to be exchanged (affirmation of step A142), after waiting for the exchange of the toner bag (step A146), and after completion of exchange (affirmation of step A146, and step A147), it proceeds to step A143. In step A143, whether there exists a no toner state of the first color is judged by ON/OFF of the empty step of the first developing unit 203. If there is no first color toner (affirmation of step A143), whether or not it is in the second color mode is checked by status 1 (step A148), and if it is in the first color mode and in the two color mode (negation of step A148), and proceeds to step A144 after completion of refilling of the first color toner of the first developing unit (affirmation of step A149 and step A150). In step A144, whether or not the second color toner is in empty state is judged by the ON/OFF of the empty switch of the second developing unit 206. If there is no second color toner (affirmation of step A144), whether or not it is in the first color mode is checked by status 1 (step A151), and if it is in the second color mode and two-color printing mode (negation of step A151), it proceeds to step A145 with the completion of refilling of the second color toner for the second developing unit (affirmation of step A152, and step A153). If it is in the first color mode (affirmation of step A151), it proceeds to step A145 by skipping steps A152 and A153.

In this way, a command acceptance approval is issued (step A145) from the host system 500 if there exist no abnormality in the conditions of the toners of the first developing unit 203 and the second developing unit 206.

Because of the above, if there is a command which indicates the first color printing mode (affirmation of step A154), the first color mode is set for status 1 (step A 157), and if there is a command which indicates the second color printing mode (affirmation of step A155), the second color mode is set in status 1 (step A158).

Further, if there is a command which indicates the two-color printing mode (affirmation of step A156), the two-color mode is set in status 1 (step A159).

Then, when in the ensuing step A160, a processing is carried out which turns on IPRDY and IPRE, there is carried out a processing which judges whether or not IPRNT is in the on-state. If it remains in off-state (negation of step A161), it goes back to step A142, and if it is in on-state (affirmation of step A161), completes the acceptance of a print request (step A162), and it proceeds to the printing In FIG. 65, processings similar to the routine warm-up processings are executed in step A163 to step A174.

In the ensuing step A177, whether or not it is in the second color mode is checked by status 1. If it is not in the second color mode (negation of step A177), the clatch of the first developing unit 203 is turned on to drive the second developing unit 203 (step 178), and then it proceeds to step A179. If it is in step second color mode (affirmation of step A177), it proceeds to step A179 by shipping step A178.

In step A179, whether or not it is in the first color mode is checked by status 1. If it is not in the first color mode (negation of step A179), the clatch of the second developing unit 206 is turned on to drive the second developing unit 206 (step A180), and proceeds to step A181. If it is in the second color mode, it proceeds to step A181 by shipping step A180.

In step 181, the bias table data about the toner color of the first developing unit 203 is read, and in the ensuing step A181, the bias table data read is set in the D/A converter 578. In the next step A183, the bias table data about the toner color of the second developing unit 206 is read, and in the ensuing step A184, the bias table data that is read is set in the D/A converter 584.

After an ensuing delay processing (step A185), a potential control before a first printing as shown in FIG. 70 is carried out (step A186).

Figure 72:
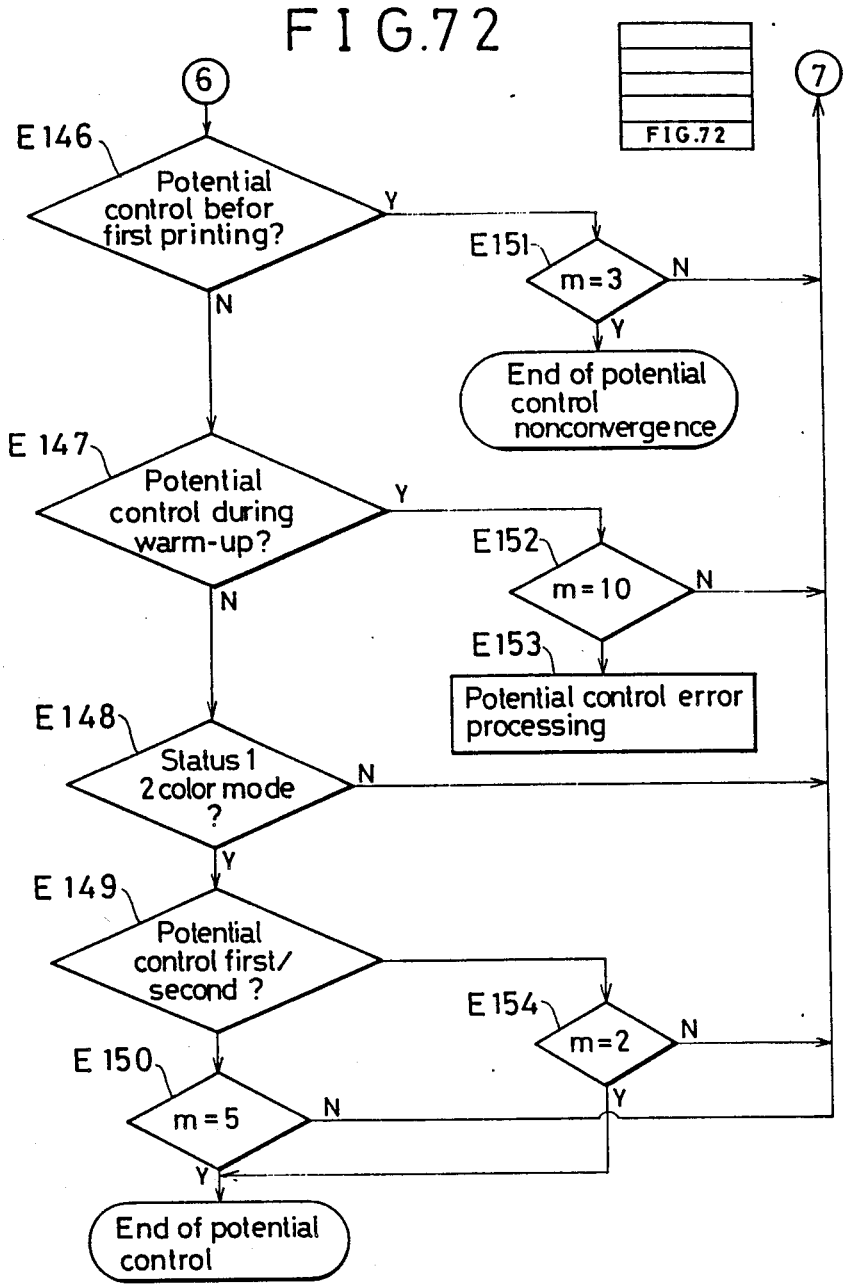
Figure 73:
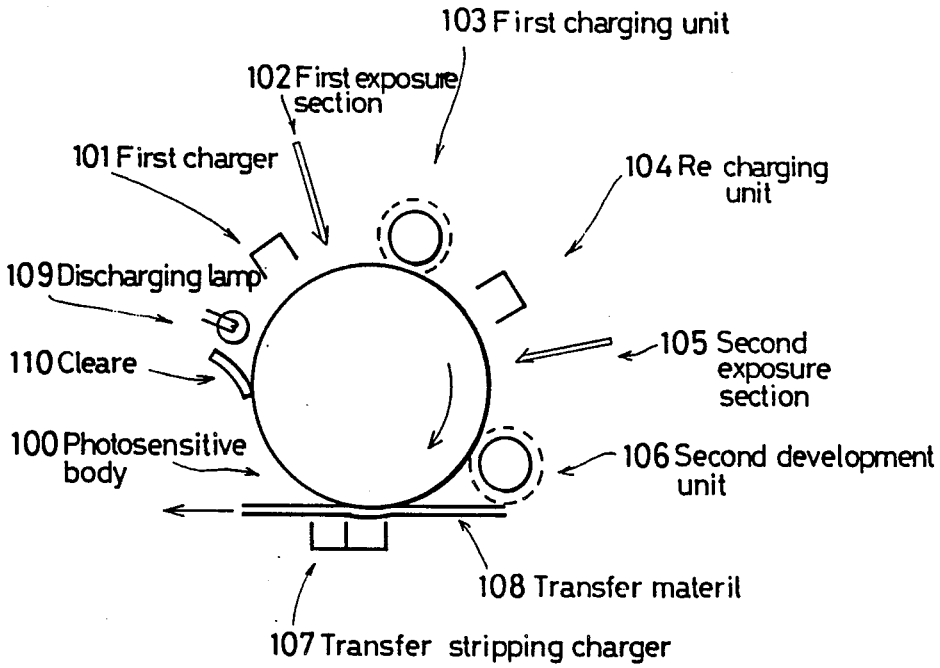
FIG. 73 is an explanatory diagram for the configuration of the conventional recording apparatus.
Figures 74A, 74B, 74C:
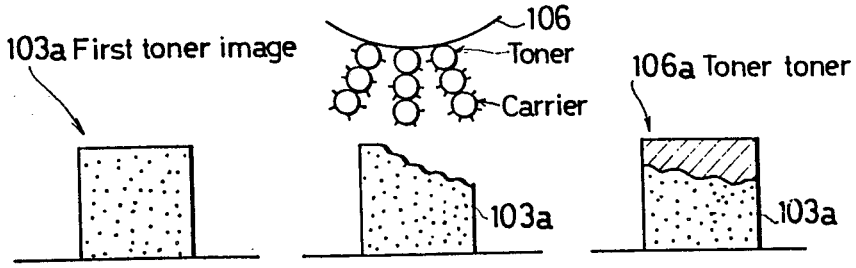
FIGS. 74A, 74B, 74C and FIG. 75 are diagrams that show respectively examples of the problem in the existing apparatus.
Figure 75:
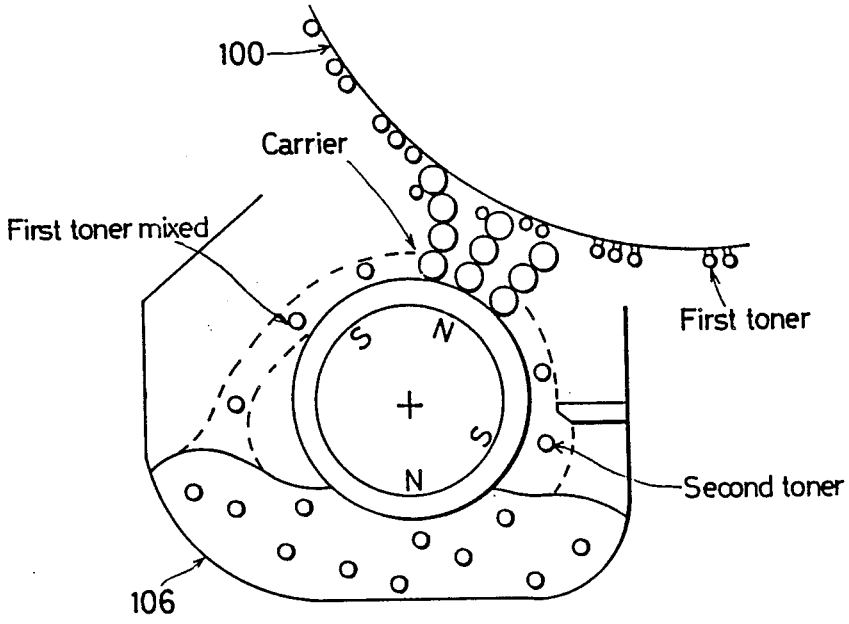

In an ensuing step A187, whether or not it is in the second color mode is checked by status 1. If it is not in the second color mode (negation of step A187), the development bias 409 of the first developing unit 203 is turned on (step A18) before proceeding to step A190. If it is in the second color mode (affirmation of step A187), it proceeds to step A190 by skipping step A188, and at the same time, a control on the potential by second charging as shown in FIG. 71 and FIG. 72 is carried out (step A189).

In step A191 that follows a delay processing of step 190, whether or not it is in the first color mode is checked by status 2. If it is in the second color mode (negation of step A191), the development bias 409 of the second developing unit is turned on (step A192) and proceeds to step A194. If it is in the first color mode (affirmation of step A191), it proceeds to step A194 by skipping step A192, and at the same time, a control on the potential by the first charging as shown in FIG. 71 and FIG. 72 is carried out (step A193).

In step A194, whether the paper feeding cassette is in the top or in the bottom is judged by status 1. When it is judged to be the top one, the paper feeding motor is driven to be rotated in the forward direction to feed a paper in the top cassette (step A195) to proceed to step A199, and at the same time, the paper feeding motor is turned off (step A109) after a delay processing of step A208. On the hand, if it is judged to be the bottom one, skips step A195, and after a delay processing (step A196), the paper feeding motor is rotated in the reverse direction to feed a paper in the bottom cassette (step A197) before proceeding to step A199, and at the same time, after a delay processing of step A208 it turns off the paper feeding motor (step A209).

In step A199, whether or not it is in the second color mode is confirmed by status 1. If it is in the first color mode (negation of step A199), it proceeds to step A202 after a delay processing of step A200, and if it is in the second color mode (affirmation of step A199), it proceeds to step A202 after a delay processing of step A201.

In step A202, it confirms that beam detection is ready by a horizontal synchronized signal HSYNC before proceeding to step A204. If on the other hand beam detection is not ready (negation of step A202), it carries out a beam detection failure processing.

In step A204, the page top counter, page end counter, margin counter, right margin counter, and a two-beam scan length correction value are set.

In the ensuing step A205, a vertical synchronized signal VSYNC request of status 1 is set. At the same time, it waits for a scan command by a vertical synchronized signal VSYNC (step A206), and when there is issued a command (affirmation of step A206), a vertical synchronized signal request of status 1 is reset (step A207).

Figure 66A:
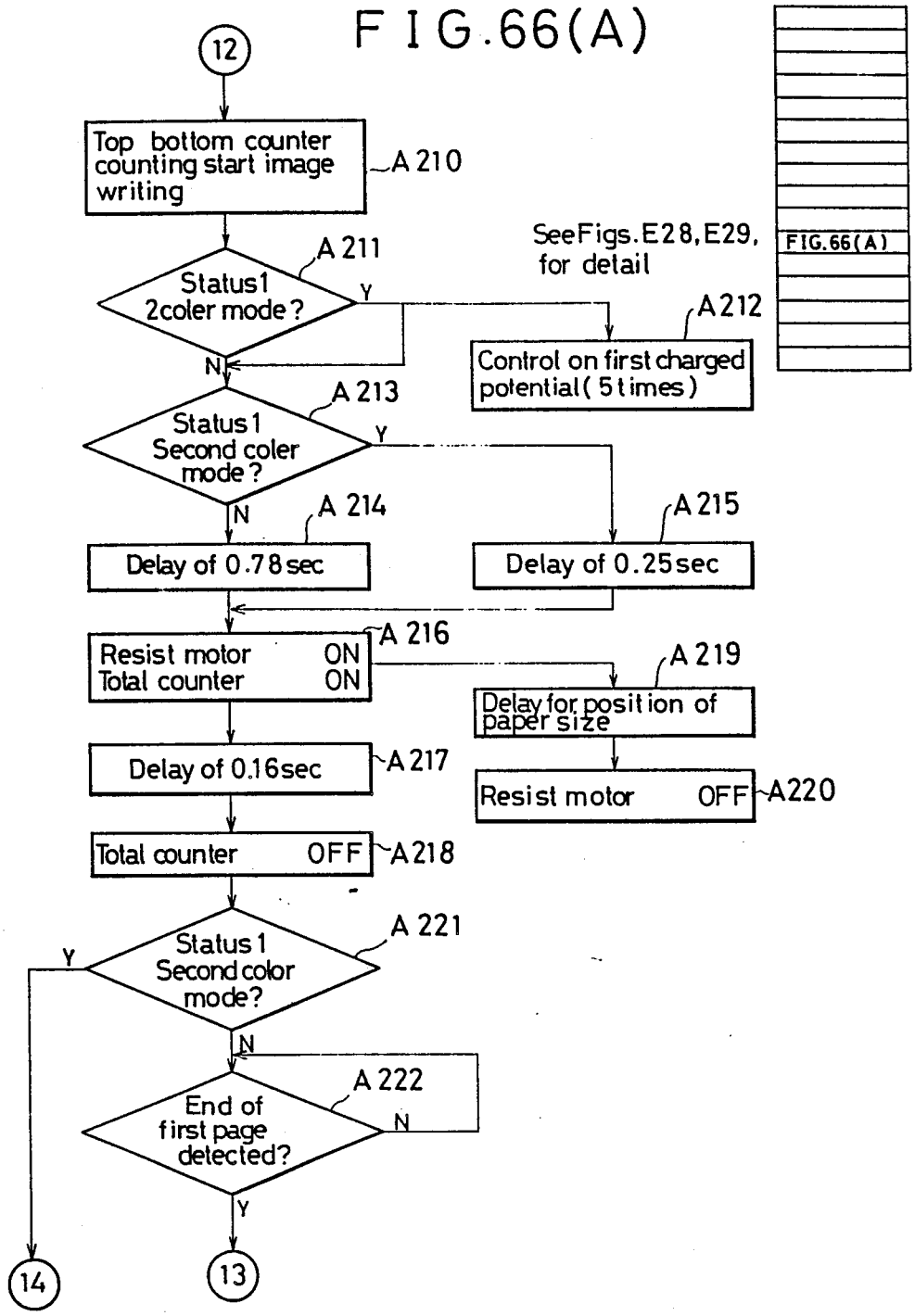
Figure 66B:
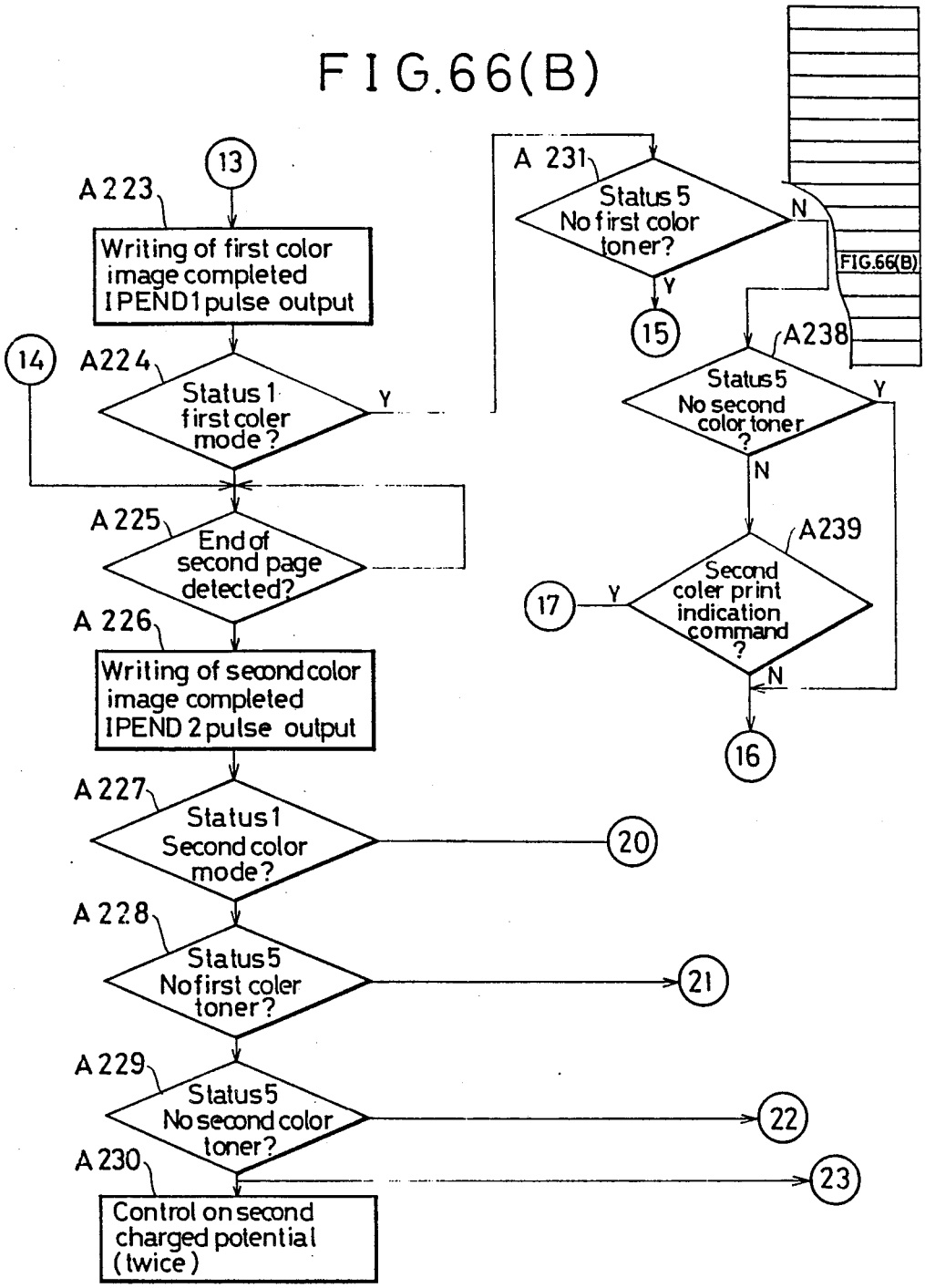
Figure 66D:
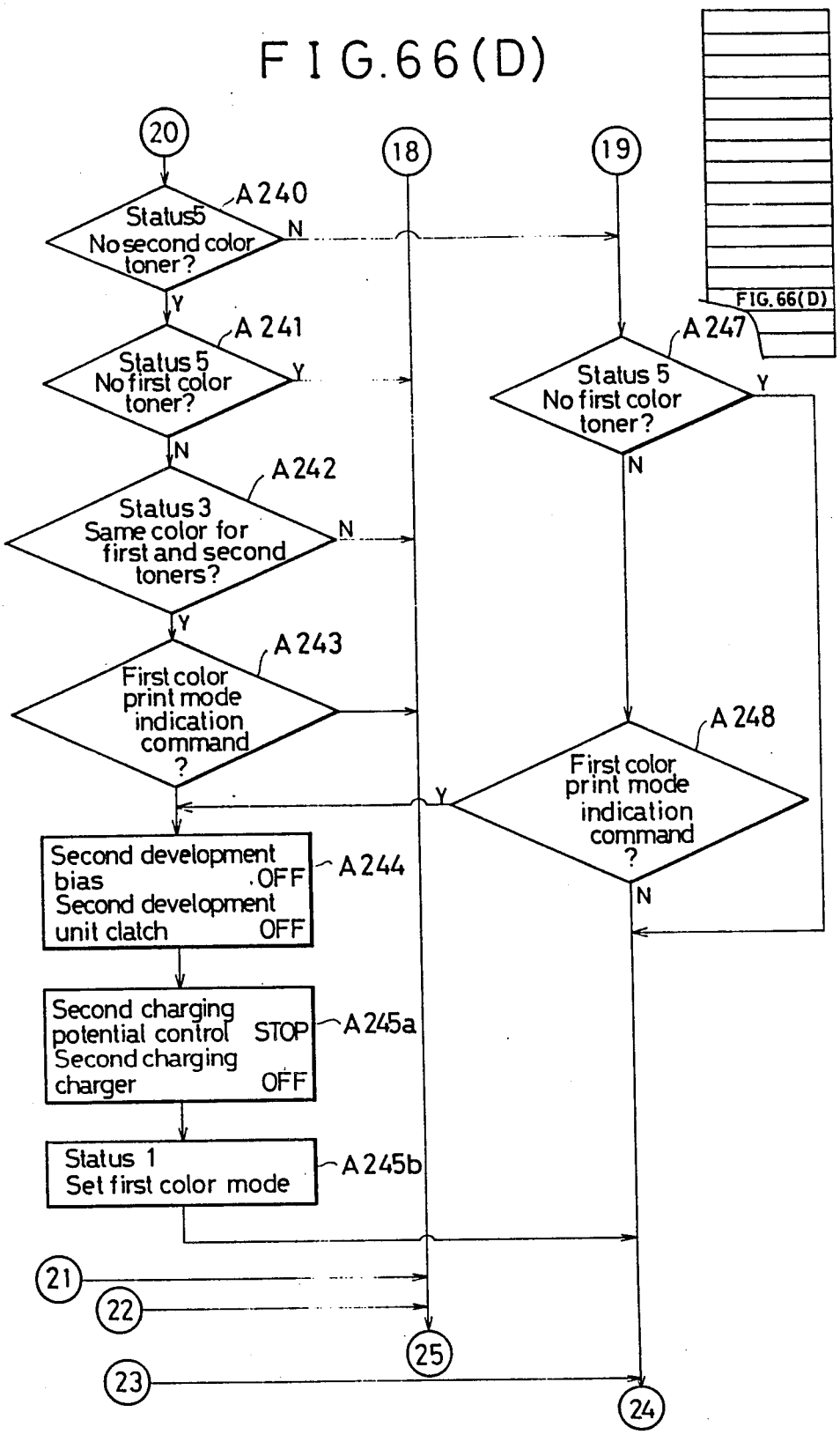

In an ensuing step A210 of FIG. 66, counting by the top/bottom counter is started to write an image. Following that, whether or not it is in the dichromatic printing mode is confirmed by status 1 (step A211). If it is in the first color mode or in the second color mode (negation of step A211), it proceeds to step A213, and if it is in the dichromatic mode (affirmation of step A211), it proceeds to step A213 as well as repeats the control on the potential by the first charging as shown in FIG. 71 and FIG. 72 for five times (step A212).

In the ensuing step A213, whether or not it is in the second color mode is confirmed by status 1. If it is not in the second color mode (negation of step A213), after a delay processing of step A214 it proceeds to step A216, and if it is in the second color mode (affirmation of step A213), after a delay processing of step A215 it proceeds to step A216.

When in step A216 the resist motor is turned on and the total counter is turned on, after a delay processing (step A217) it proceeds to step A221 by turning off the total counter, and at the same time, after a delay for the portion of the paper size (step A219) the resist motor is turned off (step A220).

In step A221, it is confirmed again whether or not it is in the second color mode. If it is not in the second color mode (negation of step A221), the first color image writing is completed when the first page end is detected (affirmation of step A222) and an IPEND 1 pulse is output (step A223).

Figure 67A:
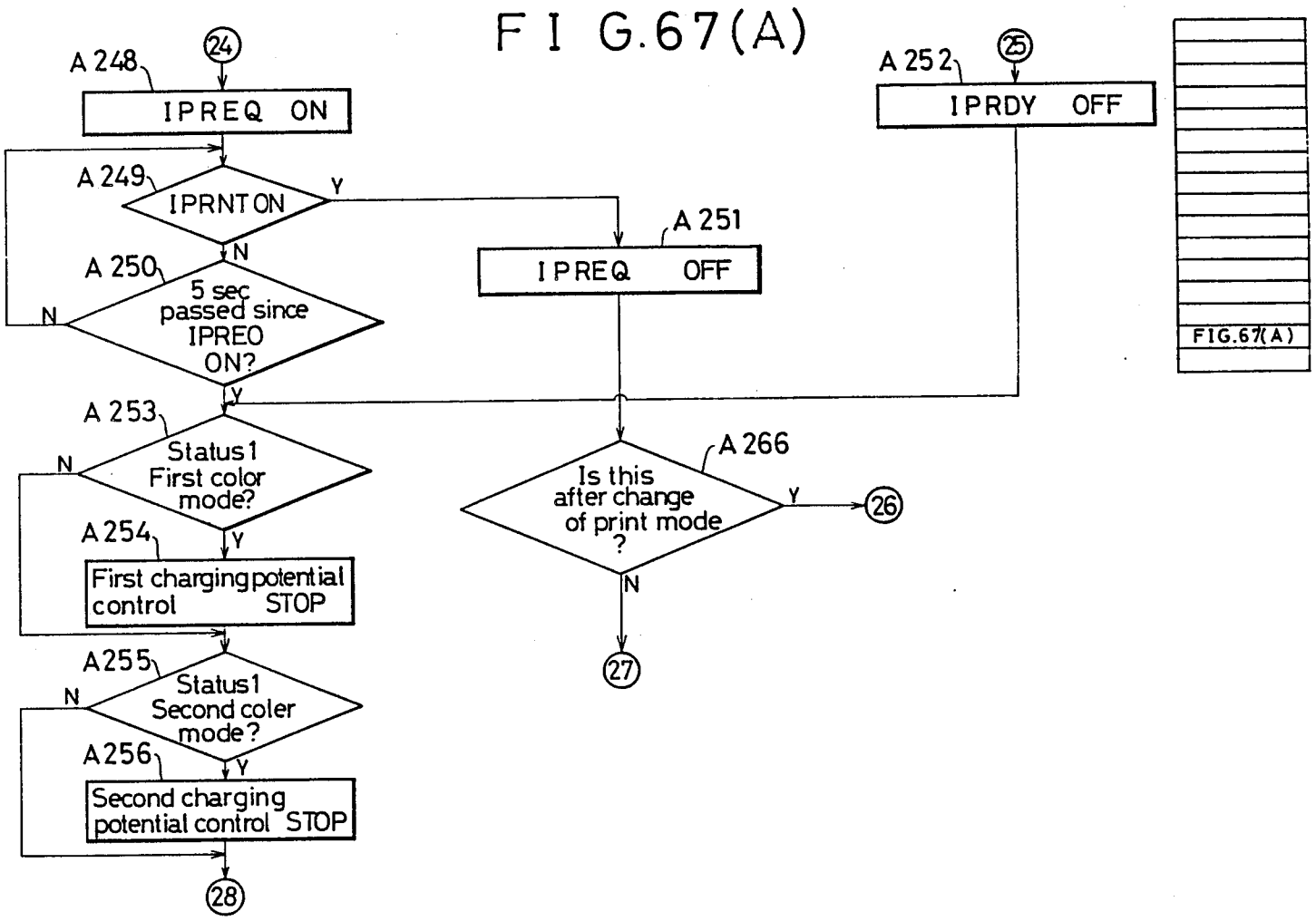

In this case, if status 1 is the first color mode (affirmation of step A224), with the first color toner in the first developing unit 203 (negation of step A231), when there is an indication command for the first color printing mode affirmation of step A247) after judgment by step A238→step A239→step A246, the development bias 409, and its clatch, of the second developing unit 206 are turned off (step A244), the second developing unit 204 is turned off (step A245*a*) by an interruption of the charged potential control of the second developing unit 204, the first color mode of status 1 is set (step 245*b*), and a print request IPREQ is turned on (step A248), as shown in FIG. 67.

Here, if there is no first color toner in the first developing unit 203 (affirmation of step A231), and further, there is no second color toner in the second developing unit 206 (affirmation of step A232), the print ready signal IPRDY is turned off (step A252) as shown in FIG. 67.

Further, even if there is no first color toner in the first developing unit 203 (affirmation of step A231), when there is the second color toner in the second developing unit 206 (negation of step A232) and both of the first color and the second color have the same color (affirmation of step A233), the development bias 400 of the first developing unit 203 and its clatch are turned off (step A235) at the time when there is issued an indication command for the second color printing mode (affirmation of step A234. Then, the first charger 201 is turned off by an interruption of the control on charged potential of the first charger 201 (step A236), the second color mode of status is set (step A237), and through negation of step A246 and a following step A247, a print request IPREQ is turned on (step A248).

In contrast to the above, with status 1 being the first color mode in step A224 and the second color toner in the second developing unit 206 (affirmation of step A238), if there is an indication command for the second color printing mode (affirmation of step A239), the development bias of the first developing unit 203 and its clatch are turned off (step A235), the first charging unit 201 is turned off by an interruption of the control on the charged potential of the first charger 201 (step A236), the second color mode of status 1 is set (step A237), and through the judgments of step A246 and step A247 or a judgment of step A246, a print request IPREQ is turned on (step A248).

On the other hand, when it is judged that it is second color mode, in step A221 and step A224, the second color image write is completed with the detection of the second page end (affirmation of step A225), and a IPEND 2 pulse is output (step A226).

In this case, even if status 1 is no second color toner (affirmation of step A240), when the first color is in the first developing unit 203 (negation of step A241) and both of the first color and the second color are the same color (affirmation of step A243), the development bias of the second developing unit 206 and its clatch are turned off (step A244) at the time when an indication command for the first color printing mode is issued (affirmation of step A243) and the second charger 204 is turned off by an interruption of control on the charged potential of the second charger 204 (step A245). After a first color mode of status 1 is set (step A245*a*), a print request IPREQ is turned on as shown in FIG. 67 (step A248).

Further, in step A227 if status is other than the second color mode, whether or not "no first color toner" is judged by status 5 (step A228), and whether or not "no second color toner" is judged by status 5 (step A229). Then, if there is no toner in both of step A228 and step A229, the print ready IPRDY is turned off (step A252).

In addition, if there are toners of the first color and the second color exist (negation of step A228 and negation of step A229), it proceeds to step A248. At the same time, control on the potential by second charge is carried out twice as shown in FIG. 71 and FIG. 72 (step A230).

Moreover, by deleting the judgments of step A233 and step A242 from the routine of step A221 through step A248, it is possible to carry out continuous development by switching development even when the toners of the first developing unit 203 and the second developing unit 206 are not the same color.

In FIG. 67, after the processing of turning on a print request IPREQ in step A248, a judgment processing is carried out by waiting 5 seconds from turning-on of the print request IPREQ (steps A249 and A250). If there is the print request IPREQ (affirmation of step A249), the print request IPREQ is turned off (step A251) to judge whether or not the printing mode is changed (step A266).

If the printing mode is changed (affirmation of step A266), it returns to step A177, and the first developing unit 203 or the second developing unit 206 is brought to the developable state, by watching satus 1 and status 2 between step A177 and step A194.

If the printing mode is not changed (negation of step A266), it returns to step A194, and the processings between step A177 through step A194 are omitted.

However, in the case of either printing mode, processings are carried out for both cases without having the processing of step AlOl through step A174, so that the recording operation can be continued without temporarily interrupting the dichromatic LBP 199.

In contrast, when the judgment processing of waiting the print request IPREQ for 5 minutes (step A249 and A250), if 5 seconds elapsed (affirmation of step A250), after an interruption processing of step A253 to step A265, it goes back to step A101 and goes into the waiting state which is waiting for a command from the host system 500.

Further, when the print ready IPREQ is turned off (step A252), the printing operation becomes unnecessary so that after the interruption processing of step A253 through step A265 it returns to step AlOl and goes into the state waiting for a command from the host system 500.

Figure 65C:
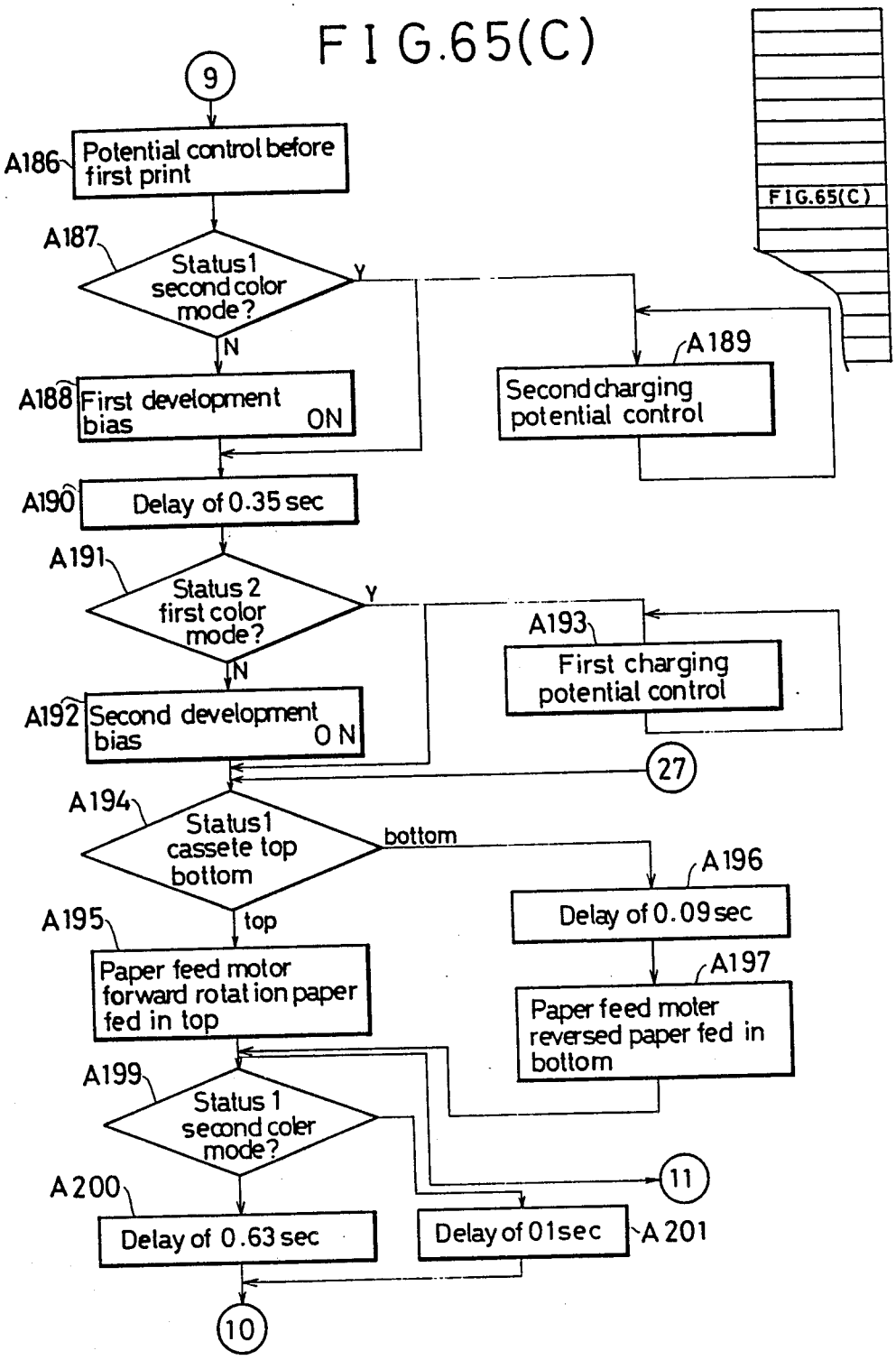
Figure 65D:
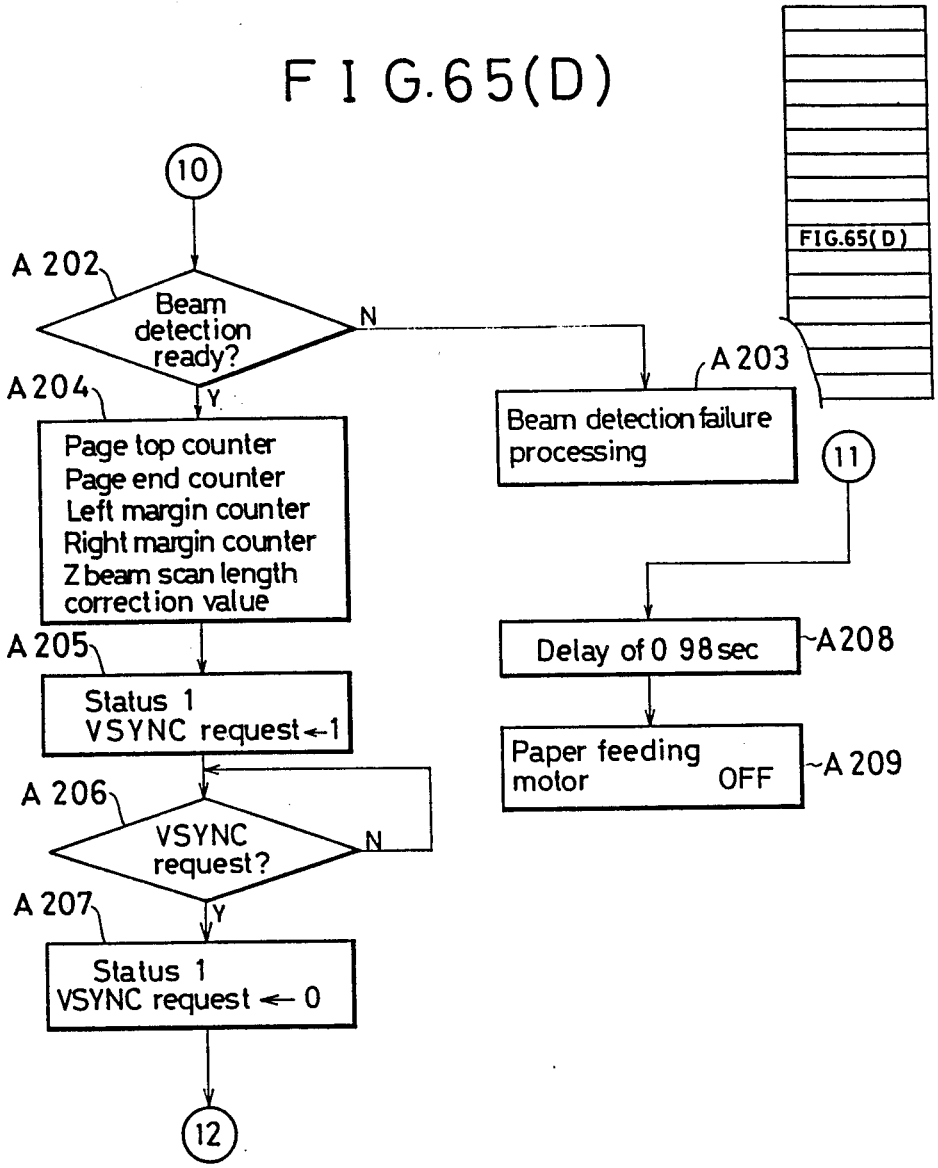
Figure 68A:
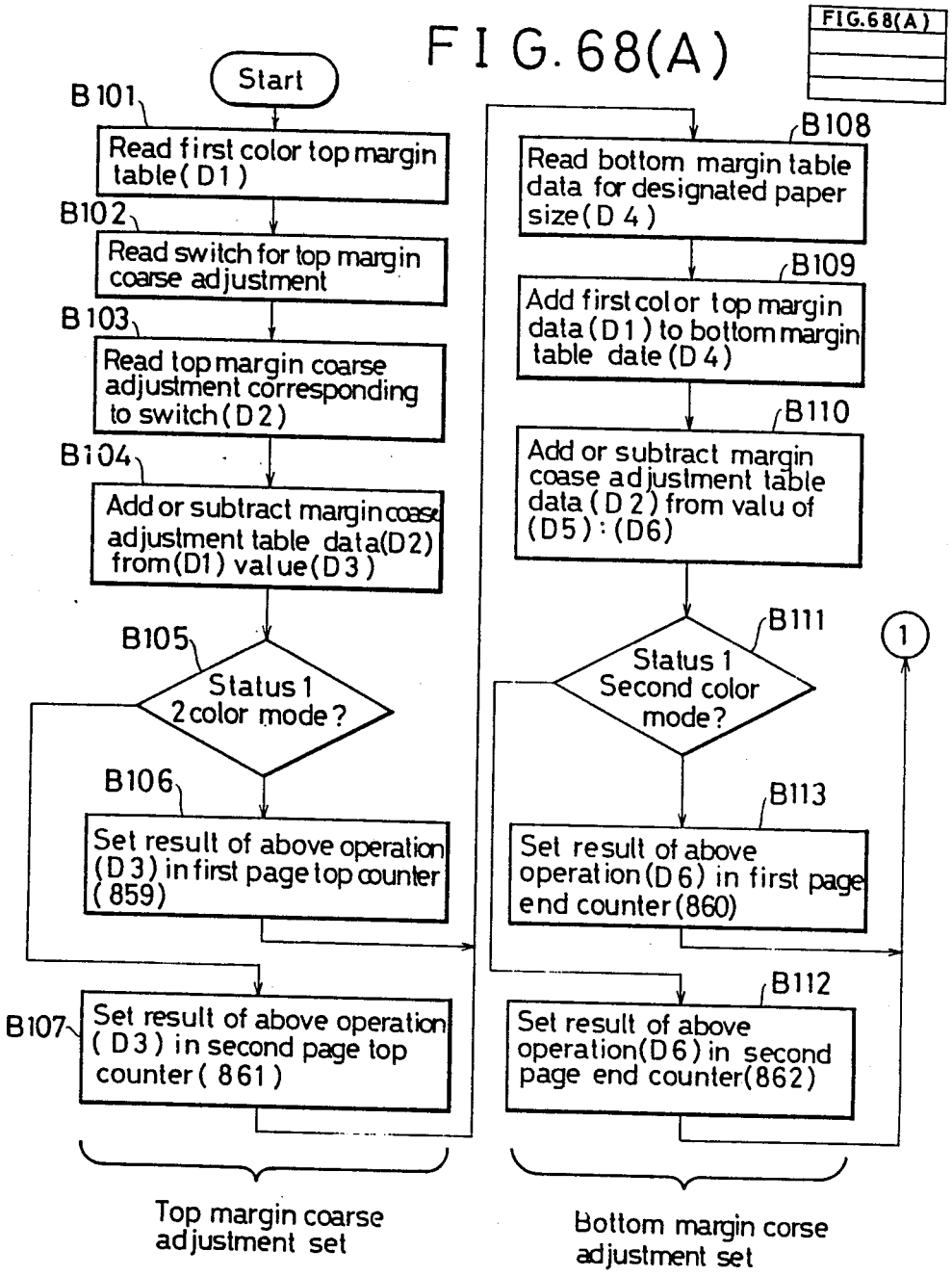
FIGS. 68A, 68B, 69A and 69B are flow charts for showing subroutine for setting the page top counter, page end counter, left margin counter, right margin counter, and two-beam scanning length correcting valve.
Figure 68B:
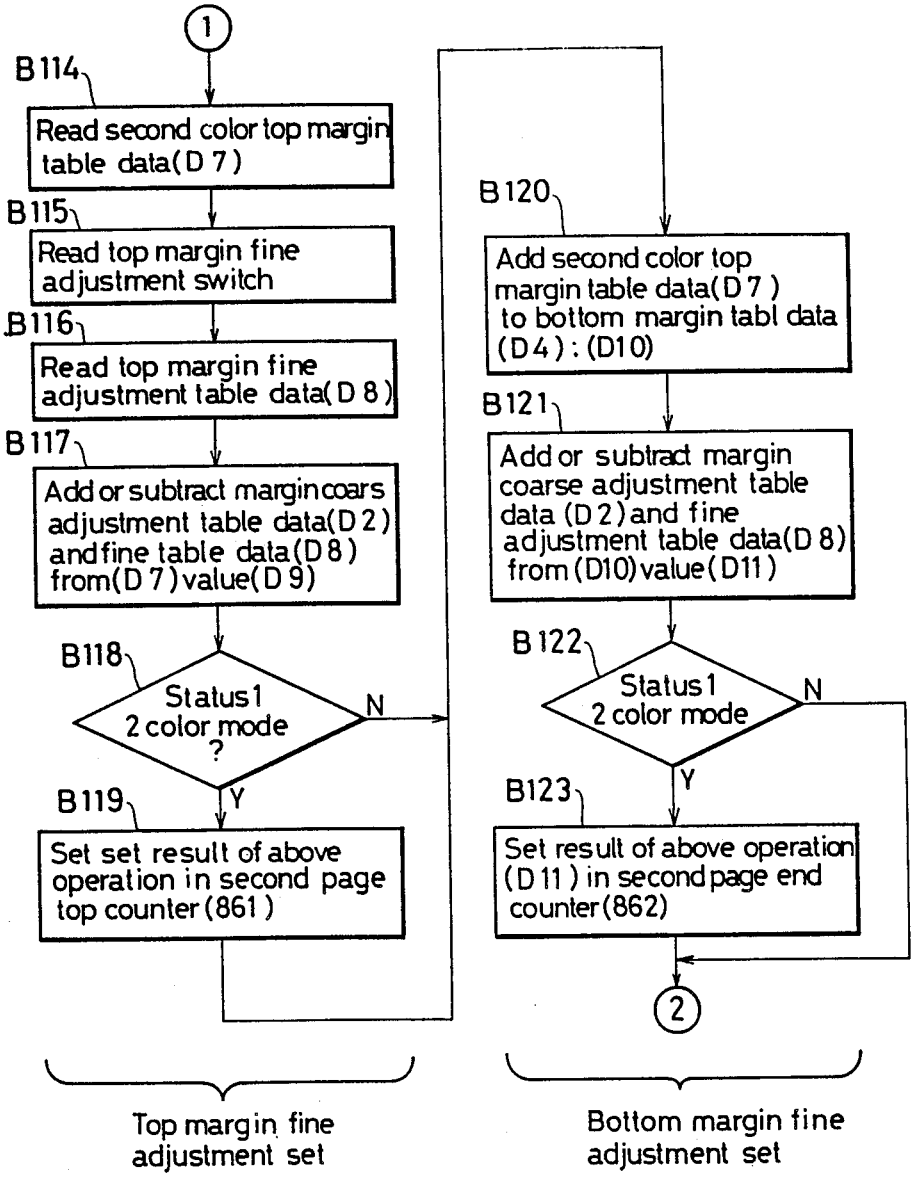
Figure 69A:
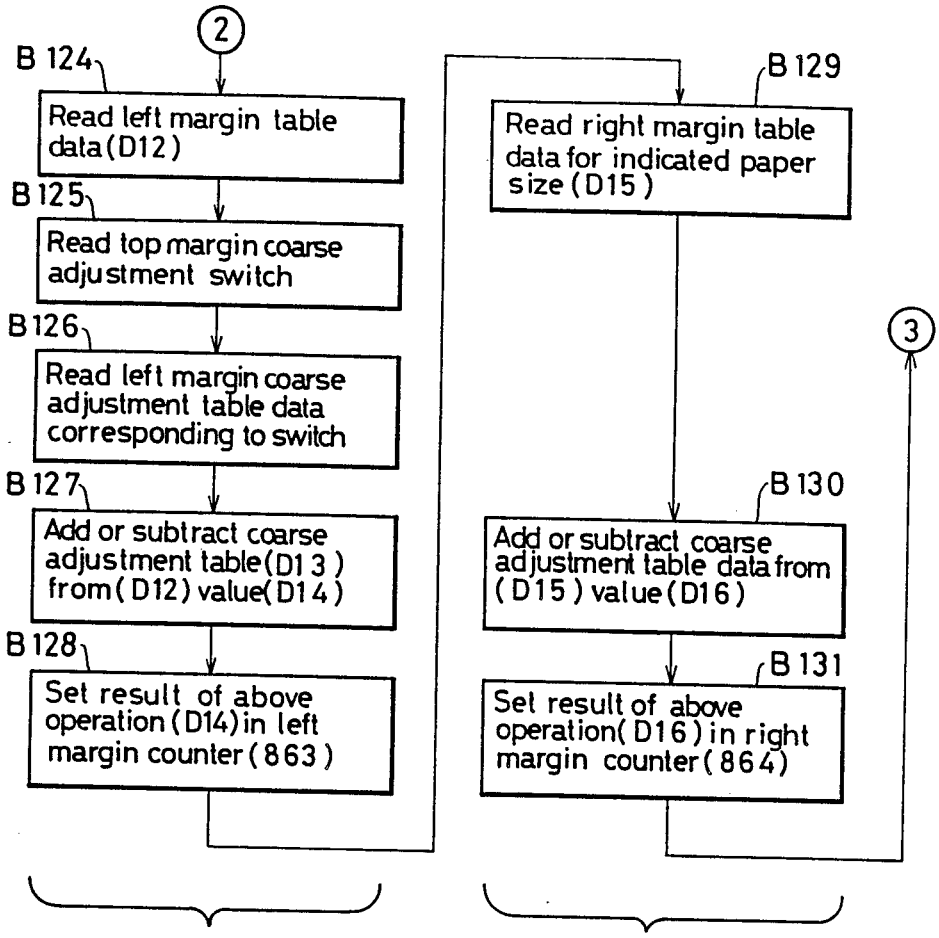
Figure 69B:
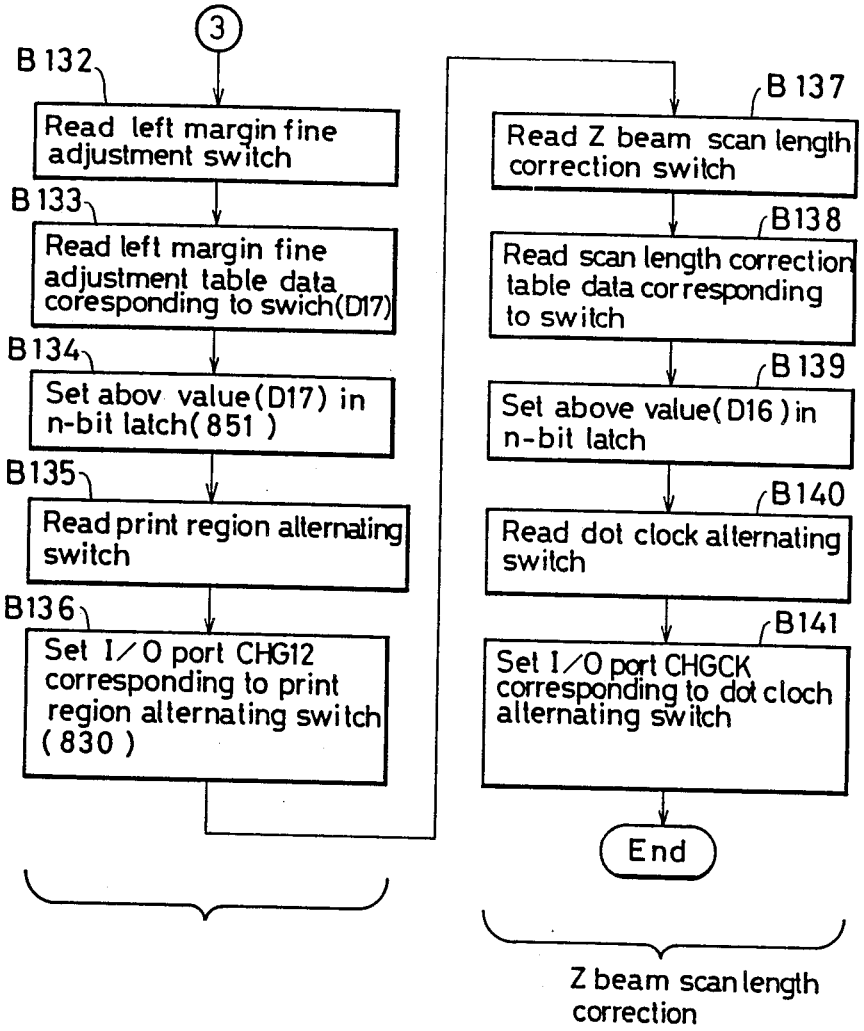

FIG. 68 and FIG. 69 are flow charts that show step A204 shown in FIG. 65.

The subroutine shown in FIG. 68 and FIG. 69 can be classified into a top margin coarse adjustment setting processing of step B101 to step B107, a top margin fine adjustment setting processing of step B114 to step B119, a bottom margin fine adjustment setting processing of step B120 to step B123, a left margin coarse adjustment setting processing of step B124 to step B128, a right margin coarse adjustment setting processing of step B129 to step B131, a right margin fine adjustment setting processing of step B132 to step B136, and a two-beam scan length correction setting processing of step B137 to step B141, and their details are as shown in the figures.

FIG. 70 is a flow chart which shows the potential control during warm-up and the potential control before first print.

In the potential control during warm-up, the value CHDT1 of the first time controlled output by first charging is read from the table data (step C101), and set the value that is read in the D/A converter 576 (step C102). Further, the value (CHDT2) of the first time controlled output by second charging is read from the table data (step C103), and the value that is read is set in the D/A converter 582 (step C104).

When the first charger is turned on in the ensuring step C105, a control on the potential by first charging is carried out (step C106) as shown in FIG. 71 and FIG. 72. After an ensuing delay processing (step C107), a control on the potential by second charging is carried out (step C109).

.Then, the number of times of the potential control, n, is incremented (step C110), and the steps from C105 to Clll are repeated until the number n of the potential control reaches three. When the control is repeated for three times, the first charger 201 and the second charger 204 are turned off (step 112), the potential control in warm-up is completed.

For the potential control before first print, if status 1 is not the second color mode (negation of step 101), the first charger 201 is turned on (step D102) to carry out the first charge potential control (step D103), as shown in FIG. 71 and FIG. 72. If it is the first color mode only (affirmation of step D104), the pre-first-print potential control is completed.

In addition, if it is to carry out the second color mode also (negation of step D104), after a delay processing (step D105), the second charger is turned on to carry out a second charged potential control (step D107) as shown in FIG. 71 and FIG. 72, completing the pre-first-print potential control.

Moreover, if status 1 is the second color mode in the initial step D101, the second color mode alone is executed so that the second charger 204 is turned on (step D106) to carry out a second charged potential control (step D107) as shown by FIG. 71 and FIG. 72, completing the pre-first-print potential control.

FIG. 71 and FIG. 72 are flow charts that show details of the charged potential control processing.

In the subroutine shown in FIG. 71 and FIG. 72, first, the drum temperature detector 570 is selected by the A/D converter (step E101), and when temperature measurement of the photosensitive body 200 is carried out (step E102), either of the first charged potential control or the second charged potential control is selected (step E103), and based on the data table of the ROM 503, processings in step E104 through step E109 are executed in the case of the first charged potential control, and processings of step E113 through step E118 are executed in the case of the second charged potential control.

Then, in step E110 and step E119, the first target surface potential data (VOS 1) and the second target surface potential data (VOS 2) are corrected so as to correspond to the actual temperature of the photosensitive body 200, to obtain the corresponding correction data VOS 1' and VOS 2', respectively.

In the ensuing steps Elll and step E120, operational processings as shown are carried out in order to store the values obtained in step E104 through step E110 and the values obtained in step E113 through step E119, respectively, in a common register.

In the next step E112 and step E121, the first potential sensor 202 and the second potential sensor 205, respectively, are selected by the A/D converter 593.

Next, for both cases of the first charged potential control and the second charged potential control, processings that follow step E 122 are carried out.

First, a delay processings for the times corresponding to the path length between the first and second chargers 201, 204 and the first and second surface potential sensors 202, 205, are carried out to measure the surface potential Vs from the first and second surface potential sensors 202 and 205 (steps E122 and E123).

In the following steps, processings are carried out based on the data obtained in step Elll and step E120.

Namely, in step E124, self-diagnosis is carried out to see whether the read value is greater than Va in accordance with the formula $$VS \geqq = Vos + Vomax$$

If it is greater (affirmation of step E124), a processing for potential control error is carried out (step E125). If it is smaller (negation of step E124), it proceeds to step E126.

In step E126, it is judged whether or not the read value is in coincidence with the target value and the control width of the error table according to the formula $$Vs = Vos \pm Voz$$

If they do not coincide (negation of step E126), how far the read data is away from the target data, for example, 200 V, 100 V, and 50 V, is examined (steps E127, E128, and E129). Then, processings of setting the control value to be equal to X1 or X2, 2 times, 4 times, or 6 times (steps E130, E131, E132, and E133).

After these settings, it proceeds to step E134 to set the charged output. In the ensuing step E135, whether or not the charged output is greater than its maximum value is checked, and in the next step E136 whether or not the charged output is smaller than its minimum value is checked. If it is greater or smaller (affirmation of step E 135 or affirmation of step E136), there is carried out a potential control error processing (step E137).

Then, if the charged output is within the control width (negation of step E135 and negation of step E136) it proceeds to step E138 where it is judged which of the first charger 201 or the second charger 204 the actual object of the potential control is.

If the result of judgment is the first charger 201, after setting $$CH_{DT1Y} = CH_{DT}$$

(step E139), a processing of setting $CH_{DT1}$ in the D/A converter 576 is carried out before proceeding to step E145.

If the result of the judgment is the second charger 204, after setting $$CH_{DT2Y} = CH_{DT}$$

(step E141), a processing of setting $CH_{DT2}$ in the D/A converter 582 is carried out before proceeding to step E145.

In step E145, the number of times of the charged potential control is incremented, and proceeds to the routine of step E146 and the following steps shown in FIG. 72.

Namely, if it is a pre-first-print potential control (affirmation of step E146), with the number of times of potential control, m, to be equal to 3 (affirmation of step E151), nonconvergence by the potential control is completed, whereas it goes back to step E122 when m is less than 3.

Further, if it is the potential control in warm-up (step E147), after the number of times of potential control, m, equals to (affirmation of step E151), a potential control error is carried out (step E153), whereas it goes back to step E 122 when m is less than 10.

Moreover, if status 1 is not the two-color mode (negation of step E148), it goes back to step E122. However, if status is the two-color mode (affirmation of step E148), inquiry is made to see the object of the potential control is the first charger 201 or the second charger 202. If it is the first color mode, the potential control is completed with 5 times of potential control (affirmation of step E150), whereas if it is the second color mode, the potential control is completed with 2 times of potential control (affirmation of step E154).

As in the foregoing, in an embodiment of a dichromatic LBP 199 of the present invention, as may be seen from the flow charts in FIG. 63 to FIG. 67 that show the overall operation of the dichromatic LBP, if there is an indication to request another monochromatic printing mode comes in (corresponding to affirmation of step A221) from outside (namely, a host system) or from within (CPU 501), while the printer is in the printing operation according to the monochromatic printing mode that was accepted in the past, the indication is accepted after completion of the printing operation of the monochromatic printing mode that was accepted in the past (corresponding to step A251). In addition, corresponding to the switching operation of switching means that carries out switching operation of the electrostatic latent image formation means and the development means to those that correspond to another monochromatic printing mode (corresponding to step A266), it goes back to step A177 without transiting to the interruption mode for the photosensitive body 200 and others (step A253 through step A265), and drives to rotate the photosensitive body by control means in continuation to the monochromatic printing mode that was accepted in the past. Accordingly, for instance, while it is in a continuous monochromatic recording, it is desired to print the original information in another color, or it is desired to change both of the recording information and the recording color, it is possible to continue the recording operation of the dichromatic LBP without temporarily interrupting the operation of the apparatus.

Further, the embodiment has a configuration which consists of printing mode discrimination means which discriminates between a multi-color printing mode and a monochromatic printing mode (corresponding to step A221 and step A224), selection means which selects one combination out of a plurality of image formation processes required for the printing operation, based on the printing mode discrimination means, as shown in step A221 through step A248, and a control means which controls the printing operation according to the combination of the image formation processes that is selected by the selection means.

Accordingly, if there is an indication command of a first color printing mode (negation of step A247), the development bias of the second developing unit 206 and its clatch are turned off (step A244), and the second developing unit 204 (step A245) is turned off. Then, if there is an indication command for the second color printing mode (step A239), the bias 409 of the first developing unit 203 and its clatch are turned off to turn off the first charger 201 (step A236).

Further, the development means is equipped with the means of generating toner color information corresponding to the toner color of the development means, and the means of detecting the quantity of the toner of the development means corresponding to step A231 and step A232, step 240 to step A249, and step A228 and step A229). Moreover, it has means of comparing step A233 and step A242) toner color information of unused development means with that of development means which is currently in printing operation or which is set after completion of the printing operation, when the toner detection means of the development means detected that there is no toner, switching means (corresponding to step A234 and step A243) which, when there is information about coincidence of colors as a result of comparison of the comparison means, switches the usage mode to other development means and other electrostatic latent image formation means according to an indication from the outside (host system 500 or the CPU 501) after completion of the printing operation (corresponding to step A223), and control means for printing operation which carries out a predetermined printing operation by the switching means (step A221 through step A248), so that even if the toner is used up during a continuous monochromatic recording, for example, when there is the toner in other developing unit (in the flow chart of the present embodiment, only the case of having toner of the same color is described), it is possible to continue the recording operation without carrying out toner refilling by a temporary interruption of the apparatus operation.

Furthermore, as may be clear from the routine in step A101 through step A265, the monochromatic printing mode has a shorter time for one cycle of recording than in the multi-color printing mode.

As described in the foregoing, according to a recording .even if a second color is apparatus of the present invention, indicated during the printing operation with a first color, for example, it is possible to continue the rotational drive of the photosensitive body at the time when the printing operation with the first color is completed, so that the copying speed can always be maintained at a high level.

What is claimed is:

1. An image forming apparatus for forming an image on a recording member, comprising:
   - means for detecting a size of the recording member;
   - means for forming an image in accordance with a plurality of dot signals;
   - means for providing a clock signal for sending the dot signals synchronous with the clock signal; whose pulse number changes according to the size of the recording member detected by said detecting means;
   - means for receiving the clock signal provided by said clock signal providing means; and
   - means for sending image signals corresponding to said dot signals to said image forming means, synchronous with said clock signal received by said clock signal receiving means.

2. The image forming apparatus as claimed in claim 1, wherein the clock signal from said providing means is synchronized with a starting point of the image forming.

3. The image forming apparatus as claimed in claim 1, wherein the transmitting of clock signal by said providing means is stopped at an ending point of the image forming.

* * * * *